US010525472B1

(12) United States Patent
Pandey et al.

(10) Patent No.: US 10,525,472 B1
(45) Date of Patent: Jan. 7, 2020

(54) DROPLET ACTUATOR AND METHODS OF DROPLET MANIPULATION

(71) Applicant: Iowa State University Research Foundation, Inc., Ames, IA (US)

(72) Inventors: Santosh Pandey, Ames, IA (US); Riley Brien, Ann Arbor, MI (US); Taejoon Kong, Ames, IA (US); Zach Njus, Ames, IA (US); Jared Anderson, Cedar Rapids, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 350 days.

(21) Appl. No.: 15/140,182

(22) Filed: Apr. 27, 2016

Related U.S. Application Data

(60) Provisional application No. 62/153,121, filed on Apr. 27, 2015.

(51) Int. Cl.
*B01L 3/00* (2006.01)

(52) U.S. Cl.
CPC . *B01L 3/502792* (2013.01); *B01L 2200/0605* (2013.01); *B01L 2200/14* (2013.01); *B01L 2300/123* (2013.01); *B01L 2300/126* (2013.01); *B01L 2300/165* (2013.01); *B01L 2300/166* (2013.01); *B01L 2400/0457* (2013.01)

(58) Field of Classification Search
CPC combination set(s) only.
See application file for complete search history.

(56) References Cited

U.S. PATENT DOCUMENTS

| | | | | |
|---|---|---|---|---|
| 8,753,498 | B2 | 6/2014 | Chuang et al. | |
| 2009/0211645 | A1 | 8/2009 | Bohringer et al. | |
| 2012/0091003 | A1 | 4/2012 | Chuang et al. | |
| 2013/0316396 | A1* | 11/2013 | Fricking | C12M 27/16 435/41 |
| 2014/0138405 | A1* | 5/2014 | Inoue | C12M 29/00 222/55 |

(Continued)

FOREIGN PATENT DOCUMENTS

WO 2010151794 A1 12/2010

OTHER PUBLICATIONS

Adafruit Industries, "Adafruit Motor Shield," Adafruit Learning System, (2014), 56 pages, https://learn.adafruit.com/adafruit-motor-shield, last updated on May 12, 2014.

(Continued)

*Primary Examiner* — Brian R Gordon
(74) *Attorney, Agent, or Firm* — McKee, Voorhees & Sease, PLC

(57) ABSTRACT

Apparatus, methods, and systems for automated liquid droplet manipulation include an open droplet supporting surface. An actuator can translate the surface in space with at least one degree freedom of movement to influence movement of one or more droplets on the surface. In one embodiment, the surface is patterned with areas that attract the droplets and interstitial areas that repel the droplets to enhance transport of droplets. For example, for water-based droplets the attracting areas can be hydrophilic and the repelling hydrophobic. In one embodiment, the repelling areas are super-hydrophobic. Electromechanical movement of the surface avoids expensive and complex microfluidic fabrication and components, and avoids electrowetting requirements.

13 Claims, 67 Drawing Sheets

Droplet Actuator Platform

(56) References Cited

U.S. PATENT DOCUMENTS

2015/0018248 A1* 1/2015 Kim ..... B29C 45/1671 506/14
2018/0015437 A1* 1/2018 Lammertyn ..... B01J 19/0046

OTHER PUBLICATIONS

Celia, Elena, et al., "Recent Advances in Designing Superhydrophobic Surfaces," Journal of Colloid and Interface Science, www.elsevier.com/locate/jcis (2013), 18 pages Apr. 10, 2013.
Duncombe, Todd A., et al., "Controlling Liquid Drops with Texture Ratchets,"Advanced Materials (2012), www.MaterialsViews.com, pp. 1545-1550, 7 pages Feb. 14, 2012.
Duncombe, Todd A., et al., "Directed Drop Transport Rectified from Orthogonal Vibrations via a Flat Wetting Barrier Ratchet," Langmuir, American Chemical Society (2012), 6 pages Aug. 30, 2012.
Elsharkawy, Mohamed, et al., "Inkjet Patterned Superhydrophobic Paper for Open-Air Surface Microfluidic Devices," Lab on a Chip Paper, Royal Societ of Chemistry (2014) 11 pages Jan. 6, 2014.
Epson "WorkForce WF-2540" Brochure, 2 pages Sep. 1, 2012.
Kong, Taejoon, et al., "Motorized Actuation System to Perform Droplet Operations on Printed Plastic Sheets," Lab on a Chip Paper, Royal Society of Chemistry (2016) 12 pages Apr. 8, 2016.
Kong, Taejoon, et al., Supplementary Figures and Videos for "Motorized Actuation System to Perform Droplet Operations on Printed Plastic Sheets," Lab on a Chip Paper, Royal Society of Chemistry (2016) 22 pages Apr. 8, 2016.
Chiou, Pei Yu, "Light Actuation of Liquid by Optoelectrowetting," Elsevier Science B.V., www.sciencedirect.com, 8 pages Jun. 1, 2005.
Rust-Oleum NeverWet Technical Data Sheet, "Moisture Repelling Treatment," (2015) 2 pages Sep. 2, 2015.
Bi-Polar Electric Motor Tech Sheet, date unknown.

* cited by examiner

Droplet Actuator Platform

Droplet Actuator Platform

Droplet Release angle vs line thickness

Droplet Release force vs line thickness

Task 4 > One-directional Movement of Droplets:

Video 7-2: Task 4 > One-directional Movement of Droplets:

Top View

DROPLET ACTUATOR AND METHODS OF DROPLET MANIPULATION

CROSS-REFERENCE TO RELATED APPLICATIONS

This application claims priority under 35 U.S.C. § 119 to provisional application Ser. No. 62/153,121 filed Apr. 27, 2015, herein incorporated by reference in its entirety.

GRANT REFERENCE

This invention was made with government support under No. CBET1150867 awarded by National Science Foundation and No. HDTRA1-15-1-0053 from the Defense Threat Reduction Agency. The government has certain rights in the invention.

BACKGROUND OF THE INVENTION

A. Field of the Invention

The present invention relates to automated manipulation of liquid droplets, and in particular, to a system, apparatus, and method of influencing movement of one or more droplets relative to a surface.

B. Problems in the Art

There is a need for efficient and effective manipulation of liquid droplets. Just a few examples are immunology, protein chemistry, and biomarker identification. Another area of use would be in molecular diagnostics of physiological samples (e.g., dried blood, urine, saliva). Handling operations can include such things as transport, mixing, merging, dispensing, and particle separation from liquid droplets.

One long-used method is manual manipulation, such as with hand-held pipettes. For example, a typical biological experiment requiring one or more operations on liquid droplets can require multiple steps, such as pipetting, rinsing, washing, separating, lysing, incubation, and some detection technique. Although tools and components to accomplish these steps are generally not complex or costly, manual droplet manipulation can be cumbersome, time-consuming, and prone to human error.

Automated or semi-automated methods have been developed. Many current systems rely on automated liquid handling techniques.

Some of these systems rely on microfluidics. The fabrication of such systems can be costly. Many automated liquid handling systems can involve tens or even hundreds of thousands of dollars in capital costs. Digital microfluidic systems can help automate at least some of the steps but, again, they tend to be expensive. They may not be easily convertible between different droplet manipulation tasks or useable in a variety of different environments. For example, photolithography or other quite exacting fabrication techniques can implement a network of fluid pathway in a substrate according to a design plan. However, once fabricated, there are inherent limitations in the variety of tasks that can be performed with that network. Substantially different droplet manipulation may require a different, and just as costly, alternative network.

Another example of an automated system for liquid droplet manipulation is called electrowetting. Stimulus (very high electrical voltages, laser beams with electric voltage, or vibrations from sound-generating devices) changes the contact angle of droplets relative a surface, thereby changing their wettability. This phenomenon can be used to influence droplet movement relative a surface. However, this generally needs exacting calibration, has complexity and cost, and also requires electrical or acoustic energy at the droplets.

A need for improvement in this technical field has been identified by the inventors. This includes fabrication with less costly techniques and components, while having substantial flexibility and customization capabilities for a variety of droplet manipulation tasks.

BRIEF SUMMARY OF THE INVENTION

The present invention includes an apparatus and system for manipulation of liquid droplets in an automated fashion.

In a general aspect of the invention, an open or closed droplet-supporting surface is automatically translated or moved in space from and back to a home or starting position in a predesigned direction, speed, and amount. The translation and return is correlated to the type and makeup of the droplet to influence it to move in the direction of initial translation and stay at a spaced-apart, new position on the surface. Further cycle translations and returns can influence further movement in that direction. A droplet can thus be manipulated across the surface, at least in one direction, by simple one degree freedom of movement (here linear movement in the plane of the surface). The translation is designed to overcome any forces that try to keep the droplet in position.

One example is linear translation. Such linear translation can be effectuated in a variety of ways. A relatively quick movement in an in-plane direction would promote displacement of a droplet from its starting position. A quickly following return of the surface would further promote that displacement. A number of droplet manipulation tasks could be performed, including with one droplet or plural droplets.

Another example of translation of the surface in space is two degrees freedom of movement of the surface. This can provide for droplet transport in two directions relative to the surface. One example is linear translation in two different directions in the plane of the surface. Those directions could be orthogonal. They could be oblique. This would increase the variety of tasks that could be performed. An alternative two-degree freedom of movement translation would be tilting of the surface relative a single pivot point. By selection of tilting in one vertical plane (one degree freedom of movement), a second vertical plane (second degree freedom of movement), or some proportional combination of both, a droplet can be influenced to transport from one location to another on the surface. Relatively non-complex components can be connected to the surface to effectuate two-plane tilting. In one example two electric motors could be operated to tilt a platform supporting the surface in orthogonal vertical planes a range of tilt angle and speed to allow tilting in any direction. This further expands the variety of tasks possible. Control of motor pulley RPM controls the speed and amount of tilt, as well as return to home of the platform. In one embodiment, the belts can have at least a section which is elastic designed to assist droplet movement. The combination of amount and speed of tilt, the fluidic properties of the droplet, the hydrophobicity of the surface, and the elastic properties of the belts can produce a jerking action that can be managed advantageously for droplet movement and control.

In another aspect of the invention, the surface includes a predetermined pattern. In one embodiment, the pattern comprises areas at what will be called droplet positions arranged spaced-apart in or on the surface. These pattern areas can be formed in predetermined shapes and sizes. Those shapes and sizes can be the same at each droplet position, or different. In home position for the surface, the shapes and sizes at the droplet positions are configured for the droplet type and makeup to promote the droplet staying in a droplet position until sufficient translation is applied to the surface to move the droplet from that position. Direction, amount, and speed of translation influences direction of droplet movement on the surface. In one example, the shapes can be geometrical (e.g. dots, circles, triangles, squares, lines, etc.). In another example, the shapes can be similar to typographical symbols (e.g. + or plus-signs, > or < or greater than or less than signs, etc.). There can be other shapes or combinations of shapes. Size in terms of length width and thickness can vary depending on the fluidic properties of the droplet, hydrophobicity of the surface, hydrophilicity of the patterns, and the operation to be performed.

In one example, for water-based droplets, the patterned areas of the surface can comprise hydrophilic material or etched grooves at the droplet locations. Hydrophobic material can be in the interstitial areas between the droplet locations. Such droplets are influenced to stay in place at the droplet locations by the hydrophilic material until sufficient translation action of the surface overcomes the attraction. Hydrophobic areas help promote movement of the droplets between droplet locations. In one example, the surface can be an independent, removable/replaceable, thin film or sheet that can be overlaid upon a more rigid substrate or platform. The removable patterned surface can be held in place by electrostatic forces, adhesive, mechanical fasteners, or other techniques. The film or sheet itself can be made of hydrophobic material, or such a property can be added (e.g. a spray-on hydrophobic substance). The hydrophilic pattern can be inkjet printed onto the film or sheet. Alternatively, grooves can be cut or etched on the hydrophobic surface that encapsulates air pockets. This makes it easy to design and implement a pattern using standard typographical symbols. Font size can simply be changed to increase or decrease size of the symbols. Other configurations for hydrophilic and hydrophobic areas are, of course, possible. The use of a removable sheet and inkjet printing or cutting allows a very cost-effective, highly flexible way to create a variety of patterns for a variety of droplet types and tasks. Quick and easy selection of different printable shapes and sizes further increases the variety of droplet manipulations possible, including for plural droplets. The size and shape variances can influence droplets in different ways and, thus, allow different droplet reaction to each surface translation. This can facilitate such tasks as moving one type of droplet but leaving another type of droplet stationary. This can allow selective operations on one type of droplets, such as merging or mixing. This can facilitate movement of droplets in only certain directions. The combination of a printable pattern, relatively non-complex actuation, and open surface droplet support promote an economical yet highly flexible and customizable droplet manipulation system.

In another aspect of the invention, a method of automated manipulation of liquid droplets includes moving one or more droplets on a surface by controlled translation of the surface direction, amount, and speed, as well as return to home position. This can optionally include a predetermined pattern of droplet locations between interstitial areas on the surface for further control of the droplets. The predetermined pattern on the surface can include different shapes and sizes of droplet location patterns to facilitate different droplets, or different droplet motions. The method can use the apparatus discussed above.

Another aspect of the invention comprises a system for manipulating droplets comprising an open droplet supporting surface, an actuating sub-system to translate the surface with at least one degree freedom of movement, and a programmable controller sub-system to control the actuator to accomplish a variety of droplet manipulation tasks. The programming can store a wide variety of different tasks, any of which can be selected for actuation. The programming is also easily customized for new or alternative tasks.

It is therefore a principle object, feature, aspect, or goal of the invention to improve over or solve problems and deficiencies in the art. Other objects, features, aspects, or goals of the invention include a droplet manipulation apparatus, method, or system which:

1. has relatively low complexity and cost compared to digital microfluidic systems;
2. can be applied to a variety of droplet manipulation tasks;
3. provides flexibility regarding number and types of tasks; and
4. does not require high voltages or utilization of electrical or acoustic forces.

These and other objects, features, aspects and goals of the invention will become more apparent with reference to the accompanying specification.

BRIEF DESCRIPTION OF THE DRAWINGS AND APPENDICES

The drawings attached after this description include illustrations to help present exemplary embodiments of the present invention. The invention is not limited to the specific embodiments.

FIG. 1 is a perspective view of a droplet actuator platform and actuator system according to one example of the invention.

FIG. 2 is similar to FIG. 1 adding a coordinate system.

FIG. 3 is a block diagram of a system of FIG. 1.

FIG. 3-1 is a series of diagrams illustrating an exemplary embodiment of the open droplet supporting surface in the form of a patterned removable sheet adhered to a substrate, and how tilting of the substrate can transport a droplet from one droplet position to the other on the surface.

FIG. 4 is a sequence of photographs (left side) and diagrams (right side) illustrating droplet transport relative to degree of surface tilt according to an example of the invention.

FIG. 5 is a diagram illustrating one type of pattern shape (plus signs) and variation of size (line thickness) for that shape to promote different effects on droplets.

FIG. 6 is a diagram illustrating the physics relating to angle of surface tilt on a droplet.

FIG. 7 is a graph illustrating droplet release angle versus line thickness in FIG. 5.

FIG. 8 is a graph illustrating droplet release force versus line thickness in FIG. 5.

FIG. 9 is diagrammatic views of droplet retention force relative to a hydrophilic track at the droplet and surrounding superhydrophobic areas.

FIG. 10 is a droplet actuation force diagram.

FIG. 11 is a representation of a graphic user interface (GUI) for a control sub-system for one exemplary embodiment of the invention.

FIG. 12 is a photograph showing a single droplet on a tiltable platform according to the apparatus of FIG. 1.

FIG. 13 is a diagram illustrating a Task 1 (single droplet transport) according to a droplet manipulation possible with the apparatus of FIG. 1.

FIG. 13-1 is a photograph of the platform of FIG. 1 relative Task 1.

FIG. 14 is a diagram illustrating a Task 2 (multiple droplet transport) according to a droplet manipulation possible with the apparatus of FIG. 1.

FIG. 14-1 is a photograph of the platform of FIG. 1 relative Task 2.

FIG. 15 is a diagram illustrating a Task 2 (multiple droplet transport) according to a droplet manipulation possible with the apparatus of FIG. 1.

FIG. 16 is a diagram illustrating a Task 3 (merging and mixing droplets) according to a droplet manipulation possible with the apparatus of FIG. 1.

FIG. 16-1 is a photograph of the platform of FIG. 1 relative Task 3.

FIG. 17 is a diagram illustrating a Task 4 (one directional movement of droplets based on pattern shape) according to a droplet manipulation possible with the apparatus of FIG. 1.

FIG. 17-1 is a photograph of the platform of FIG. 1 relative Task 5.

FIG. 17-2 is a diagram illustrating Task 4 with a different pattern.

FIG. 17-3 is a photograph of a platform relative alternative Task 4.

FIG. 18 is a diagram illustrating a Task 5 (dispensing of a droplet) according to a droplet manipulation possible with the apparatus of FIG. 1.

FIG. 18-1 is a photograph of the platform of FIG. 1 relative Task 6.

FIG. 19 is a diagram illustrating a Task 6 (separating magnetic particles from a droplet) according to a droplet manipulation possible with the apparatus of FIG. 1.

FIG. 19-1 is a photograph of the platform of FIG. 1 relative Task 6.

FIGS. 20-1 to 20-20 are photographs of the apparatus of FIG. 1 from different perspectives.

FIGS. 21-1 to 21-6 are computer-assisted drawings of the apparatus of FIG. 1 from different perspectives.

FIGS. 22-1 to 22-5 are illustrations of the pivot post and universal joint of the apparatus of FIG. 1 that allow tilting of the platform in any direction.

FIG. 23 is a perspective view of the apparatus of FIG. 1 with an enlarged photo of droplets on its surface.

FIG. 24 is a diagrammatic view and correlated photos of droplet movement on the apparatus of FIG. 23.

FIG. 25 is top plan view of the surface of the apparatus of FIG. 1 illustrating different droplet manipulations.

FIG. 26 is a top plan view showing other droplet manipulations.

FIG. 27 is a top plan view showing other droplet manipulations.

FIG. 28 is a top plan view showing other droplet manipulations.

FIG. 29 is a top plan view showing other droplet manipulations.

FIG. 30 is a perspective view of droplet placement on the surface of the apparatus of FIG. 23.

FIG. 31 is a top plan view showing other droplet manipulations.

FIG. 32 are graphs illustrating aspects of operation of the apparatus of FIG. 23.

FIG. 33 is a reproduction of a computer display GUI such as can be used with control of the apparatus of FIG. 23.

FIG. 34 are illustrations of operating parameters for the apparatus of FIG. 23.

FIG. 35 are diagrams illustrating operational characteristics of the apparatus of FIG. 23.

FIG. 36 are diagrams illustrating operational characteristics of the apparatus of FIG. 23.

FIG. 37 are photos of a mixing operation for the apparatus of FIG. 23.

FIG. 38 are diagrams illustrating operational characteristics of the apparatus of FIG. 23.

FIG. 39 are diagrams illustrating operational characteristics of the apparatus of FIG. 23.

FIG. 40 are diagrams illustrating operational characteristics of the apparatus of FIG. 23.

DETAILED DESCRIPTION OF THE EXEMPLARY EMBODIMENTS

A. Overview

For a better understanding of the invention, specific exemplary embodiments will now be described in detail. It is to be understood that these are neither inclusive nor exclusive of the forms the invention can take. Those of skill in the art will appreciate that the invention can include obvious variations.

It is to be understood that the exemplary embodiments are discussed in the context of utilizing an economical patterned surface on a platform comprised of hydrophilic pattern shapes at droplet locations and hydrophobic surfaces outside those droplet locations. However, it is to be understood that with appropriate material technology, the invention can be applied to droplets that are not necessarily water-based.

B. Exemplary Embodiment 1

FIGS. 1-22 feature one exemplary embodiment of a droplet manipulation system according to the present invention. As will be appreciated by those skilled in the art, this is but one form the invention can take.

1. General Apparatus and System

With particular reference to FIGS. 1-3, 11, 21-1, and 22-1 to 22-9, the basic components for a system 10 according to the invention can be seen. More details will follow.

a. Tiltable Platform

A surface to support one or more droplets in an open or closed environment can be a platform that can be planar. As shown in FIG. 1, system 10 provides two degree freedom of movement of a platform 20 by suspending platform 20 on a vertical post extending from a base 12. The post includes a first portion 14, a hand or transition 16, and a universal joint 18. Platform 20 mounts onto u-joint 18 to provide a single pivot point for platform 20 relative to a vertical axis (e.g. the Z-axis of FIG. 2). In this example, the pivot point is basically centered underneath the platform. An alternative to an open supporting surface such as FIG. 1 could be the addition of a hydrophobic top plate in contact with the droplet (closed system).

There are alternative ways to tilt a platform. There are also alternative ways to translate a surface. One example is linear translation. The shape and size of the platform can vary according to need and desire.

b. Actuators of Platform Tilt

An actuation sub-system translates the platform. In the example of FIG. 1, two electric motors 104, each which can rotate a toothed pulley 102, are mounted on the base 12. The rotational axes for pulleys 102 are at 90 degrees to each other in a plane parallel to the home (horizontal) position plane of platform 20. Each motor 104 drives a belt 101, having complementary teeth to its respective pulley. Each belt 101 is connected at opposite ends to connection lugs 24 on the bottom of platform 20 (see also FIG. 22-4).

As illustrated in FIGS. 1 and 2, one belt 101 is connected at opposite sides of platform 20 along a first vertical plane through the pivot point of platform 20 (e.g. the X/Z plane of FIG. 2). The other belt 101 is connected at opposite sides along the second vertical plane orthogonal to the first and through that same pivot point (e.g. the Y/Z plane in FIG. 2).

In this embodiment, the opposite ends of each belt 101 comprise elastic sections 103. These sections provide elastomeric properties to the belts, which will be discussed later. Ties 65 and 67 (e.g. zip ties) can clamp the elastic section between a platform lug 24 and an end of belt 101, as illustrated in FIG. 21-1. Other types of elastic sections and attachment techniques are, of course, possible.

Other types of actuation sub-systems are possible. The electric motors and belts provide a non-complex, economical technique. Also, sufficient accuracy and precision of tilt can be accomplished with commercially available stepper motors and control circuitry. An advantage of this embodiment is that precision and accuracy do not have to be exceedingly high for effectiveness of the principles of operation over the range of needed tilt angles.

c. Pivot Axis for Platform

Platform 20 is basically tensioned in home or horizontal position on the pivot axis created by the post and universal joint by the belts and elastic connections. FIGS. 22-1 to 22-4 show how bottom post member 14 (FIG. 22-2) can be screwed (see screw 15) or bolted or otherwise fastened to hand or transition member 16 (FIG. 22-3). The top 17 of hand 16 is a square head that complementarily fits into socket 55 in bottom u-joint piece 56 (FIG. 22-1). A center lug 27 on the bottom of platform 20 (FIG. 22-4) is a complementary square shape to fit into the socket 51 in top piece 52 of u-joint 18 (FIG. 22-1). In this way, u-joint 18 pieces 52, 54, and 56 connect platform 20 to base 12 but allows tilting of platform 20 around either pivot pin 53 or pivot pin 57 of the u-joint, or both (see FIGS. 22-1 to 22-5). This provides two degree freedom of movement of platform 20 in two vertical planes (X/Z and Y/Z). Further, it allows tilting of platform in any direction relative the vertical axis Z through u-joint 18 depending on direction of rotation of motor pulleys 102. The direction and amount of pulley rotation determines not only direction of tilt but amount of tilt. In this embodiment, the amount of tilt needed is in the approximate range of 3 to 4.5 degrees in any direction from horizontal.

Alternative platform pivot techniques are possible.

a. Programmable Controller

Control of platform movement is with a controller subsystem. A programmable controller (e.g. microcontroller 105) with associated interface circuitry (e.g. motor control circuit 106) to the motors 104 allows automation of amount and direction of tilt of platform 20. Essentially, this allows control of direction, speed, and amount of tilt to promote movement from droplet(s). Microcontroller 105 also controls reversing direction of belts 101 to return the platform from tilt back to home or horizontal. This, with the elastic connections, can add a "jerking" type action to further promote droplet movement.

Pulley diameter and the RPM and length of operation of the motor axle substantially determine speed and amount of platform tilt (and subsequent return). This can be correlated to the amount of supplemental jerking action on the platform. As will be appreciated by those skilled in the art, motors 104, belts 101, and elastic connections 103 can be selected to have, in combination, the desired forces, as well as amount of tilt.

e. Patterned Surface of Platform

Enhancement of the platform surface can enhance performance of droplet manipulation. An optional implementation of the droplet supporting surface, and a feature of this embodiment, is a separate, removable sheet 30 carrying a patterned surface 32. Sheet 30 can be adhered to the top of platform 20 (see FIGS. 1 and 3-1). To promote droplet(s) to stay in position on the platform, this independent, removable sheet 30 on top of platform 20 has the following characteristics.

A hydrophobic layer 304 (FIG. 3-1) can be created across the surface of substrate 303 (which can be platform 20). Hydrophilic material (plus-sign or + shapes 305 in the example in FIG. 3-1) can be printed, deposited, embossed, added, or otherwise created at spaced apart locations and be of a hydrophilic nature relative the droplet(s). Alternatively, shapes can be etched or cut in the hydrophobic layer using a cutter or chemical etching process. These techniques are known to those skilled in the art. Therefore, as illustrated in FIG. 3-1, a droplet will tend to remain and be attracted to a hydrophilic shape, whereas if it is moved off of one of those shapes by tilting action, it is influenced to release, move easily across the hydrophobic area, and then stop at an adjacent hydrophilic shape.

For example, tilting of the platform 20 (in FIG. 3-1 platform 20 is a combination of substrate 303, hydrophobic layer 304, and interspersed hydrophilic shapes 305) down to the right (relative to the viewing direction of the page of FIG. 3-1) a sufficient amount allows gravity and any added jerking action to promote movement of the droplet 301 away from a first hydrophilic +-shape 3025 across the interstitial hydrophobic surface 304, and to the next adjacent hydrophilic +-shape 305. Return of platform 303 to horizontal would promote the droplet then staying in that new position.

As will be illustrated by the additional details that follow, and specific examples of droplet manipulating tasks that can be accomplished, the shape and size of the hydrophilic droplet position patterns can vary according to need or desire. Those parameters can affect how much tilt and jerking action is needed to achieve different manipulations in droplets.

As will be appreciated by those skilled in the art, empirical testing can help optimization of certain of the processes or operations. Likewise, such testing can assist in determining preferred shape and size of certain of the hydrophilic droplet locations.

C. Specific Details of Embodiment 1

1) Introduction

This contains a detailed description of the invention in its current form, based on a prototype device, as well as a discussion of the general principles of operation. In addition, alternative configurations of the system are proposed and envisioned which could offer similar or extended capabilities (ex. oleophobic coatings for oil drop manipulation). This description will refer to the Figures summarized above including the materials listed below:

1 High-resolution photographs of the device from several angles (FIGS. 20-1 to 20-20).
2. 3D Computer-aided design (CAD) models of the device (FIGS. 21-1 to 21-6).
3. Technical information of the components used in the device (specification sheets, datasheets, etc.)
4. Selected frames of videos of device operation and droplet operations.

2) Droplet Actuator Design

The droplet actuator 10 includes two main components, a mechanical control platform, and a droplet manipulation surface. The control platform 20 is able to rotate about two axes, tilting up/down, left/right, or any combination of these. The droplet manipulation surface includes a superhydrophobic substrate 30 or 304 patterned with hydrophilic areas 32 or 305. Water-based droplets adhere to the hydrophilic areas, but by rapidly tilting the control platform, droplets can be transported from one hydrophilic area to another. Modifying the configuration of the hydrophilic regions enables various droplet operations to be performed, including transport, mixing, merging, dispensing, and particle separation.

i) Mechanical Control Platform

The droplet actuator 10 (FIG. 1) consists of a planar platform 20 that is mechanically rotated about two axes on a central pivot 100. The desired rotation is accomplished by two electrical motors 104. Each motor is connected to the platform with a belt 101, pulley 102, and elastomeric rubber tubing 103. A computer program communicates with microcontroller 105 (e.g. Arduino Microcontroller) which controls each motor via a motor control circuit 106, specifying the frequency of rotation (or revolutions per minute), and duration of operation. Proper coordination of these parameters between the two motors enables the desired rotation of the platform.

The structure consists of three main components: an upper platform 303, a vertical support column 14/16/18, and a base 12. The upper platform is connected to the vertical column through a universal joint 18, which allows the upper platform to pivot about two axes. The upper end of the universal joint fastened to the center of the upper platform by press-fitting (into lug 27). The lower end of the universal joint is also press-fit to the vertical support column (square head 17).

The base 12, consisting of a square plexiglass sheet measuring 25 cm×25 cm×5 mm, is attached by screw to the vertical column (at piece 14). The vertical column measures 8 cm tall and the upper platform measures 10.2 cm×10.2 cm×1.2 cm. Two stepper motors 104 and an Arduino microcontroller 105 with a stepper motor controller circuit 106 are fixed to the base with aluminum mounting brackets and double-sided tape, respectively. Each edge of the upper platform is connected to a timing belt 101 which is driven by a pulley 102 attached to each stepper motor's shaft. A piece of elastomeric rubber tubing 103 was attached to the free ends of each belt and fixed to the upper platform by a stainless steel hose clamp or zip tie. The elastomeric rubber tubing 103 ensures adequate belt tension for the pulley system. FIG. 2 shows a full-color image of the droplet actuator platform system 10.

The block diagram in FIG. 3 illustrates the connections of the communication and control system. The user can interact with the device using a computer system 40 with input device(s) 42 (keyboard, mouse, GUI, touchscreen, etc.) and output device(s) 44 (monitor, speakers, etc.). The computer 40 communicates with an Arduino microcontroller 105 through a USB connection using software described in Section 4, below. The Arduino microcontroller 105 communicates with the stepper motor controller circuit 106, which drives the stepper motors 104 with the appropriate voltage and current (~12V, 350 mA). By default, the stepper motors 104 remain stationary. Using the computer interface, a stepper motor 104 can be commanded to rotate with the following three parameters: number of steps (1.8° per step), stepping speed (0-200 revolutions per minute), and step direction (forward, reverse). The belt system links the stepper motor pulley 102 to the upper platform 30 of the droplet actuator. As the upper platform measures 10.2 cm, and the diameter of the pulley is 1.2 cm, the effective gear reduction between the motor and the platform is 1:8.5. This means each step of the stepper motor corresponds to a 0.21° rotation of the upper platform. A camera 46 provides feedback to the computer about droplet position and color. Monitoring the position and color of each droplet allows automated manipulation and readout of colorimetric tests. Such software is commercially available.

ii) Parts List

1. Plexiglass (platform 20, base 12, post 14/16)
2. 2× Stepper motor (104)
3. Adafruit Motor/Stepper/Servo Shield (105/106)
4. Timing Belt×2 (101)
5. 2× Aluminum GT2 Timing Pulley (102)
6. 2× Stepper Motor Mount
7. Universal Joint (18/100)
8. 8× Hose Clamp (65/67)
9. Elastic rubber tubing×4 (103)

iii) Droplet Manipulation Surface

Referring to FIG. 3-1, the droplet actuator 10 also consists of a film or transparency 303 adhered to the top surface of the abovementioned planar platform 20 in FIG. 1. The surface of the film 303 is first coated with a superhydrophobic (i.e. water repelling) chemical coating 304, and then specific hydrophilic 305 (i.e. water attracting) patterns are printed on the superhydrophobic-coated film using an inkjet or laser printer to accomplish various tasks of droplet manipulation. In this embodiment the hydrophilic material is black Epson inkjet printer ink (model T200XL120). Others are possible.

The specific hydrophilic patterns are dependent on the task of droplet manipulation to be accomplished. We conducted rigorous characterization to select the best patterns for each task, but other patterns may also perform any given task. Other symbols that may be used include, but are not limited to, solid circles, hollow circles, crosses, solid squares, hollow squares or any other photographic, alphanumeric or other characters.

Two methods of fabricating superhydrophobic surface were tested for use with the current system. The first method utilizes a commercially available superhydrophobic spray called Neverwet by Rust-Oleum, Vernon Hills, Ill. 60061, USA, which creates a surface with contact angles over 165° and roll-off angles less than 1°. The Neverwet spray was applied to a letter-paper sized transparency sheet. See technical data sheet for more details at http://www.rustoleum.com/~/media/DigitalEncyclopedia/Documents/RustoleumUSA/TDS/English/CBG/NeverWet/ROC-12_NeverWet_Moisture_Repelling_Barrier_TDS.ashx. The second superhydrophobic surface was fabricated by sanding a LDPE plastic sheet with sandpaper (360 grit). The surface produced lower contact angles and higher roll-off angles, demonstrating lower hydrophobicity than Neverwet. For this reason, Neverwet was chosen as the preferred superhydrophobic surface for this embodiment. Other superhydrophic chemical coatings can be used such as Teflon or paralyne.

Similarly, four methods of creating hydrophilic patterns were tested including inkjet printing, cutting, laser printing, and pen writing. Of these methods, inkjet printing produced the highest resolution and longest lasting hydrophilic patterns. The droplet manipulation surfaces shown in following figures were fabricated using inkjet-printed patterns on a Neverwet coated transparency sheet. One example of such an inkjet printer is a model WorkForce® WF-2540 available from Epson America, Inc., Long Beach, Calif. 90806, USA, with details at http://www.epson.com/cmc_upload/pdf/brochure_wf2540.pdf.

FIG. 4 shows the movement sequence which allows droplet transport between two cross symbols. Images from the left side of the figure were captured from high-speed video, while the right side shows an illustrated schematic. Initially, at t=0 milliseconds (ms.), the platform is horizontal and the droplet is at rest. At t=33 ms., the platform is rotated to its highest angle (~3°-4.5°), then at t=50 ms., the droplet begins to detach from the initial cross symbol as the platform returns to horizontal. At t=67 ms., the droplet attaches to the neighboring cross symbol and oscillates for approximately 500 ms. before remaining still.

iv) Parts List

1. Transparency Film (303)
2. Superhydrophobic coating (304)
3. Inkjet printer The line thickness of each cross symbol can be modified to change the angle and rotation speed necessary to actuate a droplet of a given volume. Table 1 shows the typical values and range of values that successfully actuate droplets between 6 μL and 200 μL. FIG. 5 shows the relative thickness of each cross symbol. The range of droplet volumes that can be transported on the platform is 5 μL to 1000 μL. These values are relative to a variety of fluid-based droplets with or without molecules including physiological fluids such as blood, urine, saliva, or suspensions or solutions of the same. One feature of the invention is that system 10 can be set up and used for a variety of different droplet types.

TABLE 1

Typical droplet actuation parameters

| Size of droplet (μL) | Revolutions per minute Range | Revolutions per minute Typical | Number of steps Range | Number of steps Typical |
|---|---|---|---|---|
| Cross symbol line thickness = 0.006 in. | | | | |
| 6 | 110-130 | 120 | 10-15 | 10 |
| 8 | 90-130 | 110 | 10-16 | 11 |
| 10 | 80-120 | 90 | 11-17 | 12 |
| 20 | 70-120 | 70 | 11-15 | 14 |
| 30 | 50-110 | 50 | 9-18 | 15 |
| 200 (4 symbols) | 10-30 | 20 | 8-15 | 11 |
| Cross symbol line thickness = 0.008 in. | | | | |
| 6 | 110-130 | 120 | 11-16 | 13 |
| 8 | 100-130 | 110 | 11-16 | 13 |
| 10 | 90-130 | 100 | 11-17 | 14 |
| 20 | 80-120 | 90 | 11-17 | 15 |
| 30 | 60-110 | 80 | 9-18 | 17 |
| 200 (4 symbols) | 20-40 | 30 | 8-15 | 13 |
| Cross symbol line thickness = 0.009 in. | | | | |
| 6 | 140-150 | 150 | 13-16 | 15 |
| 8 | 130-150 | 150 | 13-16 | 15 |
| 10 | 100-130 | 110 | 11-16 | 15 |
| 20 | 80-120 | 90 | 11-18 | 16 |
| 30 | 60-110 | 80 | 9-18 | 17 |
| 200 (4 symbols) | 30-60 | 50 | 9-16 | 12 |

1 step = 1.8 degree in motor (0.21 degree in a top substrate)
Distance between two symbols are 0.335 cm
All the values of RPM and steps are also affected by the hydrophobicity of the surface and the hydrophilicity of ink patterns.
1 mL (1000 μL) size droplet can be transported using 16 symbols (20 rpm and 10 steps).
5 μL size droplet can be transported using a single symbol (140 rpm, 11 steps).

The droplet release angle was measured by slowly increasing the tilt angle until the droplet rolled off the platform. The results of this test are shown in Table 2. By measuring the release angle, it is possible to calculate the force exerted by the hydrophilic ink patterns on the droplet. The diagram shown in FIG. 6 shows the force diagram, in which the holding force is given by the following equation:

$$F=mg\sin(\theta)$$

The results are also plotted in FIGS. 7 and 8, illustrating that thicker lines produce a greater force on the droplet.

TABLE 2

Droplet release angle

| | Cross symbol line thickness 0.006 in. Angle (degrees) | 0.00 in. Angle (degrees) | 0.008 in. Angle (degrees) |
|---|---|---|---|
| 20 μL | 15.5° | 18.6° | — |
| 30 μL | 11.0° | 14.1° | 17.5° |
| 40 μL | 9.2° | 11.2° | 12.9° |

The retentive force on the droplet under similar conditions was derived by Elsharkawy et. al. See Elsharkawy, M., Schutzius, T. M., & Megaridis, C. M. (2014). Inkjet patterned superhydrophobic paper for open-air surface microfluidic devices. *Lab on a Chip,* 14(6), 1168-75. doi: 10.1039/c31c51248g, including Supplemental Information related to this publication, all of which is incorporated by reference herein.

The results are shown below.

The retentive force FR of a spherical droplet on a solid surface is given by $$F_R = F_r - F_a$$

Where $F_r$ is the receding end force and $F_a$ is the advancing end force on the droplet $F_a = 2R\gamma \cos \theta_a$ And, $$F_r = \int_0^{\frac{\pi}{2}} R\gamma \cos\theta \cos\varphi d\varphi$$

Where R is the droplet radius, γ the surface tension of the liquid, ϕ the azimuthal angle that circumnavigates the droplet contact line from the rearmost point (ϕ=0) to the side of the drop (ϕ=π/2)

$$\cos\theta = \frac{\varphi}{\pi/2}\cos\theta/a + \left(1 - \frac{\varphi}{\pi/2}\right)\cos\theta_r$$

$$F_r = F_{r1} + F_{r2} = 2R_\gamma \int_0^{\varphi 1} \cos\theta_1 \cos\varphi d\varphi + 2R_\gamma \int_{\varphi 1}^{\frac{\pi}{2}} \cos\varphi d\varphi$$

Where $F_{a1}$ is the advancing force contribution by the hydrophilic track, Fa2 the advancing force contribution by the superhydrophobic paper 3) Principles of Operation The droplet actuator system 10 relies on two forces to drive droplet movement. As shown above, gravitational force acts upon the droplet, causing droplet release at relatively large angles (~9°-20°). Under normal operation, however, the upper platform is rotated to angles from ~3° to 4.5°. The rapid movement of the platform allows this reduction in tilt angle by providing additional force which acts on the droplet. FIG. 10 shows the forces that provide droplet actuation as seen from the side view of the platform. The tilt angle (θ) is exaggerated for illustration. The axis of rotation lies 3 cm below the platform (the radius (r) of the circle shown). The distance of the droplet from the center of the platform is shown as distance (d). The radius the droplet travels is given as (R).

See Analytical Model Section, infra, for more discussion.

4) Alternative Configurations:

i) Mechanical Control Platform

The current system relies on a universal joint to provide two-axis rotation of the upper platform. Other two-axis linkages could be used, including ball joints, dual hinges, or flexible rods or tubes. Platforms with higher or lower degrees-of-freedom (DOF) could also be used. For example, a Stewart platform using six prismatic actuators provides 6 DOF comprising three linear (x,y, z) movements, and 3 rotation (pitch, roll, yaw) movements. Robotic arms, gimbals, and optical alignment multi-axis tilt platforms could also provide the required tilting motion.

The current system utilizes rotation to provide droplet actuation, but linear motion could provide similar actuation. Translating the platform horizontally before stopping or reversing direction would produce the same forces described above, without the gravitational force cause by tilting the platform. A variety of linear actuators are commercially available which should be able to provide range of motion, speed, and power to translate platform 20 sufficiently for these purposes.

ii) Droplet Manipulation Surface

The current system uses a superhydrophobic surface patterned with hydrophilic regions to control actuation of water-based droplets. Several methods of fabricating superhydrophobic surfaces have been developed, including lithography, pattern templating, sol-gel, electrospinning, layer-by-layer technique, etching, chemical vapor deposition, electroless galvanic deposition, anodic oxidation, and electrochemical deposition. See Celia, E., Darmanin, T., Taffin de Givenchy, E., Amigoni, S., & Guittard, F. (2013). Recent advances in designing superhydrophic surfaces. *Journal of Colloid and Interface Science,* 402, 1-18. doi: 10.1016/j.jcis.2013.03.041, incorporated by reference herein.

Methods of patterning hydrophilic areas include lithography, laser machining, etching, coating with self-assembled monolayers (SAM), oxides, or biomolecules, and plasma etching. Appropriate patterns can be created at least in three ways: First, a hydrophilic coating could be selectively applied to a superhydrophobic surface, or a superhydrophobic coating could be selectively applied to a hydrophilic surface. Second, the surface could be chemically modified to produce hydrophilic regions on a superhydrophobic surface or superhydrophobic regions on a hydrophilic surface. Third, the surface topology could be altered to create the appropriate pattern.

The large contrast in droplet adhesion between the superhydrophobic and hydrophilic areas enables the droplet actuator to operate using relatively small tilt angles and speeds (rpm). Using merely hydrophobic/hydrophilic patterned surfaces would perform similarly with increased tilt angles and speeds. Oil based droplets could be actuated using patterned oleophobic surfaces. Any surface upon which the liquid experiences a contrast in surface tension can be actuated.

Alternatively, the droplet actuator could use an unpatterned hydrophobic or superhydrophobic surface to actuate the droplets. In this case, tilting the platform would induce droplet motion after exceeding the droplet release force given in the previous section. Unpatterned surfaces have limited ability to merge separate droplets, as droplets with identical mass have identical release angles.

Another alternative to patterning hydrophilic areas is to alter the geometry of the surface. By creating indentations, sidewalls, channels, creases, or holes in the surface, the system could manipulate either liquids or solid objects. For example, embossing shallow, circular indentations in the superhydrophobic surface would create "wells" in which the droplet would rest. Upon tilting the platform, the droplets could be transferred to a neighboring well. By modulating the width and depth of the wells, different droplets could be merged and mixed.

5) Droplet Actuator Software a) Current System i) Software and Firmware Requirements Matlab 2011b or later ArduinoIO package Arduino Motor shield firmware Arduino Uno USB drivers ii) Graphical User Interface (GUI)

One example of a GUI that could be used for system 10 is shown in FIG. 11. As is well understood by those skilled in the art, user control could take other forms, not only different GUIs and options, but different input/control methods. The following refer to reference numbers in FIG. 11:

151: A user can type a communication port number and connect the Arduino microcontroller to the computer.

152: A user can enter the rotation speed (rpm) and number of steps the stepper motor will turn in the x and y directions.

153: Double arrow buttons make a top substrate tilt in one of four different directions according to the inputs in 152. The platform does not return back to horizontal (initial position).

154: A user can enter the forward and backward rotation speed and number of steps of the stepper motors.

155: Single arrow buttons make the top substrate tilt and return to the initial position according to the inputs in 154. Under typical settings, the initial rotation speed is 100 rpm during the initial tilt from horizontal (0 degrees) to 3.5 degrees. The return speed is typically set to a lower rpm value (~20 rpm) to provide a slower transition from 3.5 degrees back to horizontal (0 degrees).

156: A circular button makes a substrate return to the initial position when the Arduino microcontroller is connected to the computer.

157: Video Controls buttons allow a user to take images and videos of the droplet actuation through the web camera.

FIG. 12 is a photograph of a prototype platform 20 with patterned surface 30/32 and a single blue droplet. For further understanding of the invention, several specific droplet manipulations or "tasks" will now be described, with reference to FIGS. 13-19 and subparts.

6) Droplet Operations a) Current System i) Droplet Transport

4) Task 1>Droplet Transport: This task describes the job of automatically moving a single droplet 301 from one location on the platform to another location of the platform. See FIG. 3-1. Here we accomplish this task by using 'plus-shaped' 302 symbols (line width=0.2032 mm, spacing between symbols=3.35 mm) shown in FIG. 3-1. Other symbols may be used for this transport task, such as solid circles, hollow circles, crosses, solid squares, hollow squares or any other pictographic or alphanumeric symbols. We have successfully transported up to 54, of food dye solution using movement on single plus symbols shown in FIG. 3-1. For transporting larger volumes 306 shown in FIG. 13 (diagram) and FIG. 13-1 (photo), sets of two or more plus symbols may be used as shown in FIG. 13-1.

ii) Multiple Droplet Transport

5) Task 2>Multiple Droplet Transport: This task describes the job of automatically moving more than one droplet 401 simultaneously in the same direction (FIG. 14 (diagram) and FIG. 14-1 (photo)) or moving one droplet while keeping the others stationary (FIG. 15 (diagram)). Using the plus symbols described in Task 1, we can move multiple droplets simultaneously where each droplet can initially be positioned in separated rows or columns or in the same row or column. For moving one droplet while keeping the other droplets stationary, we used plus symbols with two or more line width thicknesses. We observed that thicker lines 501 (in the plus symbols) increase the hydrophilic surface area and can hold the droplet over higher range of actuation (FIG. 15).

Whereas, plus symbols with thinner lines 502 can only hold the droplet over a smaller range of actuator (FIG. 15). Droplets that need to be stationary 504 are positioned over plus symbols with thicker line widths, while droplets that need to be transported 505 are carried over plus symbols with thinner line widths.

iii) Merging and Mixing Droplets

6) Task 3>Merging and Mixing Droplets: This task describes the job of automatically bringing one droplet to come and unite with a second stationary droplet (FIG. 16 (diagram) and FIG. 16-1 (photo)), followed by a method to mix the contents of both droplets. Using the plus symbols discussed in previous tasks, we can bring one droplet 601 to merge with a second stationary droplet 602 (FIG. 16). This is followed by mixing the contents of the merged larger droplet 603 by moving it in a circular trajectory multiple times (the number of revolutions depends on the size and diffusibility of particles suspended in the droplets).

iv) One-Directional Movement of Droplets

7) Task 4>One-directional Movement of Droplets: This task describes the job of automatically moving one or multiple droplets only in one direction (FIG. 17 (diagram) and FIG. 17-1 (photo)). Using the cross symbols, we can make one droplet stationary to a certain position irrespective of the planar platform tilting in other directions within the 150 r.p.m. rate of acceleration FIGS. 17 and 17-1. Using a single V-shaped symbol 701, we can restrict the movement of a single droplet in a certain direction, and this droplet is invariant to any tilts in this direction FIGS. 17 and 17-1. Using another symbol that comprises three V-shaped symbols, we can restrict the movement of single droplets to only one direction, which are invariant to tilts in any other direction FIGS. 17-2 and 17-3.

v) Dispensing of Liquid from Droplets

8) Task 5>Dispensing of Liquid from Droplets: This task describes the job of dispensing a fixed amount of liquid from droplets by utilizing dot symbols as shown in (FIG. 18 and FIG. 18-1). This task is particularly valuable when we want to distribute one large droplet of sample to a number of smaller droplets for dilution or various chemical reactions. By varying the size of dot symbol 801, we can control the volume of the sample dispensed on each dot symbol (FIG. 18).

vi) Separation of Magnetic Beads within Droplets

9) Task 6>Separation of Magnetic Beads within Droplets: This task describes the job of separating magnetic micro- or nano-scale beads suspended in droplets using an external permanent or electromagnet as shown in FIG. 19 and FIG. 19-1. This task is valuable when we want to separate specific particles of interest (for example, antigens, proteins or other biomarkers) from biological fluid using commercially available magnetic beads tagged with the complementary particle (for example, antibody).

Using the plus-shaped symbols, we showed that a droplet with suspended magnetic particles 901 can be exposed to a permanent or electromagnet 902 (magnetic strength around 0.4 Tesla). Then by tilting the planar platform, the liquid droplet moves away while the magnetic particles suspended in a small volume of the drop are left at the magnet's original location. The process can be repeated multiple times to bring the original or a new droplet to mix with the magnetic beads, and re-separate. The system may be expanded to include multiple permanent or electromagnets positioned above or below the planar platform to accomplish multiple steps of particle separation, washing, re-washing, mixing with another buffer/s, and re-separation.

vii) Alternative Configuration

Some refinements in our approach are ongoing and mentioned below:

a) We envision other combinations of superhydrophobic and hydrophilic printed patterns. There are many chemicals available that can be purchased and tested.

b) We envision ways of dispensing at least smaller droplets. We believe the system is applicable to some range of droplets larger also.

c) We envision there will be ways to split a larger droplet into smaller droplets by forcing the larger droplet on a sharp hydrophobic surface or material.

d) We envision use in molecular diagnostics that use ELISA kits and have relevant biological samples (e.g. infected blood samples).

Advantages of our method over existing methods (see discussion earlier and below), such as the three categories of methods for manipulating droplets. We feel our method has the following benefits over these existing methods:

a) No need for microelectronic fabrication: In all three existing approaches, electrodes or textured patterns are fabricated using silicon microelectronics fabrication techniques, which are expensive and labor-intensive. Our method can include spraying a superhydrophobic coating on a transparency and printing patterns using an inkjet printer, or other techniques that are less complex and cheaper.

b) Cheaper materials cost: The cost of fabricating and assembling a digital microfluidic platform is upwards of $2000. In comparison, the cost of the described prototype of the invention is less than $50. The main costs are that of two motors ($12 each) and the Arduino microcontroller ($15). The dramatically lower costs will be appealing for applications in rural testing or clinical tests in non-clinical labs.

c) No high voltages required: In electrowetting, a voltage stimulus of over 150 Volts is needed to actually move a droplet. If the insulator is thicker, voltages as high as 300-400 voltages are needed. The companies that have adopted electrowetting have found ways to add a high-voltage amplifier to their system. In our case, the only 9 volts voltage is needed to tilt the droplet actuator. Such 9V batteries are available commercially, which helps in making our system portable.

We have demonstrated the successful manipulation of droplets on our droplet actuator.

We envision use of our invention in molecular diagnostics of human samples or animal samples. Our general method is independent of any specific application. Certain types of patterns can be printed depending on specific experiment under study.

The field of molecular diagnostics using newer technologies is emerging that can better the negatives of standard immunoassays (e.g. with shorter time, or clinic-free on field tests). We believe our invention can provide benefits in this area.

7) Parts List a) Mechanical Control Platform

1. Plexiglass: was used to make a structure of base, vertical column and top substrate.
2. Stepper motor—NEMA-17 size—200 steps/rev, 12V 350 mA (Adafruit, product ID: 324):
   a. 200 steps per revolution, 1.8 degrees/step (Approximately 0.21 degree applied to the top substrate)
   b. Product webpage: http://www.adafruit.com/products/324
   c. Technical datasheet: http://www.adafruit.com/datasheets/12vstepper.jpg* (incorporated by reference herein).
3. Arduino Uno Microcontroller (Arduino)
   a. Product webpage: http://store.arduino.cc/product/A000066 (incorporated by reference herein).
4. Adafruit Motor/Stepper/Servo Shield for Arduino kit—v1.2 (Adafruit, product ID: 81) (incorporated by reference herein).
   a. Product webpage: http://www.adafruit.com/products/81 (incorporated by reference herein).
   b. *Datasheet incorporated by reference herein.
5. Timing Belt GT2 Profile—2 mm pitch—6 mm wide 1164 mm long (Adafruit, product ID: 1184)
   a. Product webpage: http://www.adafruit.com/products/1184 (incorporated by reference herein).
6. Aluminum GT2 Timing Pulley—6 mm Belt—20 Tooth—5 mm Bore (Adafruit, product ID: 1251)
   a. Product webpage: http://www.adafruit.com/products/1251 (incorporated by reference herein)
7. Stepper Motor Mount with Hardware—NEMA-17 Sized (adafruit, Product ID: 1297)
   a. Product webpage: http://www.adafruit.com/products/1297 (incorporated by reference herein).
8. Universal Joint Kit Stanley 85-727 3 Piece (Stanley, Model No. 85-727)
   a. Product webpage: http://www.stanleytools.com/default.asp?TYPE=PRODUCT&PARTNUMBER=85-727 (incorporated by reference herein).
9. Hose Clamp: Breeze Aero-Seal 100 10H 9/16—1 1/16 inch Range 9/16" 301 SS Band (Breeze Industrial Products)
   a. Product webpage: http://www.hoseclampkings.com/prod-21-1-258-107/breeze-aero-seal-100-10h-9-16-1-1-16-inch-range-9-16-301-ss-band.htm (incorporated by reference herein).
10. Elastic rubber tubing Resistance Band Set (Walmart)

b) Droplet Manipulation Surface

1. Transparency Film Staples 50 Pack Transparency Film for Inkject Printers (Staples, Item: 954143, model: 23247)
   a. Product webpage: http://www.staples.com/Staples-50-Pack-Transparency-Film-for-Inkj ect-Printers/product_954143 (incorporated by reference herein).
2. Superhydrophobic coating Rust-Oleum NeverWet (Rust-Oleum)
   a. Product webpage: http://www.rustoleum.com/product-catalog/consumer-brands/neverwet/neverwet-kit/*PDF file attached in folder (incorporated by reference herein).
3. Inkjet printer Epson WorkForce WF-2540 All-in-One Printer (Epson, Model: C11CC36201)
   a. Product webpage: http://www.epson.com/cgi-bin/Store/jsp/Product.do?sku=C11CC36201*WF-2540 (incorporated by reference herein).

D. Additional Discussion of State of the Art

The three general present state of the art categories of manipulating liquid droplets are as follows:

First Category:

One class of devices to move liquid droplets is the work by Karl Bohringer. Below are his references. The first link shows a video on public site. In their devices, microscale textured surfaces (e.g. tracks and pillars) are patterned and fabricated in silicon or glass substrates. The surface and tracks are vibrated by orthogonal waves at a frequency and amplitude that is sufficient to move the droplets. Droplets of volumes around 10 microliters can be moved in pre-defined manner using the vibration of patterned and textured surfaces (called "ratchets"). In their patent, they claim that means of generating the vibration is not important, and can be through a piezo actuator or an audio speaker. The vibrations change the contact angle of droplets, which also depends on the amount of area textured. Vibration frequency is 1 Hz through 100 Hz. Their method has been highlighted in science tech news for potential use in portable diagnostics (e.g. first link below). http://scitechdaily.com/portable-diagnostics-use-vibration-to-move-drops-of-liquid/

1) Todd A. Duncombe, E. Yegan Erdem, Ashutosh Shastry), Rajashree Baskaran and Karl F. Bohringer, "Controlling Liquid Drops with Texture Ratchets", Advanced Materials, Volume 24, Issue 12, pages 1545-1550, Mar. 22, 2012 (incorporated by reference herein).
2) Duncombe T A, Parsons J F, Bohringer K F, "Directed drop transport rectified from orthogonal vibrations via a flat wetting barrier ratchet." Langmuir. 2012 Sep. 25; 28(38):13765-70. Epub 2012 Sep. 10 (incorporated by reference herein).
3) Vibration-driven droplet transport devices having textured surfaces: U.S. Pat. No. 2,009,021 1645 A1 Application number U.S. Ser. No. 12/179,397; Publication date Aug. 27, 2009 Inventors: Karl F. Bohringer, Ashutosh Shastry (incorporated by reference herein).

Second Category:

Another class of devices for moving liquid droplets is using electrowetting and optical stimulus. The method is called optoelectrowetting. Some groups have shown its workability. The reference Light Actuation of Liquid by Optoelectrowetting is a nice review, and their project was funded by a DARPA project. In Optoelectrowetting, the platform is made of planar electrodes through which voltages can be applied to individual electrodes. Underneath the electrodes is a layer of photoconductive material whose conductivity changes when laser light is shown on it. A combination of electrical fields (from the electrodes) and light illumination controls the contact angle of droplets, thereby allowing to move droplets in pre-defined directions. The group from Purdue University have a patent on optoelectrowetting. The primary method is similar to the Japanese group discussed above where virtual electrodes are created by projected images from laser illumination.

1) "Light actuation of liquid by optoelectrowetting"
Pei Yu Chioua, Hyejin Moonb, Hiroshi Toshiyoshic, Chang-Jin Kimb, Ming C. Wua Sensors and Actuators A 104 (2003) 222-228 (incorporated by reference herein).
This project is supported in part by DARPA Optoelectronics Center through Center for Chips with Heterogeniously Integrated Photonics (CHIPS) under contract #MDA972-00-1-0019
2) Open optoelectrowetting droplet actuation device and method: U.S. Pat. No. 8,753,498 B2 Priority date 25 Jun. 2009 (incorporated by reference herein).
Also published as US20120091003 (incorporated by reference), W02010151794A1 (incorporated by reference)
Inventors Han-Sheng Chuang, Aloke Kumar, Steven T. Wereley
Original Assignee Purdue Research Foundation Third Category:

The final and most popular device uses the principle of electrowetting (and the technology thereby is called digital microfluidics) to move droplets. The idea uses electrical voltages through planar electrodes to change the contact angle of liquid droplets. When the contact angle is lower, the droplet wets the surface; while a higher contact angle makes the droplet more spherical for transport. The original idea was conceived by C. J. Kim from UCLA who later sold his company to Advanced Liquid Logic.

http://www.mae.ucla.edu/news/news-archive/2012/professor-cj-kims-start-up-experience-excerpt-from-the-ucla-invents-magazine (incorporated by reference herein). Aaron Wheeler's group at University of Toronto has been pursuing digital microfluidics technology based on the above electrowetting principles. His research website discusses a number of applications of digital microfluidics for cell culture and molecular diagnostics.

http://microfluidics.utoronto.ca/research.php (incorporated by reference herein) His "Publications List" has discussed the potential applications. His recent publications include:

1) Analysis on the Go: Quantitation of Drugs of Abuse in Dried Urine with Digital Microfluidics and Miniature Mass Spectrometry
2) Automated Digital Microfluidic Platform for Magnetic-Particle-Based Immunoassays with Optimization by Design of Experiments Sandia National Labs has an ongoing program on digital microfluidics at Livermore, Calif. led by Dr. Anup Patel. The group has recently received a 5 million IARPA funding (along with some University partners) from a division called Bio-Intelligence Chips (BIC). 2012 R&D I 00 Winner: http://www.rdmag.com/award-winners/2012/08/modular-answer-microfluidics-transport (incorporated by reference herein) https://ip.sandia.gov/technoglogy.do/techID=102 (incorporated by reference herein) Video: http://www.youtube.com/watch?v=9GInROYzSJg&feature=youtu.be (incorporated by reference herein).

A company called Advanced Liquid Logic from Duke University uses the electrowetting technique. http://www.liquid-logic.com/ (incorporated by reference herein).

Some videos illustrating the idea of using electrical fields to move and manipulate droplets is in the following videos. Many more videos are available on youtube through a search for "digital microfluidics" or "electrowetting".

http://vimeo.com/31391137 (incorporated by reference herein)
http://vimeo.com/31391811 (incorporated by reference herein)
http://vimeo.com/31391783 (incorporated by reference herein)
http://www.formamedicaldevicedesign.com/case-studies/advanced-liquid-logic-2/(incorporated by reference herein)

Patents have been filed by Advanced Liquid Logic (ALL). These patents are largely in two groups:

First group is on the methods of using electrical fields to transport, split, mix, merge, and dispense droplets. The other category is on the potential applications of their digital microfluidic device to separate particles from liquids, concentrate liquid samples, or apply for experiments in enzyme assay, pyrosequencing, and protein analysis in physiological fluids.

As can be seen by the several examples of manipulation, size/shape of droplet pattern locations, set forth above, the invention achieves its objects of economical, highly flexible, automated droplet manipulation.

As also discussed above, the benefits of such a system can be understood by referencing the types of existing state of the art systems, such as electrowetting.

E. Analytical Model and Extension to Other Fluids

The following is taken from Taejoon Kong, Riley Brien, Zach Njus, Upender Kalwa and Santosh Pandey, Motorized actuation system to perform droplet operations on printed plastic sheets. *Lab Chip,* 2016, Advance Article, DOI: 10.1039/C6LC00176A, Published on 8 Apr. 2016. (incorporated by reference herein).

This adds an analytical model and discusses more tests to show the feasibility of the instrument in testing other fluids.

Electronic supplementary information (ESI) available: Supplementary figures and videos of droplet manipulation included. See DOI: 10.1039/c61c00176a.

We developed an open microfluidic system to dispense and manipulate discrete droplets on planar plastic sheets. Here, a superhydrophobic material is spray-coated on commercially-available plastic sheets followed by the printing of hydrophilic symbols using an inkjet printer. The patterned plastic sheets are taped to a two-axis tilting platform, powered by stepper motors, that provides mechanical agitation for droplet transport. We demonstrate the following droplet operations: transport of droplets of different sizes, parallel transport of multiple droplets, merging and mixing of multiple droplets, dispensing of smaller droplets from a large droplet or a fluid reservoir, and one-directional transport of droplets. As a proof-of concept, a colorimetric assay is implemented to measure the glucose concentration in sheep serum. Compared to silicon-based digital microfluidic devices, we believe that the presented system is appealing for various biological experiments because of the ease of altering design layouts of hydrophilic symbols, relatively faster turnaround time in printing plastic sheets, larger area to accommodate more tests, and lower operational costs by using off-the-shelf products.

INTRODUCTION

Generally speaking, microfluidic platforms consist of closed channel networks where liquid flow is controlled by mechanical, pneumatic or electrokinetic means. Today, with emphasis on higher experimental throughput, microfluidic platforms incorporate several on-chip components (e.g. microvalves micropumps, and microelectrodes) that increase the complexity in fabricating the different layers, integrating the micro and macroscale components, and controlling the individual sensing or actuation parts.[1,2] In contrast to closed-channel microfluidics, open microfluidic platforms obviate the use of polymeric channels and continuous liquid flow; thereby relaxing the fabrication process, easing the system integration to fewer components, and promising a cheaper alternative to robotic micro-handling systems.[3,4] In open microfluidics, liquid is dispensed from a reservoir as discretized droplets and transported to desired locations for further manipulation. Typical operations to be performed with discrete droplets may include transport of a single or multiple droplets, merging and mixing of two droplets, incubation and affinity binding within droplets, extraction of solid particles from the liquid phase, and removal of waste droplets.[3,5] These droplet operations are often conceptualized from test tube experiments performed in a wet chemistry laboratory, and the sequence of operations can be easily altered depending on the actual experiment being performed.

The general strategy of producing and actuating discrete droplets on open surfaces relies on methods to modulate the surface tension between the liquid droplet and the solid surface it rests on. The current literature on this topic can be grouped into two categories—methods that employ electrical fields to modulate the wettability of droplets3-6 and nonelectrical methods that employ mechanical, magnetic, acoustic or gravitational forces to generate directional movement of droplets.[7-15]

The electrical or 'electrowetting-on-dielectric' method of droplet actuation has gained popularity in the last decade primarily because of the ease of programmability and portability.[16,17] Here, the conductive liquid droplet sits on patterned electrodes coated with a hydrophobic dielectric layer. An electric field applied to the target electrode increases the contact angle of the droplet placed over it, and thus alters the wettability of the liquid surface to the solid surface. This electrowetting phenomenon can be scaled up to move and control multiple droplets over an array of electrodes, thereby performing any desired sequence of operations including transport, merging, mixing, splitting, and dispensing. Analogous to digital microelectronics where pockets of electrons are transferred between devices (e.g. in charged coupled devices), several groups have realized electrowetting-based 'digital microfluidic platforms' having electrodes of precisely-controlled geometry, on-chip control electronics to energize individual electrodes, and software programs to automate the droplet operations.[3,18,19]

Even though the electrowetting method is widely accepted as the gold standard for droplet handling systems, it is restrained by the need for high electrical voltages (in the range of 100 volts to 400 volts) that have unknown effects on the biomolecules or cells within droplets.[18-20] For instance, the electric actuation force can interfere with the adsorption of biomolecules on a surface.[21] Furthermore, droplet actuation is dependent on the conductivity of the droplet and the dielectric properties of the insulating layers (e.g. Teflon and Parylene) that are expensive for large-scale deposition. Because each electrode is electrically addressed, there are only a finite number of electrodes that can be addressed on a digital microfluidics platform.[22] To get around this last issue, it has been shown that the electrodes can be optically stimulated (and thereby producing on-demand optical interconnects) by incorporating photoconductive and high dielectric constant layers underneath the Teflon coating.[8,23] Active matrix arrays of thin film transistor (TFTs) have also been demonstrated as an alternate digital microfluidic testbed where many thousand individually addressable electrodes could sense, monitor, and manipulate droplets.[22] Similarly, electrodes can be selectively energized to reposition water volumes in an otherwise liquid paraffin medium to create reconfigurable, continuous-flow microfluidic channels.[24] As these innovations in digital microfluidics technology extend the functionalities to newer arenas of portable diagnostics, much of the fabrication protocol still requires access of industrial-grade microelectronics foundry and is thus limited to select users.

To eliminate some of the limitations of electrowetting mentioned above, non-electrical methods of droplet actuation have been pursued.[9,11-15] In the 'textured ratchet' method, movement of liquid droplets is achieved on textured microstructures (i.e. ratchets) fabricated in silicon or elastomeric substrates.[15] The textured ratchets are placed on a level stage that is vertically vibrated using a linear motor. At the resonant frequency of vertical oscillations, the liquid droplet is able to advance or recede on the textured ratchets. The movement of different droplets can be individually controlled, both in linear and closed tracks, by manipulating the volume and viscosity of droplets. In the superhydrophobic tracks' method, shallow grooves are cut in zinc plates or silicon substrates.[14] This is followed by a superhydrophobic coating step by depositing silver and fluorinated thiol surfactant on metal plates or a fluoropolymer on silicon substrates. The produced superhydrophobic tracks are able to confine liquid droplets and guide their movement in trajectories defined by the tracks. In the 'surface acoustic waves (SAW)' method, a high frequency source connected to interdigitated gold electrodes generates acoustic waves that is able to transport fluid droplets on a piezoelectric substrate.[25] Recently, pneumatic suction through a PDMS membrane has been used to activate and move droplets in two dimensions on a superhydrophobic surface without any interference from an external energy (e.g. heat, light, electricity).[21]

While the above non-electrical methods demonstrate that mechanical machining the substrate can passively move droplets, more results are needed to match the level of droplet handling operations achieved in digital microfluidic platforms.[3] To gauge the maturity of digital microfluidics, an exciting example is a multi-functional digital microfluidic cartridge by Advanced Liquid Logic that can perform multiplexed real-time PCR, immunoassays and sample preparation.[26] A group at Sandia National Laboratories has developed a digital microfluidic distribution hub for next generation sequencing that is capable of executing sample preparation protocols and quantitative capillary electrophoresis for size-based quality control of the DNA library.[27] With growing demand of lab on chip systems in medicine, digital microfluidics has been used to extract DNA from whole blood samples,[28] quantify the levels of steroid hormones from breast tissue homogenates,[29] and screen for metabolic disorders and lysosomal storage diseases from newborn dried blood spots.[30-34] These examples highlight the fact that digital microfluidics is revolutionizing the field of portable medical diagnostics, and any rival technology needs to achieve the basic standards of droplet handling set by digital microfluidics.

In an attempt to emulate the droplet operations performed in digital microfluidics without the use of high electrical voltages or micromachining steps, we present a system where droplets are manipulated on a superhydrophobic surface (created on plastic sheets) by gravitational forces and mechanical agitation. The superhydrophobic plastic sheets are further printed with unique symbols using a hydrophilic ink. A microcontroller controls the direction and timing of two stepper motors which, in turn, provide mechanical agitation for droplet transport. Droplets remain confined to the hydrophilic symbols, and are able to 'hop' to neighbouring symbols by gravity when the surface is agitated and tilted to a certain degree. Using this basic principle, we illustrate the following droplet operations: transport of single and multiple droplets, transport of larger-volume droplets, merging and mixing of multiple droplets, dispensing of fixed-volume droplets from a large droplet or liquid reservoir, and one directional movement of droplets. As a proof-of-concept, we show the application of the system as a colorimetric assay to detect the concentration of glucose in sheep serum.

EXPERIMENTAL

Design of the Droplet Actuation System

The motorized actuation system consists of a two-axis tilting platform to manipulate movement of discrete liquid droplets on hydrophilic symbols printed on a superhydrophobic surface. FIG. 23*a* shows the system configuration, including the three structural components: base, vertical column, and upper stage. The dimensions of these components are as follows: base (20 cm×20 cm×0.5 cm); vertical column (1 cm×1 cm×10 cm); upper stage (9 cm×9 cm×1.3 cm). The entire three-dimensional structure is designed in AutoCAD (Autodesk™) and the separate components are machined in acrylic glass (Plexiglas™). The stage is connected to the column by a universal joint that enables two-axis rotation about a central pivot. Two stepper motors (NEMA-17™, 200 steps per revolution, 12 volts, 350 milliamperes, bipolar mode) are connected with individual timing belts to the stage and mounted to the base. Each stepper motor controls one axis of rotation of the stage through an Arduino microcontroller (Adafruit Industries™). Single commands to tilt the stage up or down, left or right, and any sequence of such commands are programmed in a computer workstation and transmitted through a universal serial bus (USB) connection to the Arduino microcontroller. A graphical user interface (GUI) is designed for remote access to the droplet actuation system using a standard computer workstation (see ESI† FIG. 33). For image recording and characterization of droplet operations, a webcam (Logitech C920™) is positioned above the stage to monitor and record the simultaneous movement of multiple droplets.

Preparation of Plastic Sheets

After assembling the structural components of the droplet actuation system, we prepare the surface of plastic sheets that will serve as an open microfluidic arena to hold and move discrete droplets (FIG. 23*b*). Initially, letter-sized transparency films (Staples Inc.™) are rinsed with distilled water and spray-coated with a commercially available superhydrophobic coating (Rust-Oleum NeverWet™). The coating procedure is a two-step process that involves depositing a base coat and a top coat provided by the supplier. The base coat is applied by spraying on the surface of the transparency film. Three applications of the base coat are performed with a wait time of two minutes between successive applications. After drying for one hour, four applications of the top coat are performed in a similar fashion. The superhydrophobically-coated plastic sheet is dried for 12 hours at room temperature. Thereafter, hydrophilic symbols are printed on the plastic sheet by inkjet printing. For this step, the plastic sheet is loaded into the document feeder of a commercial ink-jet printer (Epson WF-2540™). The layout of the desired symbols are drawn in Adobe Illustrator, saved on the computer, and printed using a black ink cartridge (Epson T200120™). After printing, the plastic sheet is dried for 12 hours at room temperature. Using the above procedure, a single letter-sized transparency film can produce six printed templates (9 cm×9 cm) in one run.

Remote Control and GUI Software

A graphical user interface (GUI) software is developed in Matlab to remotely access and control the mechanical movement of the droplet actuation system. The Adafruit Motor Shield v1 communicates with the Arduino microcontroller through the I2C (Inter IC) protocol and controls each of the stepper motors. The Arduino is further controlled from a computer workstation using the Arduino Integrated Development Environment™. The GUI enables commands to be easily sent to the Arduino microcontroller. The script accepts inputs to set the speed and number of steps taken by the motors, which, in turn, controls the angular movement of the stage about the central pivot. The GUI has options to control motor parameters, such as the number of steps, speed of rotation, and direction of rotation which eventually control the angular movement of the stage about the central pivot. In the default state, the position of the stage is assumed horizontal and is calibrated using a bubble level (Camco Manufacturing Inc.™). When the GUI software is first run, the connection to the Arduino microcontroller is established automatically by searching active COM ports. Once the Arduino COM port is confirmed to be connected, the user can enter the sequence of mechanical operations to be performed. In the GUI window, pressing the double arrows increases the stage's angle of rotation in the corresponding direction (see ESI† FIG. 33). The single arrow button rapidly tilts the stage to a specified angle, and then returns it to the default horizontal position. In addition, the GUI software communicates with a webcam to display a live preview of the top surface and record images or videos of droplet actuation.

Chemicals

Glucose assay kit (Sigma-Aldrich, GAGO20) is composed of the following chemicals: glucose oxidase/peroxidase (Sigma-Aldrich, G3660), and o-dianisidine reagent (Sigma-Aldrich, D2679). Glucose standard (Sigma-Aldrich, G6918) and sheep serum (Sigma-Aldrich, 53772) are also used. The glucose oxidase/peroxidase reagent is dissolved in 39.2 ml of deionized water. Next, o-dianisidine reagent is added in 1 mL of deionized water. The assay reagent is prepared by adding 0.8 mL of the o-dianisidine solution to the 39.2 mL of the glucose oxidase/peroxidase solution and mixing the solution thoroughly. The glucose standard solution is diluted to create 0.7 mg $mL^{-1}$, 0.6 mg $mL^{-1}$, 0.5 mg $mL^{-1}$, 0.4 mg $mL^{-1}$, 0.3 mg $mL^{-1}$, 0.2 mg $mL^{-1}$, and 0.1 mg $mL^{-1}$ standards in deionized water. For control experiments, deionized water and black food dye (ACH Food Companies Inc.) are used.

Result and Discussion

Transport of a Single Droplet

FIG. 24*a* shows the side-view of a single droplet placed on a hydrophilic symbol (left-side) printed on a superhydrophobic layer. As the stage is tilted clockwise, the droplet remains on the hydrophilic symbol. But, as the stage is quickly tilted anti-clockwise to the default horizontal position, the droplet slides down the superhydrophobic surface and rests on the neighbouring hydrophilic symbol (right-side). In FIG. 24*b*, side-view images of a single droplet are shown as it slides from the left symbol to the right one. The time for transporting a single 10 μL droplet between two consecutive symbols is approximately 100 milliseconds. The stage is tilted at 100 revolutions per minute (r.p.m.) and the number of steps is 14.

The basic principle of droplet transport thus relies on positioning a droplet on a hydrophilic symbol and providing a rapid tilting action (i.e. tilting the stage clockwise (or anticlockwise) to a specific angle followed by tilting the stage anti-clockwise (or clockwise) to the horizontal position). The rapid tilting action allows us to use small tilting angles (3-5°) with acceleration and deceleration of a droplet. Alternatively, a single droplet can be transported by slowly tilting the stage in one direction which, however, requires a larger tilting angle (9-20°) and provides no control on stopping the accelerated droplet.

We found that droplet transport can be controlled by a series of hydrophilic symbols printed at regular intervals. Based on initial tests, we chose to use 'plus (+)' symbols to demonstrate single droplet transport. Other symmetric symbols can also be used for this purpose. We printed plus symbols of different line widths and inter-symbol spacings (see ESI† FIG. 34*a*). The transport of single droplets on the different symbols is recorded, and an average displacement error is measured in each case. Negative displacement error occurs when a droplet fails to detach from the initial symbol. Conversely, positive displacement error occurs when the droplet travels beyond the neighbouring symbol (see ESI† FIG. 34*c*). In all cases, the droplet volume is 10 μL, tilting speed is 100 r.p.m., and number of steps is 14. The results indicate that symbols with thicker line widths produce negative displacement error as they have more surface area to hold the droplet in its original position (see ESI† FIG. 34*b*). On the other hand, symbols with thinner line widths produce positive displacement error as they have insufficient surface area to hold or capture a sliding droplet. The optimal line width is 0.02 cm and the inter-symbol spacing is 0.335 cm, which produces a negligible displacement error of 0.005 cm. We also found that, using this optimal dimension of the plus symbol, we can transport single droplets having a minimum and maximum water volume of 8 μL and 38 μL, respectively.

Physical Model for Droplet Detachment from a Hydrophilic Symbol

Following the force balance analysis of Extrand and Gent,[35] we assume the contact region of a liquid droplet on the superhydrophobic surface is circular with a radius R. The droplet is about to detach from the hydrophilic symbol and travel downwards as the stage is tilted from its horizontal position to a critical angle $\alpha$ (see ESI† FIG. 35*a*). If the angular speed of the stage is $\omega$ revolutions per minute (r.p.m.) and the time for rotation is $\Delta t$ minutes, then the critical angle $\alpha=2\pi\cdot\omega\cdot\Delta t$ radians. The parameter $\Delta t$ can be further expressed as $\Delta t=N\cdot t_1$ minutes where N is the number of steps of the motor and $t_1$ is the time for one step rotation. The 'advancing edge' and 'receding edge' are labelled (see ESI† FIG. 35*b*). For the plus symbol, the hydrophilic line width is w and the length is 2×R. The liquid droplet has a surface tension $\gamma$, contact angle $\theta$, viscosity $\eta$, density $\rho$, volume V, radius r (such that $V=(4/3)\cdot\pi\cdot r^3$), and linear velocity v (such that $v=\omega\cdot\zeta$, where $\zeta=3$ cm is the distance from the pivot to the center of stage). The azimuthal angle $\phi$ circumnavigates the perimeter of the contact region between a value of $\phi=0$ at the rear end of the droplet to a value to $\phi=\pi/2$ at the advancing side of the droplet. There are three forces acting on the droplet as the stage is tilted: surface tension $F_{ST}$, gravitation force $F_G$, and viscous force $F_V$. At the critical angle $\alpha$ of the stage, the individual forces balance as:

$$F_{ST}+F_V=F_G \tag{1}$$

In eqn (1), the surface tension force $F_{ST}$ can be divided into two components: force $F_r$ acting on the rear of the droplet and force $F_a$ acting on the advancing front of the droplet. Plugging in the expressions for the gravitational force $F_G$ acting parallel to the stage and the viscous force $F_V$, we get:

$$(F_r-F_a)+6\cdot\pi\cdot\eta\cdot r\cdot v=\rho\cdot V\cdot g\cdot\sin\alpha \tag{2}$$

To compute the surface tension force, its component f per unit length of the contact perimeter varies along the perimeter as:[35]

$$f=\gamma\cdot\cos\theta\cdot\cos\phi \tag{3}$$

To simplify the calculation, we assume that $\cos\theta$ varies linearly around the perimeter of the contact region between a receding value of $\cos\theta_r$ at the rear end of the droplet (where $\phi=0$) to an advancing value of $\cos\theta_a$ at the advancing side of the droplet (where $\phi=\pi/2$). For the case of a droplet on a homogeneous superhydrophobic surface, the expression for the contact angle is given by:[35]

$$\cos\theta = \frac{\phi}{\pi/2}\cdot\cos\theta_a + \left(1-\frac{\phi}{\pi/2}\right)\cdot\cos\theta_r \tag{4}$$

Upon integration of eqn (3) and using eqn (4), the force acting on the rear of the drop $F_r$ can be evaluated as:

$$F_r = 2\int_0^{\pi/2} f\cdot R d\phi = 2\cdot R\cdot\gamma\int_0^{\pi/2}\cos\theta\cdot\cos\phi d\phi \tag{5}$$

In our design with plus symbols, we modify eqn (4) to accommodate the role of hydrophilic symbol on the surface tension acting on the droplet (see ESI† FIG. 35*b*). In other words, the hydrophilic symbol produces an inhomogeneity in the surface tension which is accounted for by splitting the force contributions of the hydrophilic ink and the superhydrophobic surface.[36] We denote the advancing and receding contact angles on the hydrophilic ink as cos $\theta_{a,ink}$ and cos $\theta_{r,ink}$, respectively. Similarly, the advancing and receding contact angles on the superhydrophobic surface are denoted as cos $\theta_{a,sub}$ and cos $\theta_{r,sub}$, respectively. The parameter $\phi 1$ indicates the azimuthal angle $\phi$ where the hydrophilic ink region changes to the superhydrophobic surface in the contact region, and is given by $\phi 1=\sin^{-1}[w/(2\cdot R)]$.

Following from eqn (5), the force $F_r$ acting on the rear of the droplet can be written as a sum of three forces:

$$F_r = 2\cdot R\cdot\gamma\left[\int_0^{\phi_1}\cos\theta_1\cdot\cos\phi d\phi + \int_{\phi_1}^{\frac{\pi}{2}-\phi_1}\cos\theta_2\cdot\cos\phi d\phi + \int_{\frac{\pi}{2}-\phi_1}^{\frac{\pi}{2}}\cos\theta_3\cdot\cos\phi d\phi\right] \tag{6}$$

Where $$\cos\theta_1 = \frac{\phi}{\phi_1}\cdot\cos\theta_{r,sub} + \left(1+\frac{\phi}{\phi_1}\right)\cdot\cos\theta_{r,ink} \tag{7}$$

$$\cos\theta_2 = \frac{\phi-\phi_1}{\frac{\pi}{2}-2\phi_1}\cdot\cos\theta_{r,ink} + \frac{\frac{\pi}{2}-\phi_1-\phi}{\frac{\pi}{2}-2\phi_1}\cdot\cos\theta_{r,sub} \tag{8}$$

$$\cos\theta_3 = \frac{\phi-\frac{\pi}{2}+\phi_1}{\phi_1}\cdot\cos\theta_{a,ink} + \frac{\frac{\pi}{2}-\phi}{\phi_1}\cdot\cos\theta_{r,ink} \tag{9}$$

Similarly, the force $F_a$ acting on the advancing front of the droplet can be written as a sum of three forces:[36]

$$F_a = 2\cdot R\cdot\gamma\cdot\left[\cos\theta_{a,ink}\int_0^{\phi_1}\cos\phi d\phi + \cos\theta_{a,sub}\int_{\phi_1}^{\frac{\pi}{2}-\phi_1}\cos\phi d\phi + \cos\theta_{a,ink}\int_{\frac{\pi}{2}-\phi_1}^{\frac{\pi}{2}}\cos\phi d\phi\right] \tag{10}$$

Substituting eqn (6) and (10) into eqn (2), we can compute the critical angle $\alpha$ of the inclined stage where the gravitational force balances the surface tension and the viscous forces; thereby allowing the droplet to detach from the hydrophilic symbol and slide down the superhydrophobic surface.

To validate the physical model, experiments are conducted with water (density $\rho$=1 g cm$^{-3}$, viscosity $\eta$=0.001 Pa s, surface tension $\gamma$w=72.8 mN m$^{-1}$) and ethylene glycol (density $\rho$=1.11 g cm$^{-3}$, viscosity $\eta$=0.0162 Pa s, surface tension $\gamma_{EG}$=47.7 mN m$^{-1}$) at temperature T=20° C. We measured the advancing and receding contact angles of the two liquids as: (a) water: $\theta_{a,ink}$=147°, $\theta_{r,ink}$=81°, $\theta_{a,sub}$=157°, and $\theta_{r,sub}$=142° and (b) ethylene glycol: $\theta_{a,ink}$=134°, $\theta_{r,ink}$=73°, $\theta_{a,sub}$=140°, and $\theta_{r,sub}$=126°. The radius of the contact region is R=0.12 mm. Table 3 shows the predicted and experimentally measured values of the critical angle $\alpha$. The number of experiments (n) for each combination of line width and droplet volume is 10. In all cases, the predicted values lie within one standard deviation of the measured values.

It is worth noting that the viscosity of the liquid droplet is dependent on the concentration of dissolved electrolytes or sugars. The concentration-dependent viscosity of various sugar solutions can be modelled as:[37]

$$\eta=\eta 0\cdot a\cdot\exp(E\cdot X) \tag{11}$$

where $\eta_0$ is the viscosity of pure water (in centiPoise) and X is the mole fraction in the solution. The parameters a and E are numerically estimated from experiments. In the case of glucose solutions, the values of the parameters are a=0.954 and E=27.93 for up to 60% maximum concentration at temperature T=20° C.[37]

Transport of Multiple Droplets and Large-Volume Droplets

Using the abovementioned principle, the droplet actuation system can be used to transport multiple discrete droplets. As shown in FIG. 25, four droplets (each having 10 μL volume and coloured with different food dyes for visual illustration) are initially placed on separate plus symbols. For each symbol, the line width is 0.02 cm, line length is 0.24 cm, and inter-symbol spacing is 0.335 cm. The motor speed is 100 r.p.m. and the number of steps is 14. The red arrows in the figure indicate the direction of tilting the stage at each step. The stage is tilted to the right two times (FIGS. 25*a* and *b*) and then downwards for three times (FIG. 25*c-e*). The final positions of the four droplets are shown in FIG. 25*f*. The images indicate that discrete droplets can be transported on a two-dimensional arrangement of plus symbols with virtually no risk of cross-contamination between droplets.

To address the challenge of transporting droplets having volumes greater than 38 μL, we designed arrays of plus symbols. FIG. 26*a* shows images of the 80 μL droplet being transported using a 2×2 array of plus symbols (line width is 0.0178 cm, line length is 0.24 cm, and inter-array spacing is 0.68 cm). Reducing the speed and increasing the number of steps of the motor (80 r.p.m., 20 steps) allows transport of the 80 μL droplet. Here, the stage is tilted once to the right (FIGS. 26*a-i* and *ii*), once downwards (FIG. 26*a-iii*), and once to the left as depicted by the red arrows. The final position of the droplet is shown in FIG. 26*a-iv*. Using a similar approach, FIG. 26*b* shows images of the 300 μL droplet being moved using a 3×3 array of plus symbols (line width is 0.0178 cm, line length is 0.24 cm, and inter-array spacing is 0.94 cm). The motor speed is further reduced and the number of steps is increased to move this large droplet (60 r.p.m., 25 steps).

Here, the stage is tilted to the left and the droplet settles on the neighbouring array of 3×3 symbols. Even though larger droplet volume can be transported by changing the design layout, we feel that the droplet volume of 300 μL adequately represents the maximum threshold needed for portable diagnostic testbeds.[29-33]

TABLE 3

Critical sliding angle α of a droplet (water and ethylene glycol) is predicted from the physical model and compared from experiments on the actuation system. Three droplet volumes are tested (20 μL, 30 μL, and 40 μL); each droplet volume is tested on plus symbols having three different line widths (0.152 mm, 0.178 mm, and 0.203 mm). Every combination of droplet volume and line width is tested 10 times.

| Water | | | | Ethylene Glycol | | | |
|---|---|---|---|---|---|---|---|
| Droplet volume (μL) | Line width (mm) | Predicted α | Measured α | Droplet volume (μL) | Line width (mm) | Predicted α | Measured α |
| 20 | 0.152 | 26.27° | 24.1° ± 1.81° | 20 | 0.15 | 20.99° | 19.6° ± 1.36° |
| | 0.178 | 26.40° | 26.2° ± 1.94° | | 0.18 | 21.06° | 20.9° ± 1.70° |
| | 0.203 | 26.53° | 28.5° ± 1.69° | | 0.2 | 21.13° | 22.1° ± 1.42° |
| 30 | 0.152 | 17.19° | 15.7° ± 1.18° | 30 | 0.15 | 14.32° | 13.3° ± 0.93° |
| | 0.178 | 17.28° | 17.3° ± 1.62° | | 0.18 | 14.37° | 14.8° ± 0.79° |
| | 0.203 | 17.36° | 18.2° ± 1.16° | | 0.2 | 14.41° | 15.5° ± 0.81° |
| 40 | 0.152 | 12.83° | 11.7° ± 1.04° | 40 | 0.15 | 10.99° | 10.5° ± 0.81° |
| | 0.178 | 12.89° | 12.7° ± 1.34° | | 0.18 | 11.02° | 10.9° ± 0.81° |
| | 0.203 | 12.95° | 13.4° ± 1.37° | | 0.2 | 11.05° | 11.5° ± 0.72° |

Merging and Mixing of Multiple Droplets

The ability to bring two droplets together, merge and mix them, and repeat these steps sequentially with a finite number of discrete droplets is important for realizing on-chip chemical reactions. To achieve this ability, it is required that some droplets remain stationary while other droplets are being transported, merged or mixed together. This is accomplished by using plus symbols of different line widths, where symbols with thicker line widths have more holding force than symbols with thinner line widths. FIG. 27 shows images of a two-step merging and mixing performed on three droplets. The line widths of the plus symbols are thinnest in the left two columns (i.e. 0.015 cm holding the yellow droplet), medium thickness in the middle two columns (i.e. 0.02 cm holding the red droplet), and thickest in the right two columns (i.e. 0.025 cm holding the blue droplet). For all symbols, the line length is 0.24 cm and inter-symbol spacing is 0.37 cm. The intent here is to merge the yellow droplet with the red one, and subsequently merge their product with the blue droplet. The stage is tilted in the following sequence: downwards, right, right, downwards, and right (FIG. 27*a-e*). The red arrows indicate the direction of tilting the stage. The final product formed after merging all the three droplets is shown in FIG. 27*f*. It is interesting to note that the red and blue droplets are stationary when the yellow droplet is moved and merged with the red one (FIGS. 27*a* and *b*), and the blue droplet is immobile throughout all the tilting operations. Thus, by adjusting the line widths of the plus symbols, we can selectively move one or more droplets to accomplish sequential merging operations. Post-merging, the mixing of two droplets is demonstrated in FIGS. 27*c* and *f* by letting the merged product stay put on the symbol for some time (depending on the incubation time). This way of mixing by passive diffusion is satisfactory in case of droplets having soluble compounds. For droplets having immiscible or water-insoluble compounds, one can mix the droplets by agitating the stage (i.e. rapidly tilting the stage in alternate right and left directions in small angles) or moving the droplet in a circular pattern on neighbouring symbols.

One-Directional Transport of Droplets

While the plus symbols allow us to move droplets in two dimensions (i.e. left and right, upwards and downwards) on the plastic sheet, there is also interest to control droplet transport in only one direction (i.e. left or right only, upwards or downwards only). Previously, this transport mechanism was demonstrated on a texture ratchet where vibrations at the resonance frequency produced directed motion of droplets.[15] To accomplish this task in our system, we used a 'greater-than (>)' symbol that allows us to move a droplet only to the right side (i.e. converging side of the symbol) upon tilting the stage in that direction. For each symbol, the line width is 0.023 cm and the length of each line is 0.33 cm. The acute angle between the two lines of the greater-than symbol is 28°. FIG. 28*a* shows images of two droplets; one placed on a greater-than symbol and the other on a plus symbol. The stage is tilted in the following sequence: right, left, right, and left. The droplet on the row of plus symbols follows the direction of stage tilting, and eventually returns to its original position. In comparison, the droplet on the greater-than symbol is held at its original position when the stage is tilted to the left but moves to the right when the stage is tilted to the right. FIG. 28*b* shows the dynamics of the droplet on the greater-than symbol during the left or right tilting of the stage. During the left tilting, the droplet is still held in its original position due to the asymmetry of the greater-than symbol (on its left side compared to its right side). During the right tilting, the droplet volume concentrates to the narrow point of the symbol (on its right side) and is able to slide to the neighbouring symbol. FIG. 28*c* shows images of a droplet placed at the center of three converging greater-than symbols. Here the line width is 0.023 cm, length of each line is 0.33 cm, and the acute angle of each greater-symbol is 28°. Similar to FIGS. 28*a* and *b*, this symbol also allows movement of droplets only to the right side but is able to hold the droplet on its central position even when the stage is tilted left, up or down. Thus one greater than symbol prevents droplet movement in the left direction while the three converging greater-than symbols prevent droplet movement in the left, up, and down directions.

Dispensing Smaller Droplets from a Large Droplet

In wet chemistry experiments, it is often desired to pipette small volumes of reagents or samples repeatedly for multiple tests. As such, there is a need to generate equal volumes of smaller droplets from a large droplet (which may be a reagent or test sample). Typically, this is achieved in devices based on electrowetting[16-21] or by using a superhydrophobic blade to split a large droplet.[14] We accomplish this task by moving the large droplet over a series of circular dot symbols. FIG. 29*a* shows the side-view of a large red droplet moving over four dot symbols, and leaving behind a small droplet over each traversed symbol. Besides circular dot symbols, we can use rectangular or diamond-shaped symbols for dispensing small droplets, as shown in FIGS. 29*b* and *c*, respectively (in all cases, the symbol area is 0.0097 $cm^2$). In FIG. 29*d*, we show how dispensing and mixing are performed sequentially. Here, a large red droplet moves over a row of dot symbols, leaving behind small droplets over each symbol (FIG. 29*d-i-iii*). Afterwards, a water droplet is moved over the same set of dot symbols, thereby mixing the previously-left behind red droplets with water (FIG. 29*d-iv-vi*). We conducted experiments to measure the actual volume of small droplets left behind as a 10 μL water droplet travels over plus symbols and different sized dot symbols (see ESI† FIG. 36, Tables S1 and S2). In addition to the fluid properties, the volume of droplets dispensed on the dot symbol is determined by the surface area of the symbol or surface defect,[38,39] which can be increased or decreased depending on the desired volume of dispensed droplets.

Dispensing Droplets from an External Reservoir

Besides dispensing smaller droplets from a large droplet, it is beneficial to develop a mechanism to dispense finite droplets from an external liquid reservoir that may contain a much larger liquid volume (e.g. cartridges, tubes, and syringes).[7] To achieve this method of dispensing, a syringe-based dispenser is realized. Here, the tip of a 20 mL syringe is cut, plugged by a 200 μL pipette tip, and then attached to a 1 mL syringe. The pipette tip is sealed with a cyanoacrylate adhesive along with a steel wire to extend the tip. This syringe-based dispenser is positioned above the plastic sheet on the stage (FIG. 30*a*). As the syringe tip faces downwards, gravitational force prevents liquid from back-flowing through the 20 mL syringe. When the stage is rapidly tilted, the steel wire is momentarily pushed up (FIG. 30*b*) to dispense a small droplet on the hydrophilic symbol underneath (FIG. 30*c*). This step can be repeated several times to dispense a series of discrete droplets from the reservoir (FIG. 30*d-f*).

Glucose Detection

As a proof-of-concept, the droplet actuation system is employed to determine the glucose concentration in sheep serum using a colorimetric enzymatic test. The following reaction details the chemical reactions involved in the colorimetric test for glucose.[1]

glucose oxidase $$\text{d-glucose} + H_2O + O_2 \xrightarrow{\text{glucose oxidase}} \text{d-gluconic acid} + H_2O_2 \quad (12)$$

$$H_2O_2 + \text{reduced o-Dianisidine} \xrightarrow{\text{peroxidase}} \text{oxidized o-Dianisidine} \quad (13)$$

In the presence of glucose oxidase, D-glucose is oxidized to D-gluconic acid and hydrogen peroxide. The colorless o-dianisidine reacts with hydrogen peroxide, in the presence of peroxidase, to form a brown-coloured oxidized o-dianisidine.

Initially, experiments are conducted in 24-well plates to characterize the colorimetric glucose assay. A standard glucose assay kit is used to prepare glucose solutions of different dilution factors. Around 250 μL of each solution is loaded into separate well plates, followed by 500 μL of assay reagent in each well. A webcam is used to record the colour of all well solutions for 30 minutes (frame rate: 29 frames per second). A Matlab script is written to extract the colour intensity of each well solution as a function of time. Specifically, the user selects different cropped areas in the first image. Then the script identifies the selected areas of all subsequent images in a video (see ESI† FIG. 40*a*). The 3-channel (RGB) images are converted into 1-channel (i.e. grayscale) images using ITU-R Recommendation BT.601, and the average colour intensity values are estimated as a function of time (see ESI† FIG. 40*b*). The colour intensity data are exported to a Microsoft Excel spreadsheet. The maximum slope for each solution (i.e. maximum change in colour intensity per second) is determined that correlates to the initial concentrations of glucose.[34] For each run with glucose samples, two control samples are used: deionized water with reagent and black food dye with reagent. The sheep serum is tested in a similar manner to give its glucose concentration (i.e. 0.59 mg $mL^{-1}$, see ESI† FIG. 40*c*), which is close to the value obtained from a microplate reader (i.e. 0.63 mg $mL^{-1}$).

After conducting the well plate experiments, we performed a similar set of experiments on the droplet actuation system. After preparing the same dilutions of glucose solution, 5 μL droplets are placed on the middle column of plus symbols (line width=0.015 cm) as shown in FIG. 31*a*. Another set of 10 μL glucose reagents are placed on the leftmost column of plus symbols (line width=0.02 cm). When the stage is tilted to the right, the two columns of droplets (i.e. of glucose samples and reagents) merge on the middle column (FIG. 31*b*). Upon further tilting the stage to the right, the merged droplets settle on the rightmost column of X-shaped symbols (FIG. 31*c*) where they are agitated to be mixed thoroughly (FIG. 31*d-g*) and incubated for the chemical reaction (FIG. 31*h-j*). We found that agitating the stage reduces the mixing time of a merged droplet (using 5 μL red droplet and 20 μL yellow droplet) from 550 seconds with passive diffusion to 60 seconds with stage agitation (i.e. approximately a nine-fold reduction in mixing time) (see ESI† FIG. 37-39). As shown in FIG. 31*h*, the colour change is visible after around 10 seconds of incubation. The higher the glucose concentration, the darker is the colour of the incubated droplet. The Matlab script accurately determines the average colour intensity of the droplets (FIG. 32*a*), which is later used to estimate the glucose concentrations in each droplet (FIG. 32*b*). The sheep serum is also tested in parallel with other glucose samples. Using the standard curve equation, the unknown glucose concentration of sheep serum is calculated as 0.62 mg $mL^{-1}$, which is close to the readings from the microplate reader and well plate experiments.

Table 4 summarizes the system parameters for the various droplet operations. Table 5 shows the flexibility of the system in transporting droplets having different fluid properties and different volumes. The three fluids tested are: water, milk, and ethylene glycol. Keeping the operating conditions fixed (i.e. motor speed=100 r.p.m., number of steps=14), we found that a wide range of droplet volumes (7 μL to 40 μL of water) can be transported on plus symbols (line width=0.152 mm). However, under the same operating conditions, the range of droplet volumes transported on plus symbols decreases for a viscous liquid (12 μL to 26 μL of ethylene glycol). Supplemental videos show the real-time droplet operations performed on the droplet actuation system (see ESI† Videos S1-S3).

CONCLUSION

We demonstrated a droplet actuation system where discrete droplets are manipulated on hydrophilic patterns printed on a superhydrophobic plastic surface. Gravitational forces and mechanical agitation of the stage enable the transport of droplets. The system is designed for low-cost, resource limited settings where large area, disposable plastic sheets can be printed from standard inkjet printers and portable 9 V batteries power the motorized stage. We showed the possibility of transporting multiple droplets (volumes: 8 μL to 300 μL) in parallel and performing sequential fluidic reactions that will be beneficial to a variety of biological experiments. With the presented method, the design and layout of the hydrophilic symbols can be easily altered to specific functional requirements of an experiment. Lastly, the integration of smart image analysis tools with the droplet actuation system helps to automatically extract the parametric data, thereby minimizing human bias.

TABLE 4

Values of the system parameters for the different droplet operations

| Droplet Operation | FIG. number | Volume (μL) | Speed (r.p.m.) | Steps N | Line width (cm) | Inter-symbol spacing (cm) |
|---|---|---|---|---|---|---|
| Single droplet transport | 2 | 10 | 100 | 14 | 0.02 | 0.335 |
| Multiple droplets transport | 3 | 10 | 100 | 14 | 0.02 | 0.335 |
| Large droplet transport | 4(a) | 80 | 80 | 20 | 0.0178 | 0.68 |
| | 4(b) | 300 | 60 | 25 | 0.0178 | 0.94 |
| Merging and mixing | 5(a, b): left | 10 | 80 | 14 | 0.015 | 0.37 |
| | 5(c-e): | 20 | 90 | 14 | 0.02 | 0.37 |
| | 5(f): right 2 | 30 | 0 | 0 | 0.025 | 0.37 |
| One-directional transport | 6(a, b) | 10 | 100 | 14 | 0.023 | 0.37 (+)<br>0.74 (>) |
| | 6(c) | 20 | 100 | 14 | 0.023 | 0.74 |
| Dispensing droplets | 7(a-d) | 10 | 100 | 14 | area = 0.0097 $cm^2$ | 0.37 |
| Glucose detection | 9(a): left | 10 | 100 | 14 | 0.015 | 0.45 |
| | 9(a): middle | 5 | 100 | 14 | 0.02 | 0.45 |
| | 9(c): right | 15 | 100 | 14 | 0.038 | 0.45 |
| | 9(d-g): right | 15 | 40 | 25 | 0.038 | 0.45 |
| | 9(i, j): right | 15 | 0 | 0 | 0.038 | 0.45 |

TABLE 5

The range of droplet volumes that can be transported on plus symbols is shown. Three different fluids are tested: water, milk, and ethylene glycol. The operating conditions of the motors is fixed (speed = 100 rpm, number of steps = 14). Each experiment on the minimum and maximum droplet volume is conducted 5-7 times.

| Fluid droplet | Fluid properties | Line width (mm) | Volume (μL) |
|---|---|---|---|
| Water | $\eta$ = 0.001 Pa · sec | 0.152 | 7-40 |
| | $\rho$ = 1 g/$cm^3$ | 0.203 | 8-38 |
| | $\gamma_w$ = 72.8 mN/m | 0.254 | 10-36 |
| Milk | $\eta$ = 0.003 Pa · sec | 0.152 | 7.5-38 |
| | $\rho$ = 1.032 g/$cm^3$ | 0.203 | 9-35 |
| | $\gamma_m$ = 52.4 mN/m | 0.254 | 11-33 |
| Ethylene Glycol | $\eta$ = 0.0162 Pa · sec | 0.152 | 12-26 |
| | $\rho$ = 1.11 g/$cm^3$ | 0.203 | 17-24 |
| | $\gamma_{EG}$ = 47.7 mN/m | 0.254 | 20-22 |

REFERENCES

1 K. S. Elvira, X. C. Solvas, R. C. Wootton and A. J. deMello, Nat. Chem., 2013, 5, 905-915.
2 E. K. Sackmann, A. L. Fulton and D. J. Beebe, Nature, 2014, 507, 181-189.
3 M. J. Jebrail, M. S. Bartsch and K. D. Patel, Lab Chip, 2012, 12, 2452-2463.
4 M. G. Pollack, A. D. Shendorov and R. B. Fair, Lab Chip, 2002, 2, 96-101.
5 K. Choi, A. H. C. Ng, R. Fobel and A. R. Wheeler, Annu. Rev. Anal. Chem., 2012, 5, 413-440.
6 W. C. Nelson and C.-J. Kim, J. Adhes. Sci. Technol., 2012, 26, 1747-1771.
7 A. Ghosh, R. Ganguly, T. M. Schutzius and C. M. Megaridis, Lab Chip, 2014, 14, 1538-1550.
8 S. Y. Park, M. A. Teitell and E. P. Y. Chiou, Lab Chip, 2010, 10, 1655-1661.
9 Z. Long, A. M. Shetty, M. J. Solomon and R. G. Larson, Lab Chip, 2009, 9, 1567-1575.
10 J. Seo, S. Lee, J. Lee and T. Lee, ACS Appl. Mater. Interfaces, 2011, 3, 4722-4729.
11 V. Jokinen, L. Sainiemi and S. Franssila, Adv. Mater., 2008, 20, 3453-3456.
12 Z. Wang and J. Zhe, Lab Chip, 2011, 11, 1280-1285.
13 D. Foresti, M. Nabavi, M. Klingauf, A. Ferrari and D. Poulikakos, Proc. Natl. Acad. Sci. U.S.A, 2013, 110, 12494-12554.
14 H. Mertaniemi, V. Jokinen, L. Sainiemi, S. Franssila, A. Marmur, O. Ikkala and R. H. Ras, Adv. Mater., 2011, 23, 2911-2914.
15 T. A. Duncombe, E. Y. Erdem, A. Shastry, R. Baskaran and K. F. Bohringer, Adv. Mater., 2012, 24, 1545-1550.
16 J. Gong and C. J. Kim, J. Microelectromech. Syst., 2008, 17, 257-264.
17 C. Peng, Z. Zhang, C. J. Kim and Y. S. Ju, Lab Chip, 2014, 14, 1117-1122.
18 S. C. Shih, P. C. Gach, J. Sustarich, B. A. Simmons, P. D. Adams, S. Singh and A. K. Singh, Lab Chip, 2015, 15, 225-236.
19 S. Srigunapalan, I. A. Eydelnant, C. A. Simmons and A. R. Wheeler, Lab Chip, 2012, 12, 369-375.
20 M. Abdelgawad, S. L. Freire, H. Yang and A. R. Wheeler, Lab Chip, 2008, 8, 672-677.
21 C. J. Huang, W. F. Fang, M. S. Ke, H. Y. E. Chou and J. T. Yang, Lab Chip, 2014, 14, 2057-2062.
22 B. Hadwen, G. R. Broder, D. Morganti, A. Jacobs, C. Brown, J. R. Hector, Y. Kubota and H. Morgan, Lab Chip, 2012, 12, 3305-3313.
23 P. Y. Chiou, H. Moon, H. Toshiyoshi, C.-J. Kim and M. C. Wu, Sens. Actuators, A, 2003, 104, 222-228.
24 R. Renaudot, V. Agache, Y. Fouillet, G. Laffite, E. Bisceglia, L. Jalabert, M. Kumemura, D. Collard and H. Fujita, Lab Chip, 2013, 13, 4517-4524.

25 Z. Guttenberg, H. Müller, H. Habermüller, A. Geisbauer, J. Pipper, J. Felbel, M. Kielpinski, J. Scriba and A. Wixforth, Lab Chip, 2005, 5, 308-317.
26 Z. Hua, J. L. Rouse, A. E. Eckhardt, V. Srinivasan, V. K. Pamula, W. A. Schell, J. L. Benton, T. G. Mitchell and M. G. Pollack, Anal. Chem., 2010, 82, 2310-2316.
27 H. Kim, M. S. Bartsch, R. F. Renzi, J. He, J. L. Van de Vreugde, M. R. Claudnic and K. D. Patel, J. Lab. Autom., 2011, 16, 405-414.
28 R. Sista, Z. Hua, P. Thwar, A. Sudarsan, V. Srinivasan, A. Eckhardt, M. Pollack and V. Pamula, Lab Chip, 2008, 8, 2091-2104.
29 N. A. Mousa, M. J. Jebrail, H. Yang, M. Abdelgawad, P. Metalnikov, J. Chen, A. R. Wheeler and R. F. Casper, Sci. Transl. Med., 2009, 1, lra2.
30 C. Arnaud, Chem. Eng. News, 2011, 89, 13-17.
31 R. S. Sista, A. E. Eckhardt, T. Wang, C. Graham, J. L. Rouse, S. M. Norton, V. Srinivasan, M. G. Pollack, A. A. Tolun, D. Bali, D. S. Millington and V. K. Pamula, Clin. Chem., 2011, 57, 1444-1451.
32 M. J. Jebrail, H. Yang, J. M. Mudrik, N. M. Lafreniere, C. McRoberts, O. Y. Al-Dirbashi, L. Fisher, P. Chakraborty and A. R. Wheeler, Lab Chip, 2011, 11, 3218-3224.
33 S. C. C. Shih, H. Yang, M. J. Jebrail, R. Fobel, N. McIntosh, O. Y. Al-Dirbashi, P. Chakraborty and A. R. Wheeler, Anal. Chem., 2012, 84, 3731-3738.
34 V. Srinivasan, V. K. Pamula and R. B. Fair, Anal. Chim. Acta, 2004, 507, 145-150.
35 C. Extrand and A. Gent, J. Colloid Interface Sci., 1990, 138, 431-442.
36 M. Elsharkawy, T. M. Schutzius and C. M. Megaridis, Lab Chip, 2014, 14, 1168-1175.
37 J. Chirife and M. P. Buera, J. Food Eng., 1997, 33, 221-226.
38 J. Schneider, A. Egatz-Gomez, S. Melle, S. Lindsay, P. Dominguez-Garcia, M. A. Rubio, M. Marquez and A. A. Garcia, Colloids Surf., A, 2008, 323, 19-27.
39 N. A. Patankar, Langmuir, 2003, 19, 1249-1253.

Supplementary Figures and Videos for Motorized Actuation System to Perform Droplet Operations on Printed Plastic Sheets See DOI: 10.1039/c61c00176a Electronic Supplementary Material (ESI) for Lab on a Chip. See http://pubs.rsc.oreen/content/articlelanding/2016/lc/c61c00176a#!divAbstract (incorporated by reference).

Figure 1:
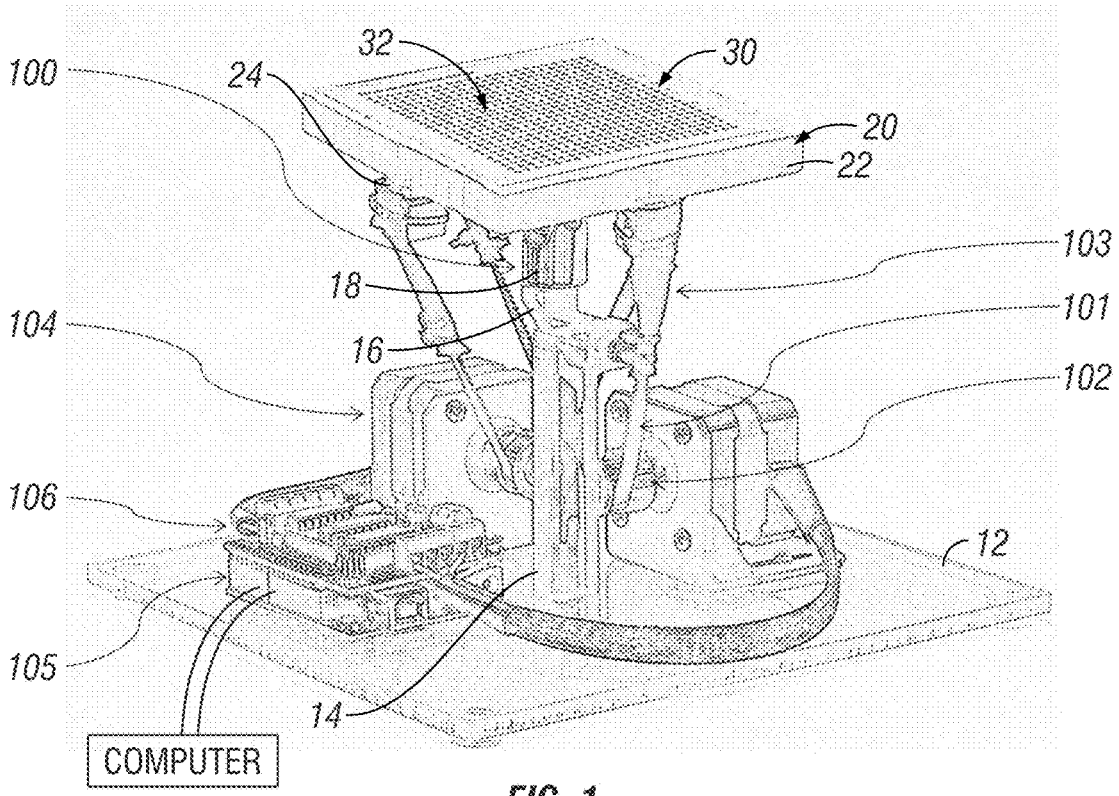
Figure 2:
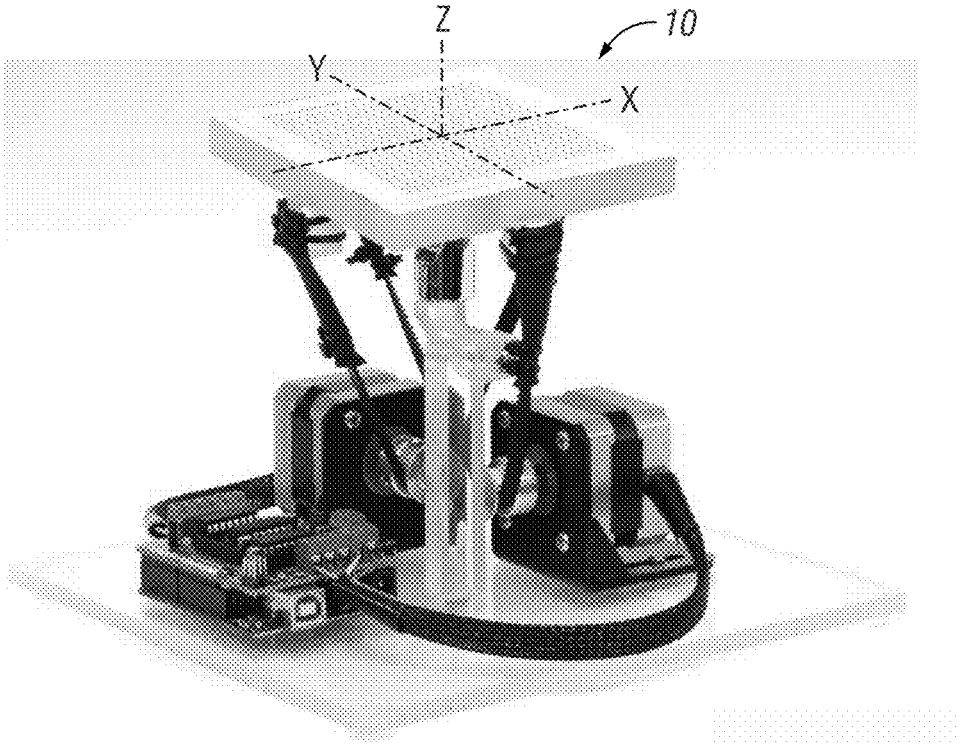
Figure 3:
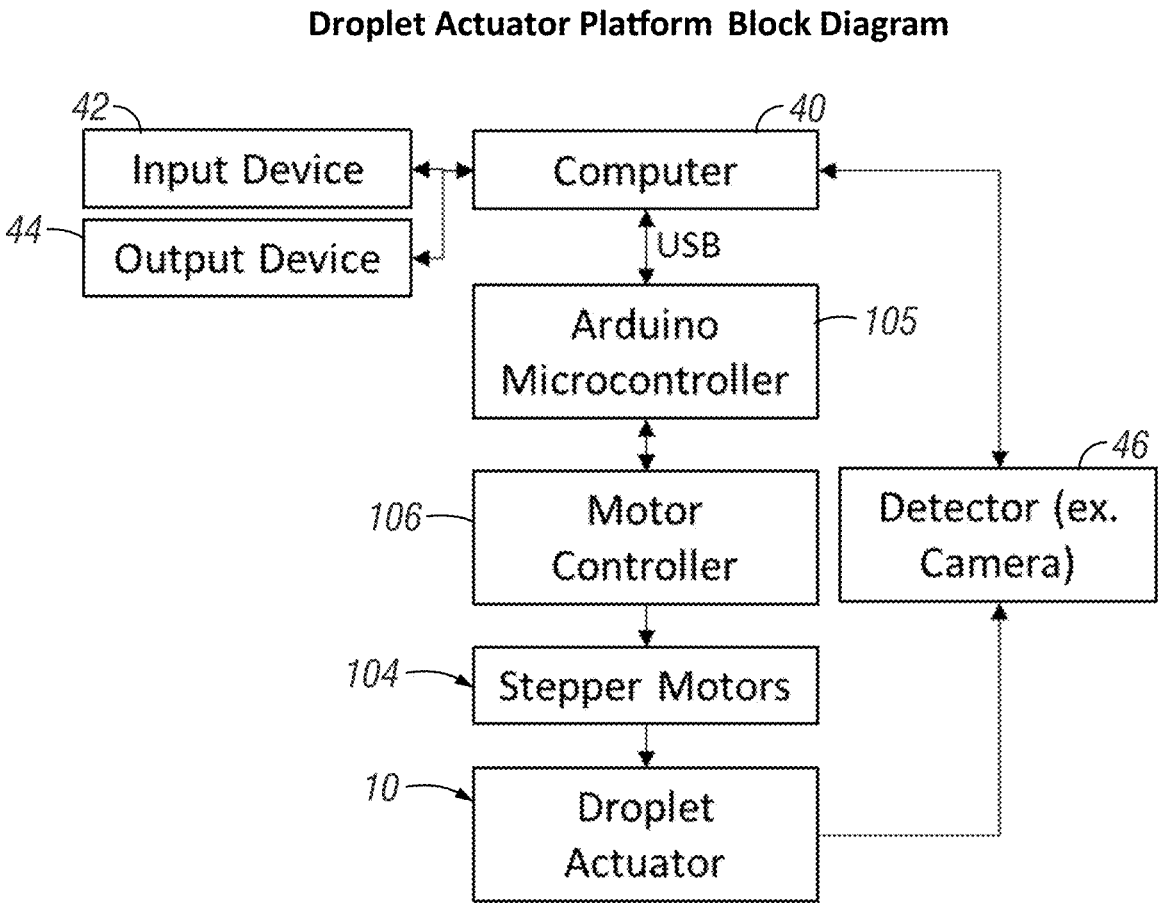
Figures 1, 3:
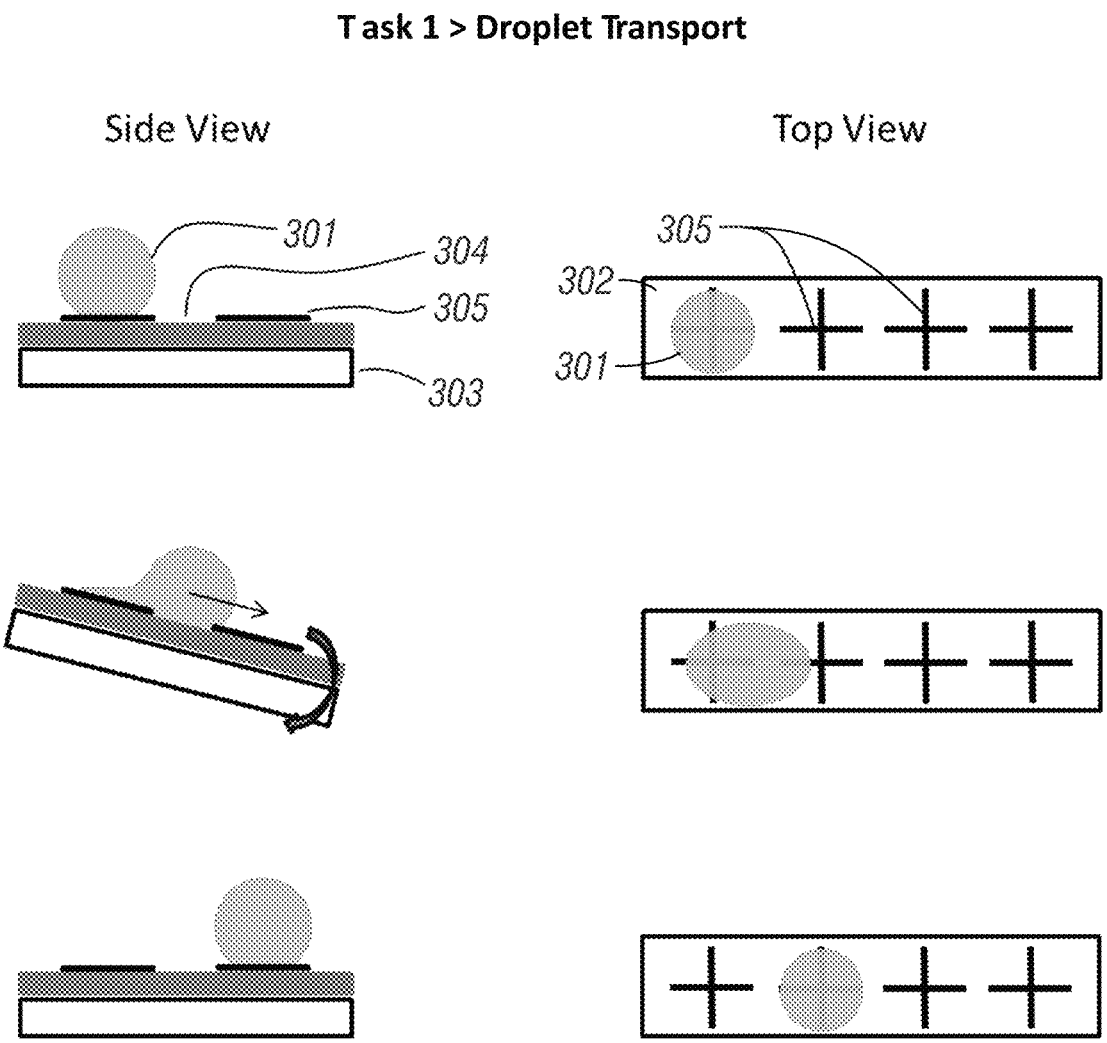
Figure 4:
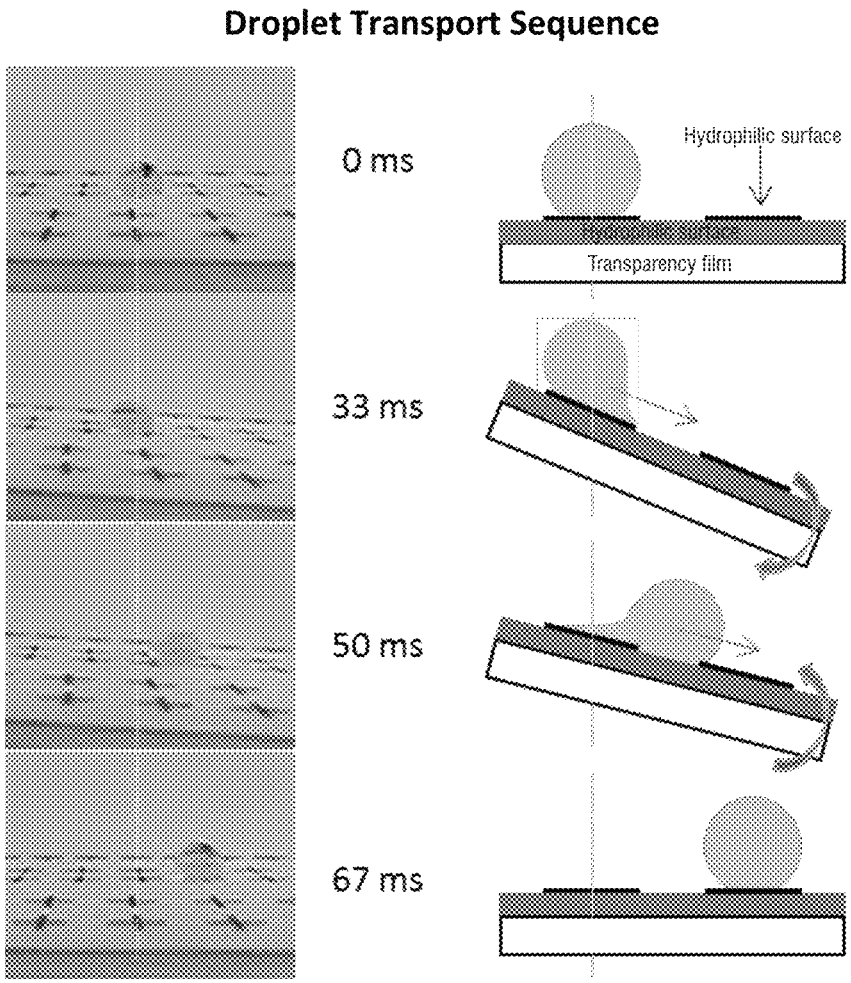
Figure 5:
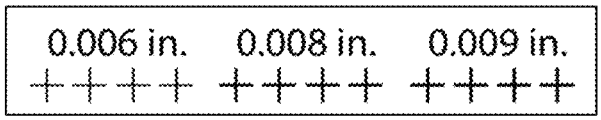
Figure 6:
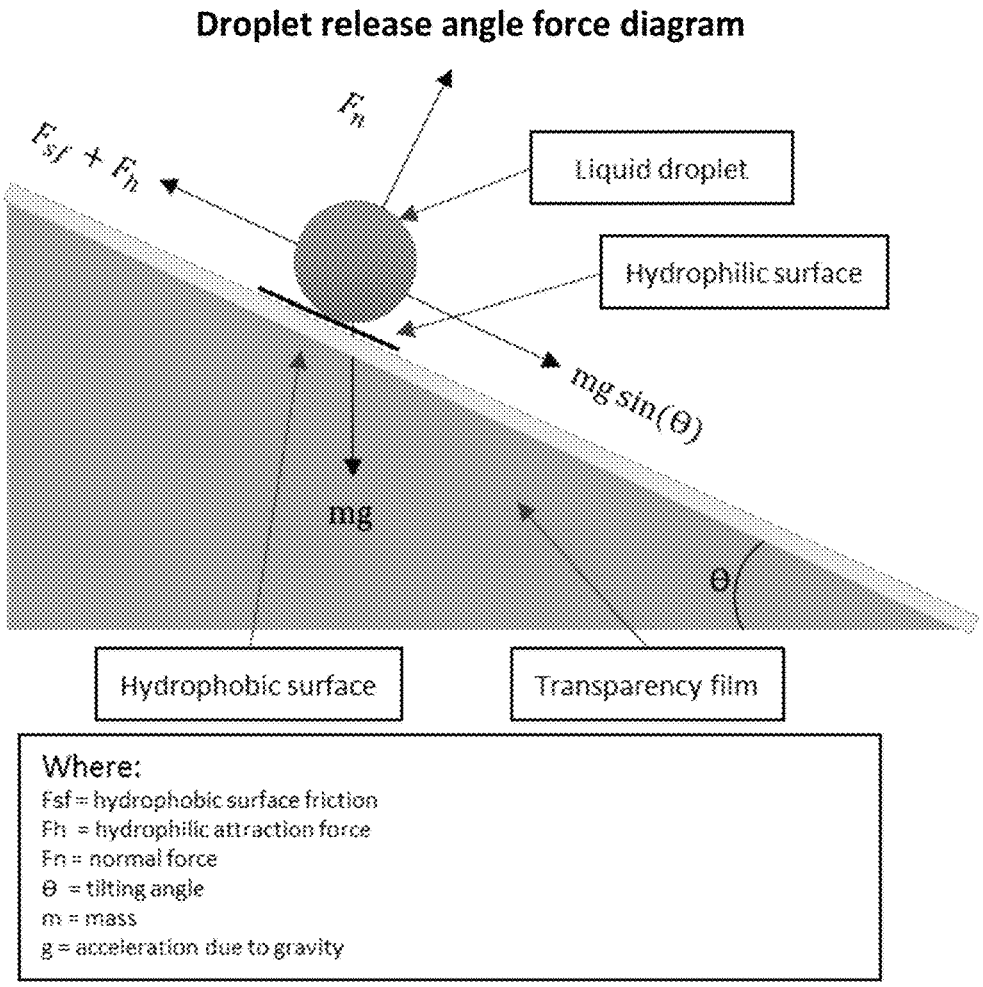
Figure 7:
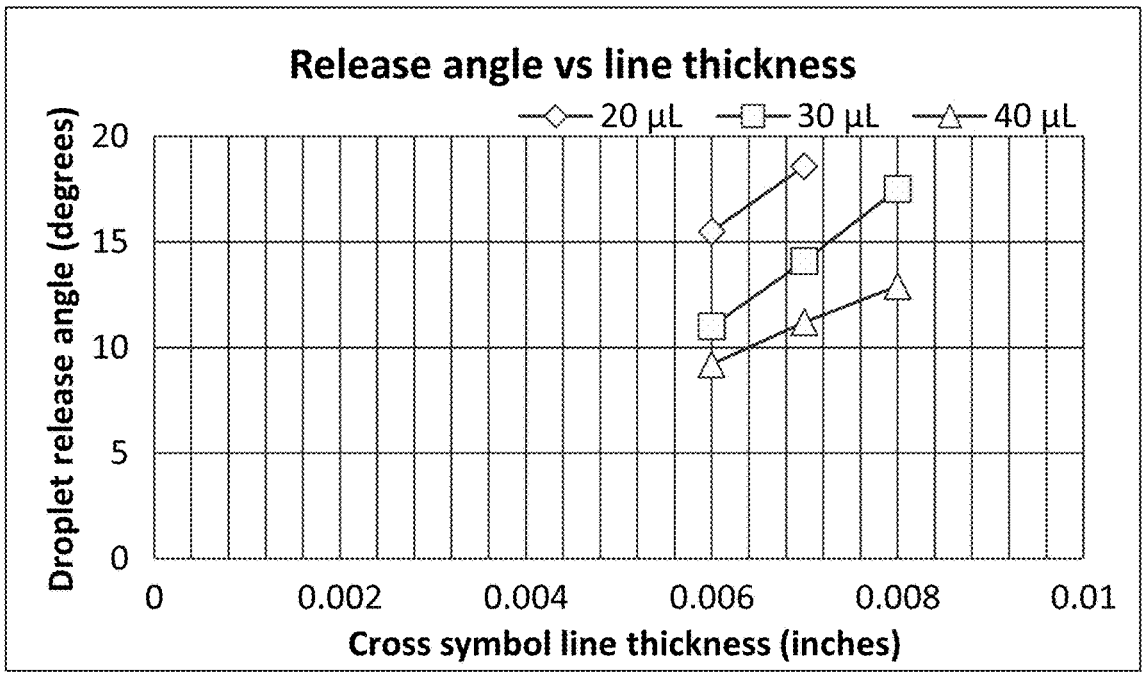
Figure 8:
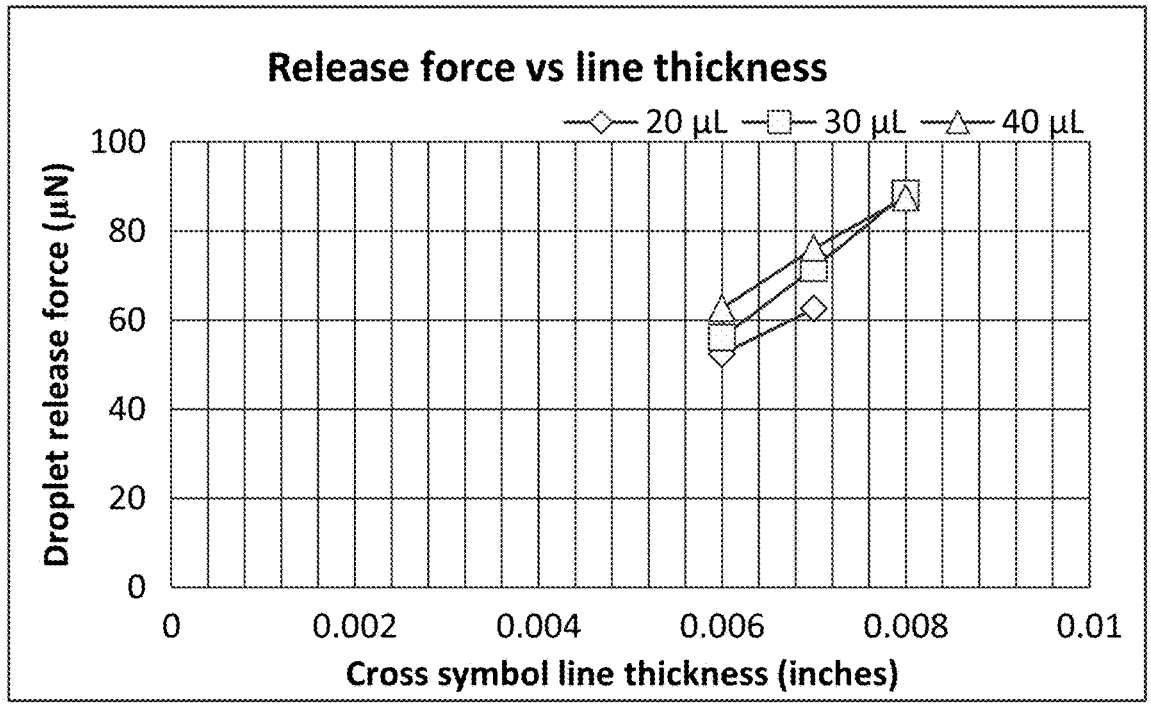
Figure 9:
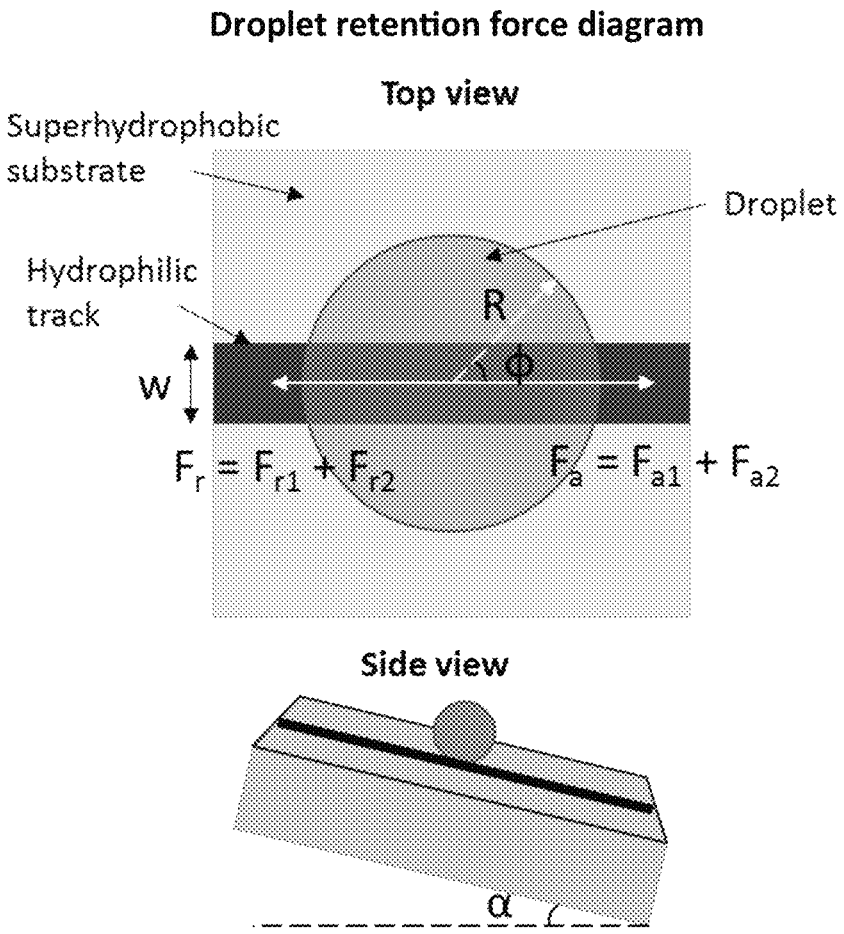
Figure 10:
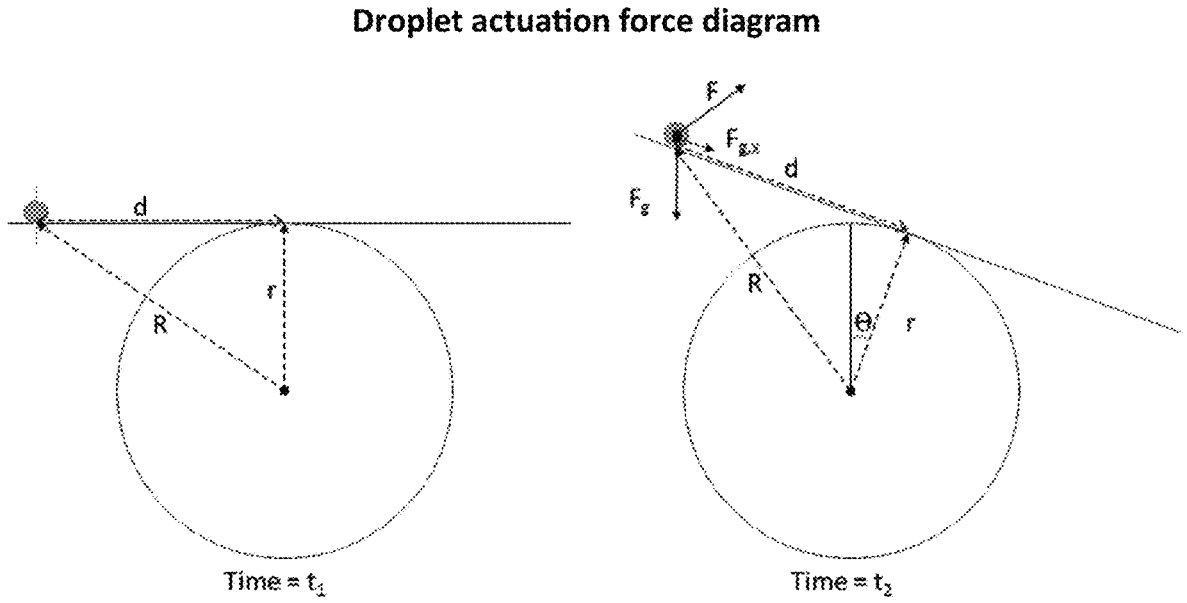
Figure 11:
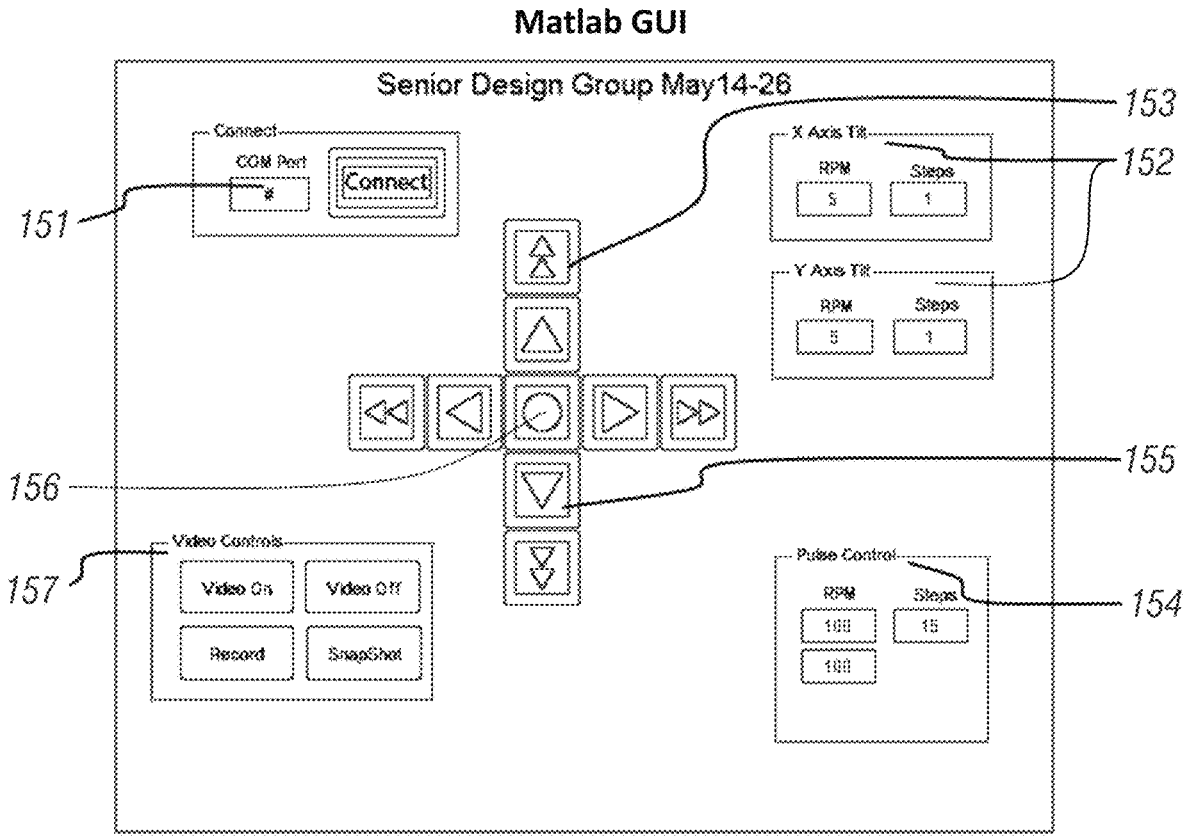
Figure 12:
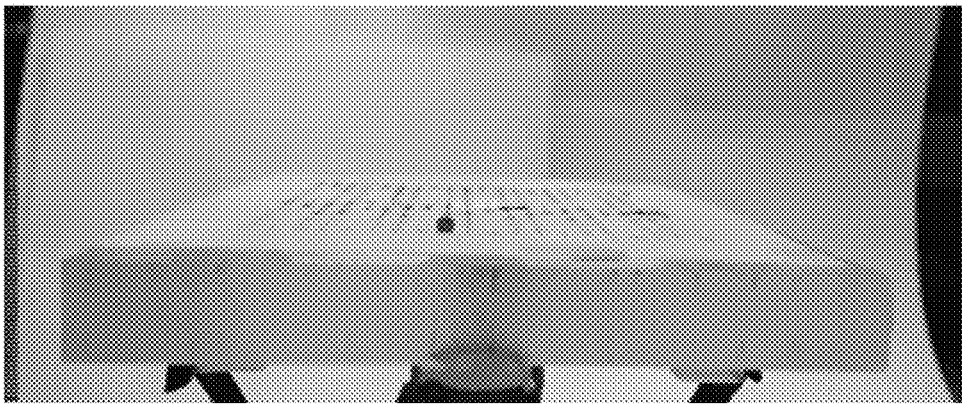
Figure 13:
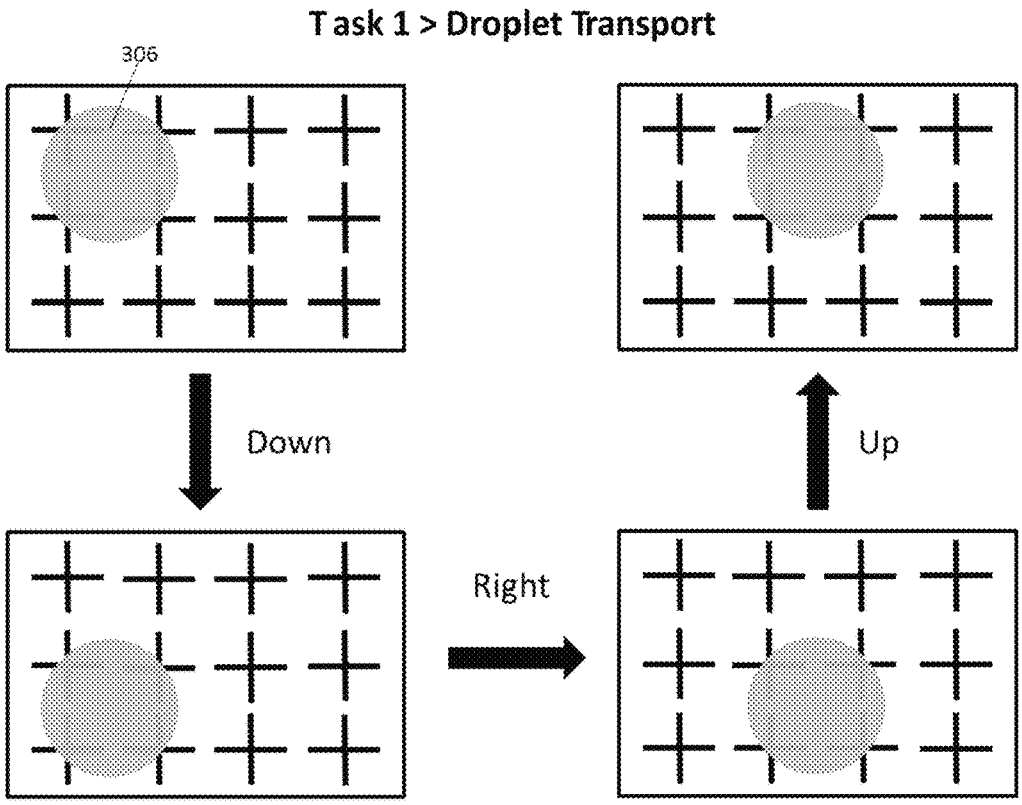
Figures 1, 13:
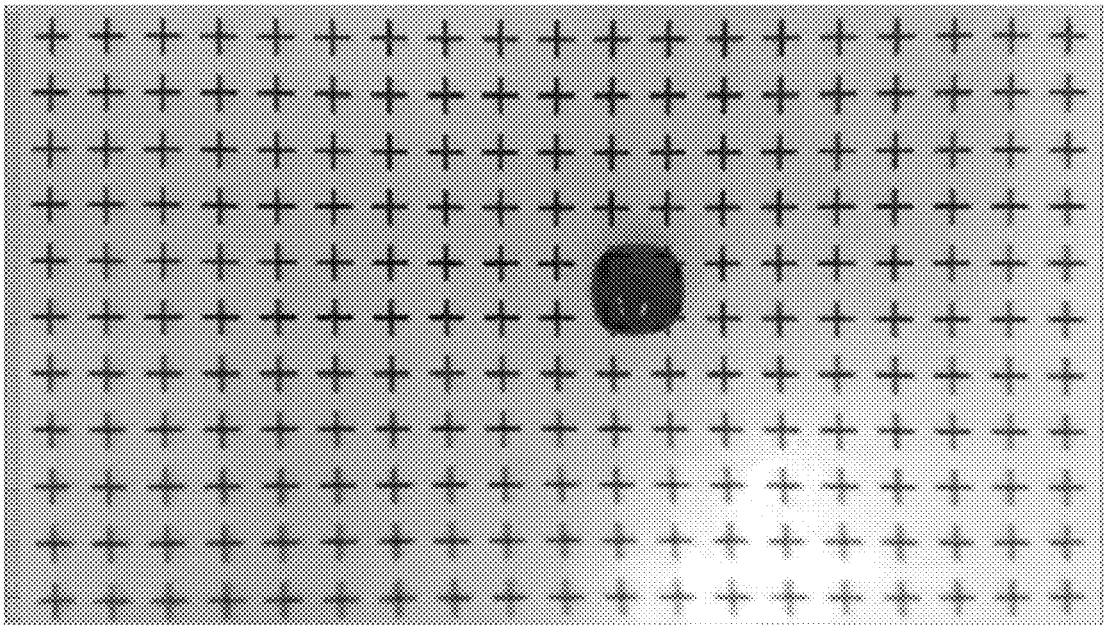
Figure 14:
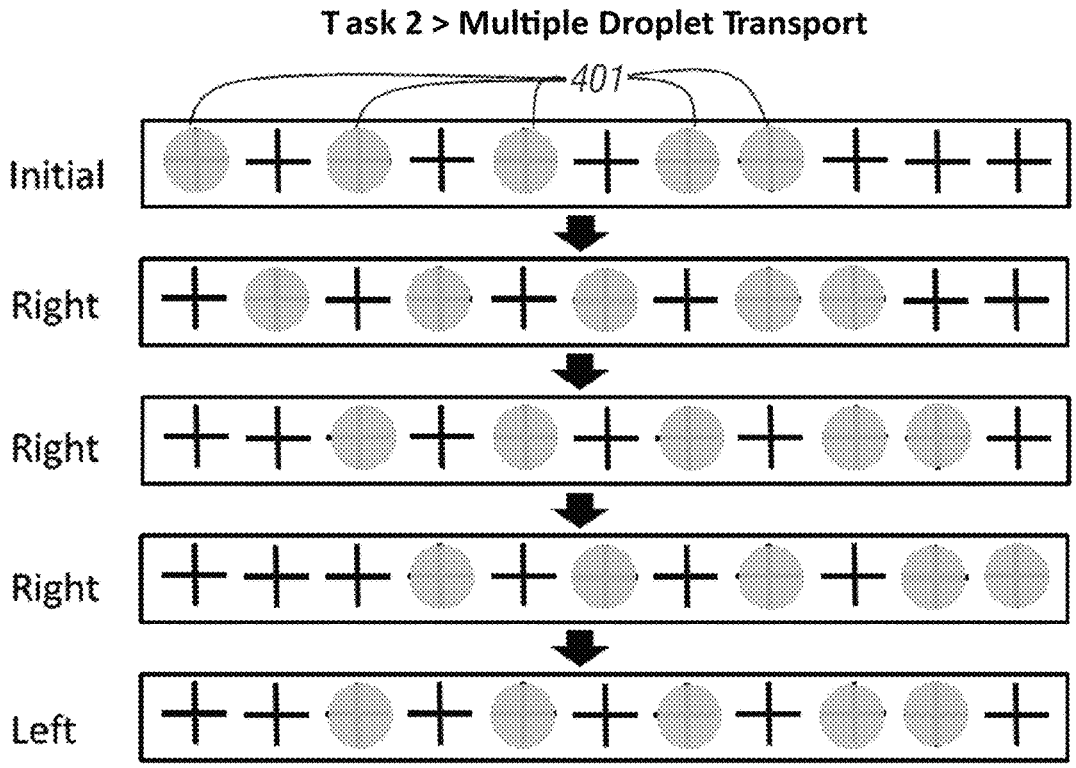
Figures 1, 14:
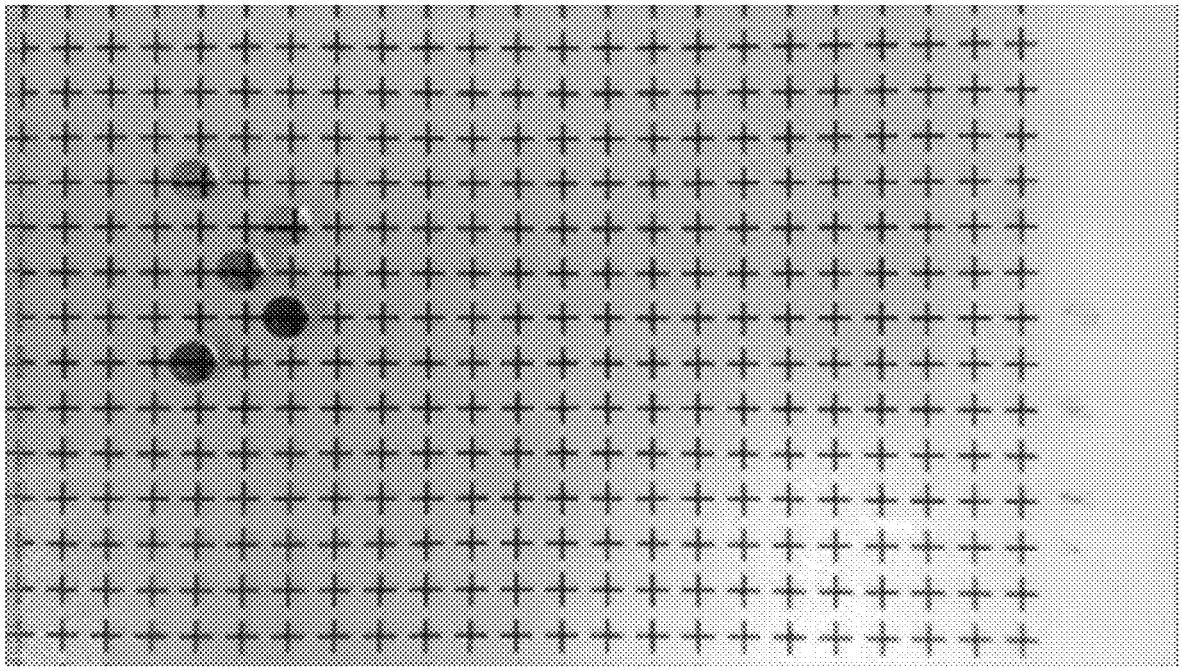
Figure 15:
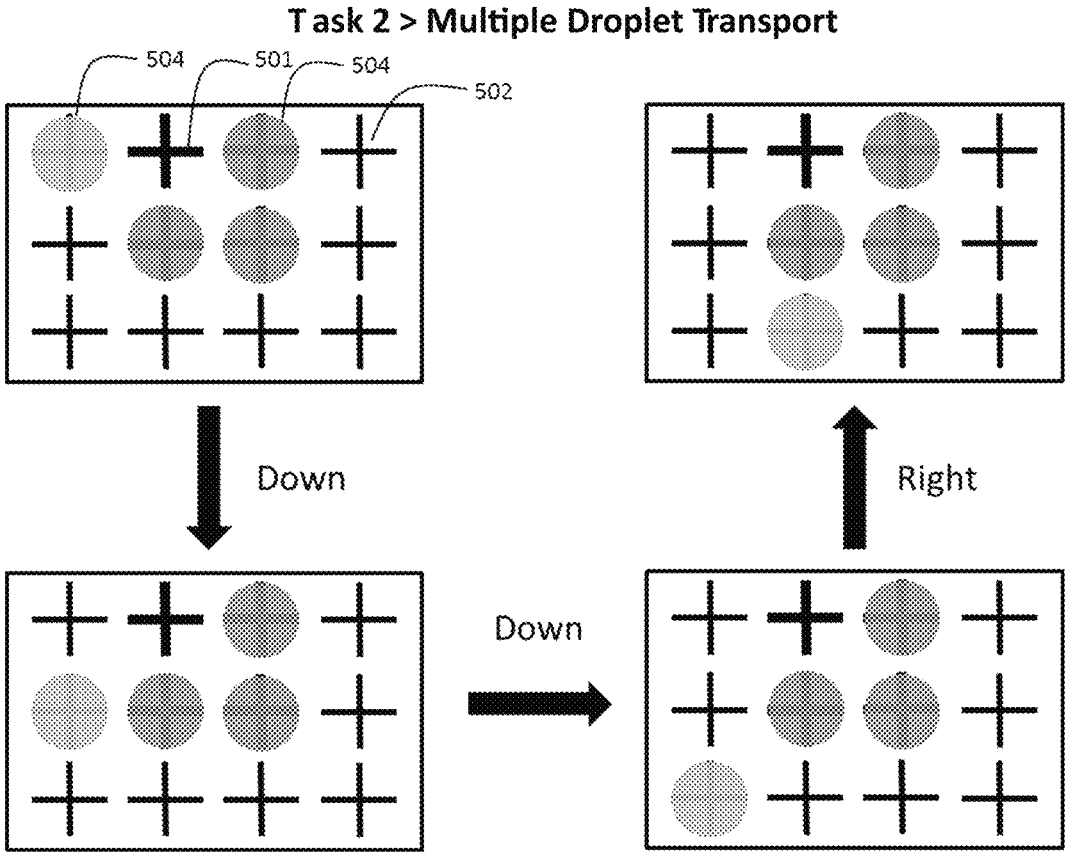
Figure 16:
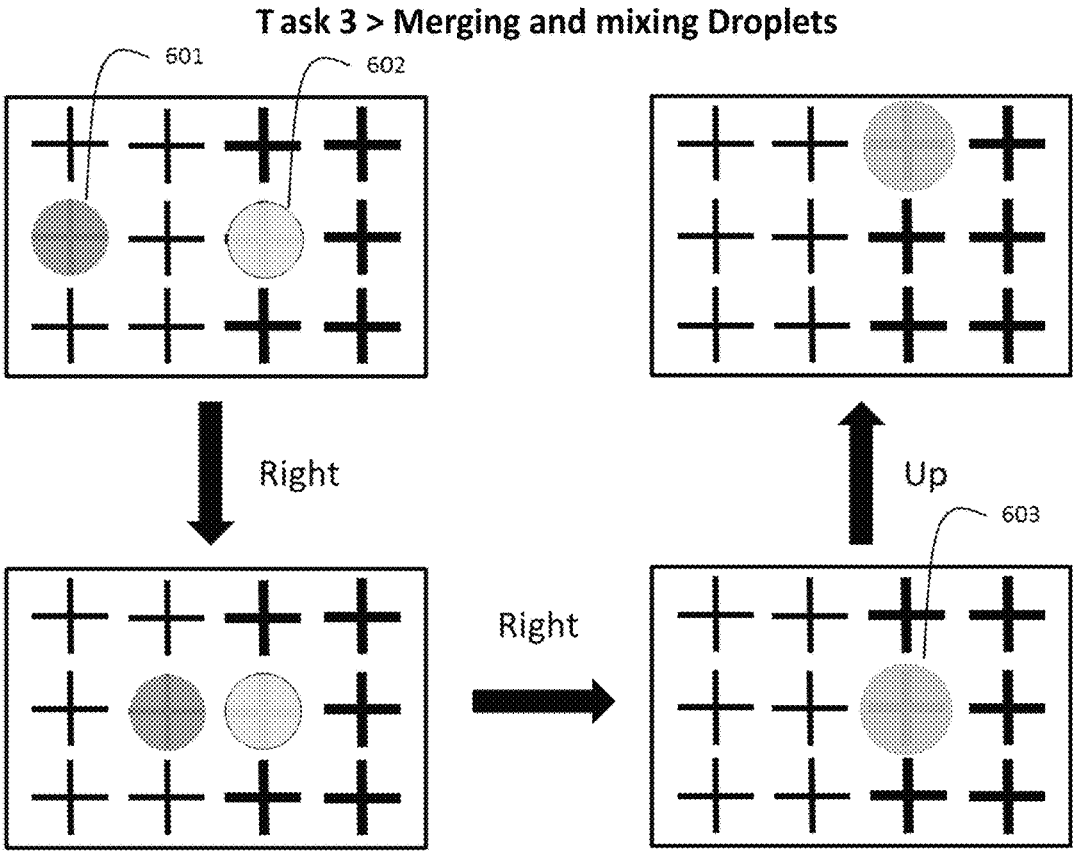
Figures 1, 16:
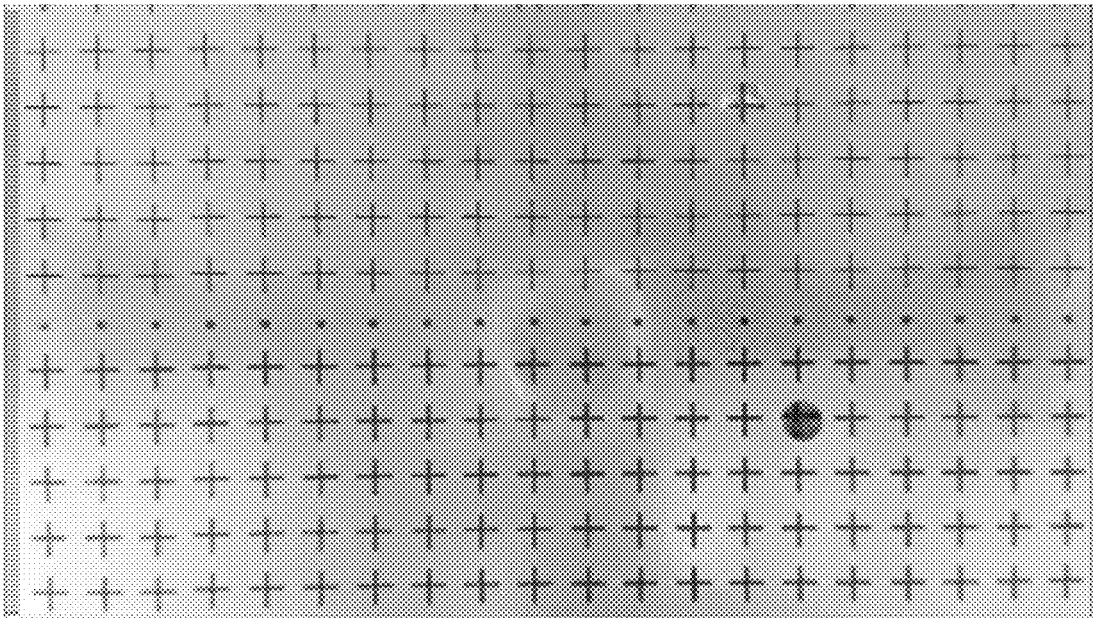
Figure 17:
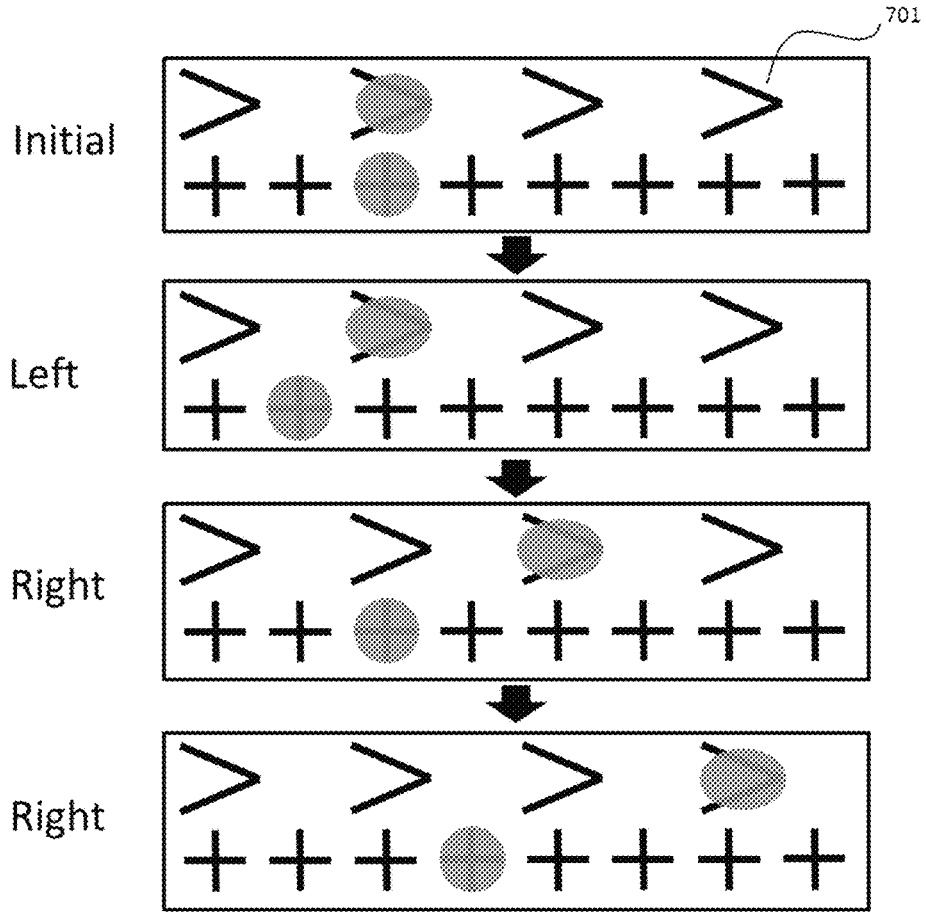
Figures 1, 17:
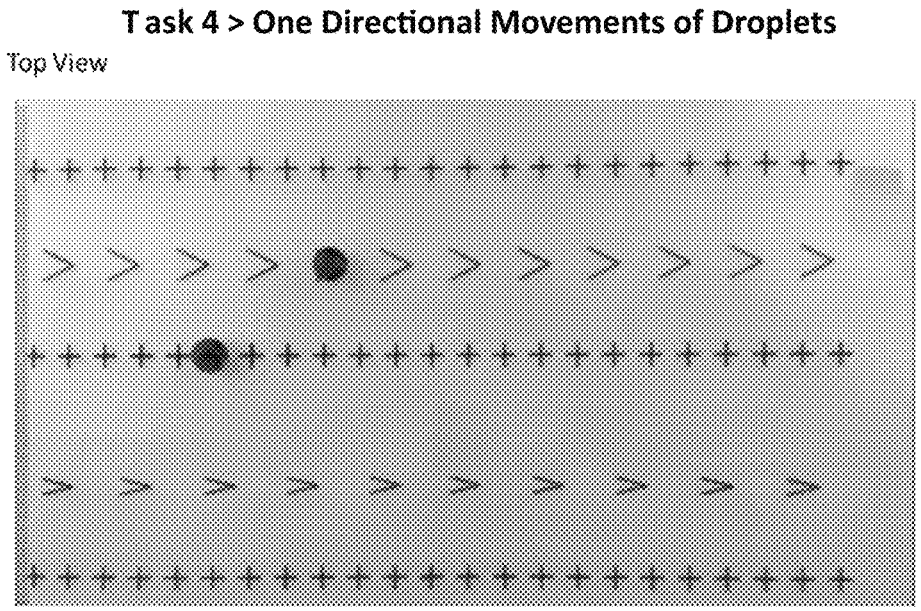
Figures 2, 17:
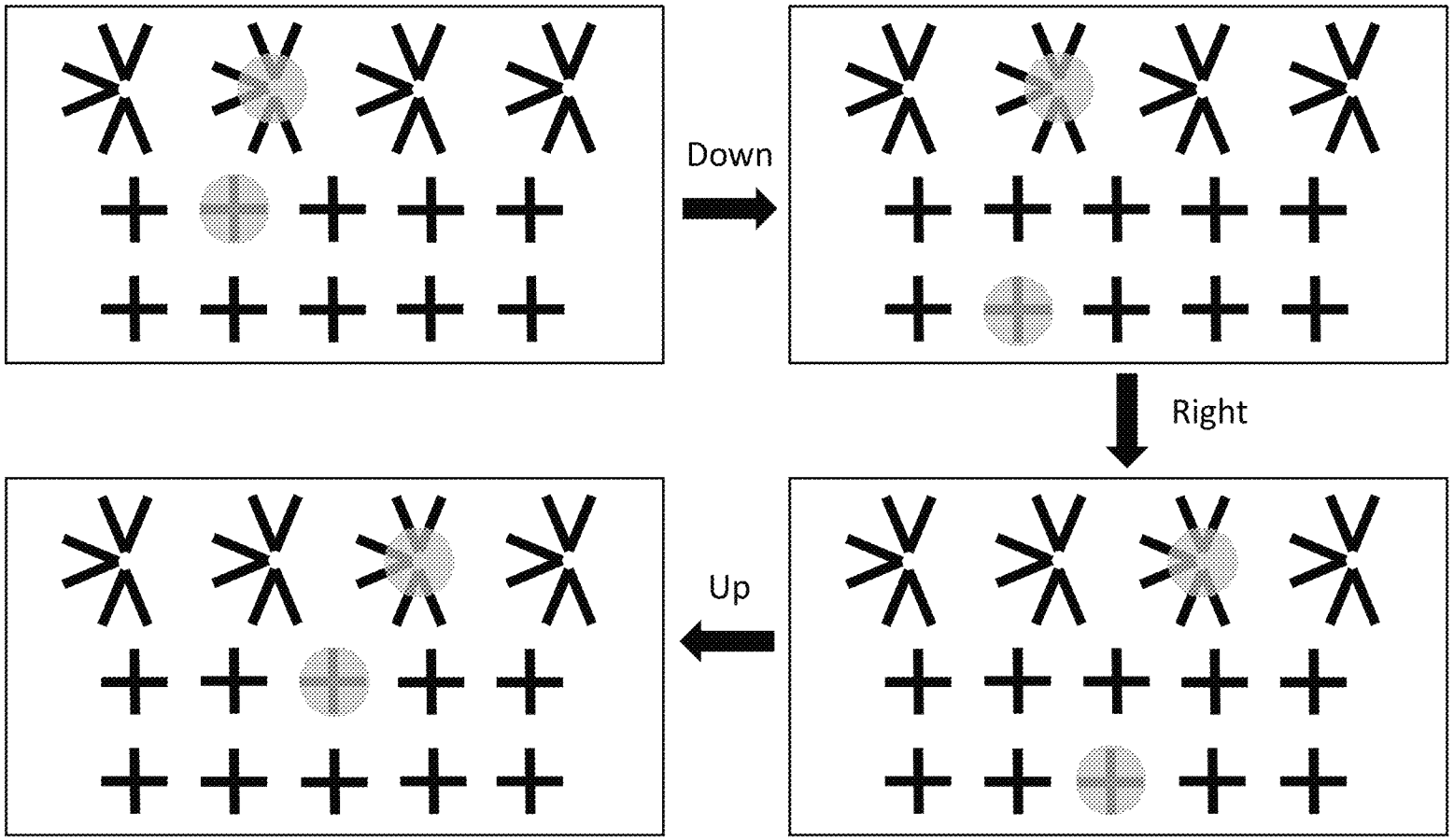
Figures 3, 17:
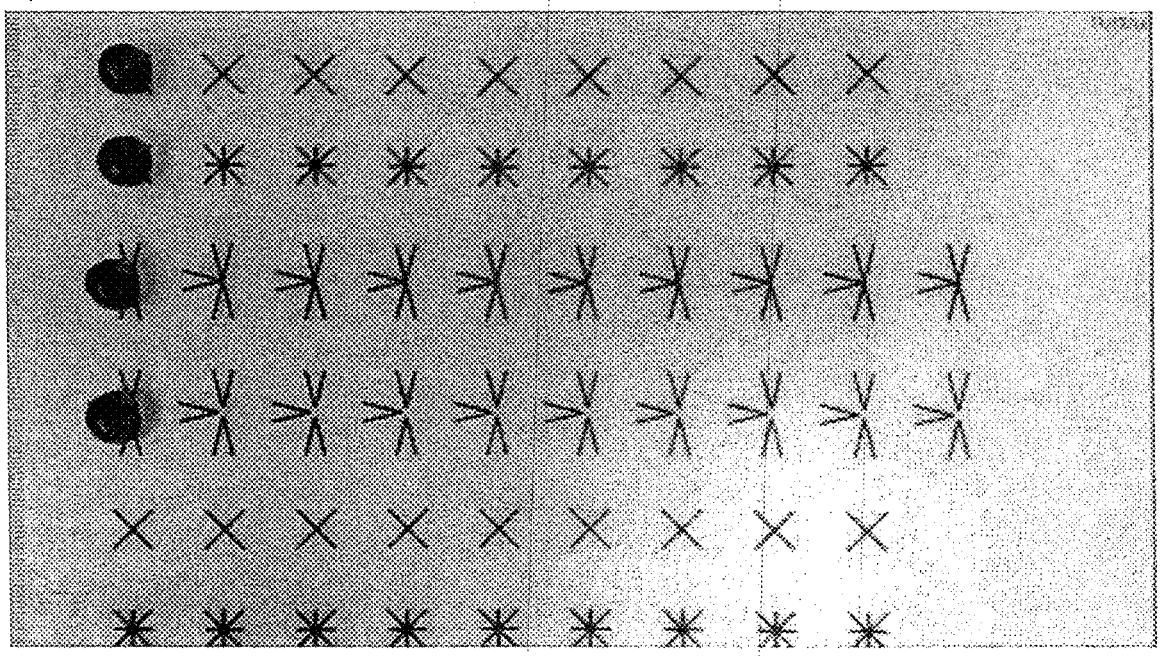
Figure 18:
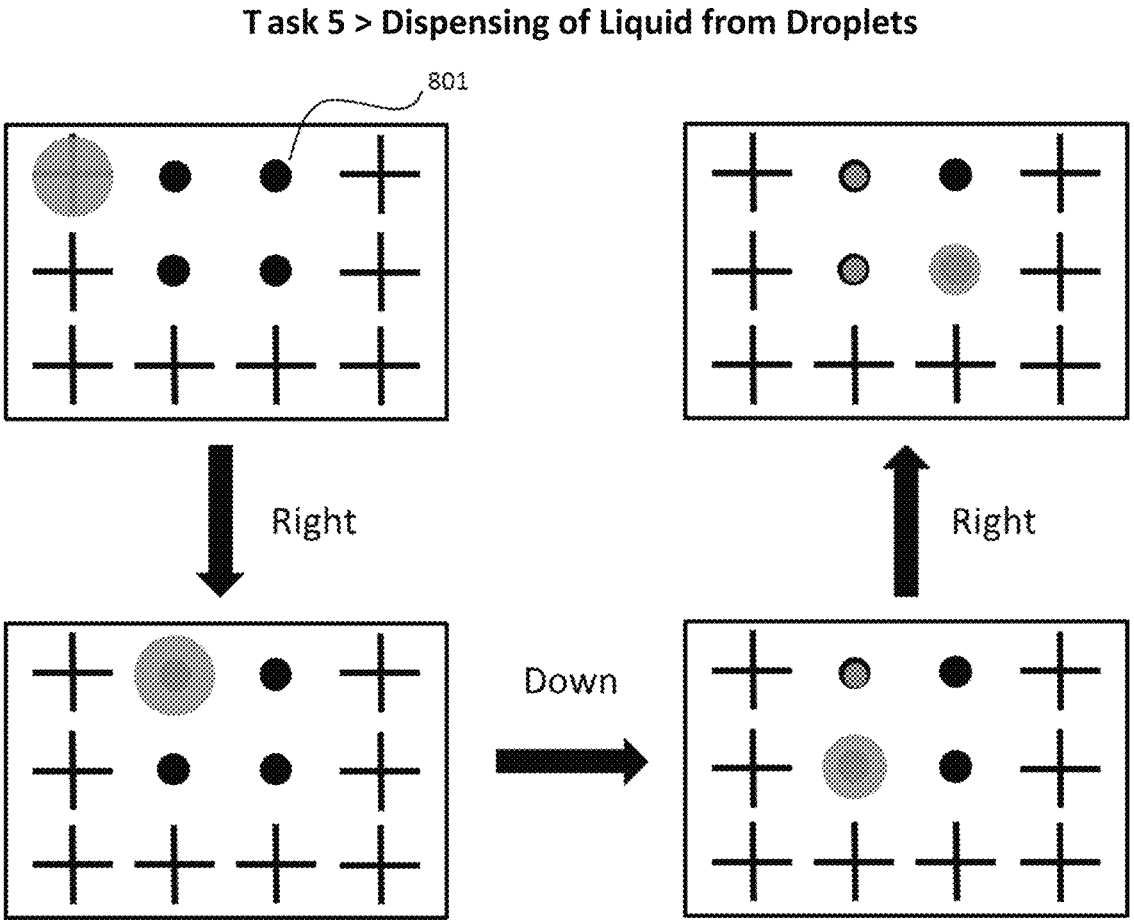
Figures 1, 18:
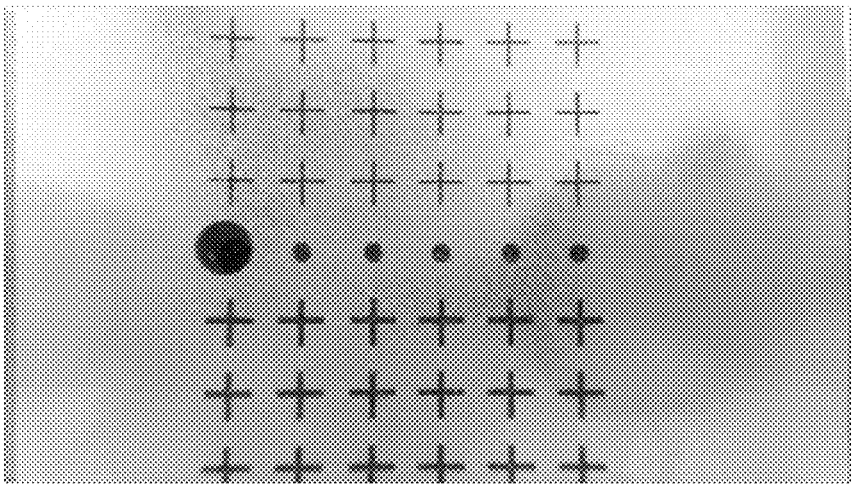
Figure 19:
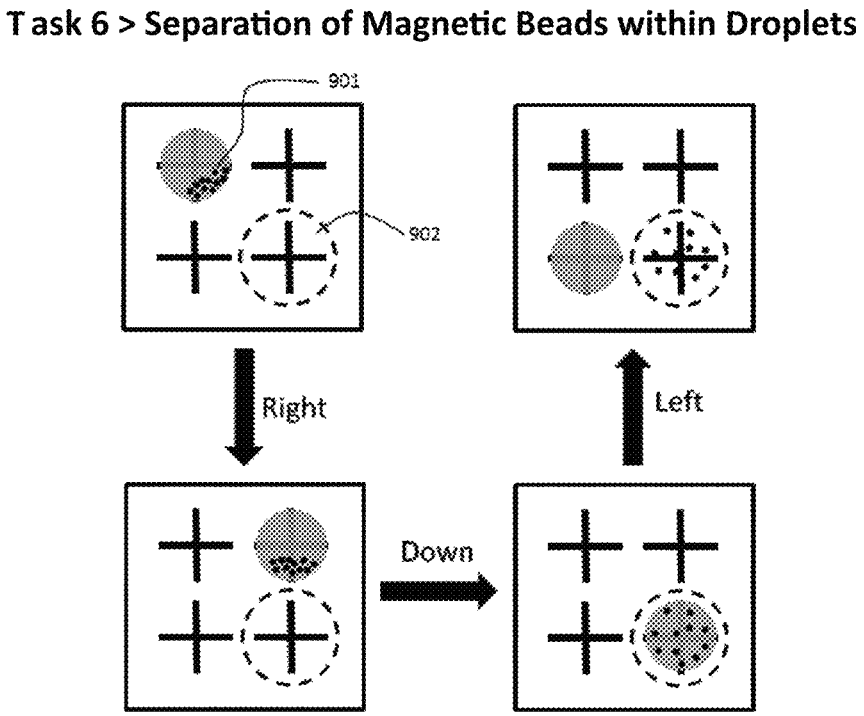
Figures 1, 19:
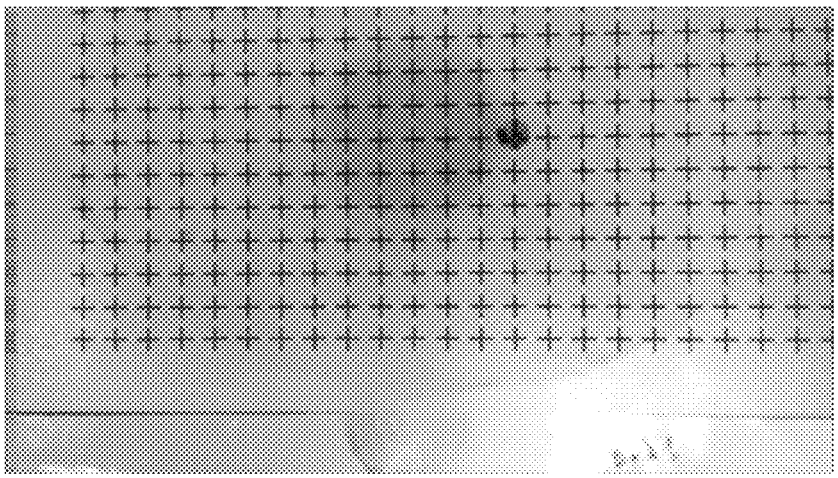
Figures 1, 20:
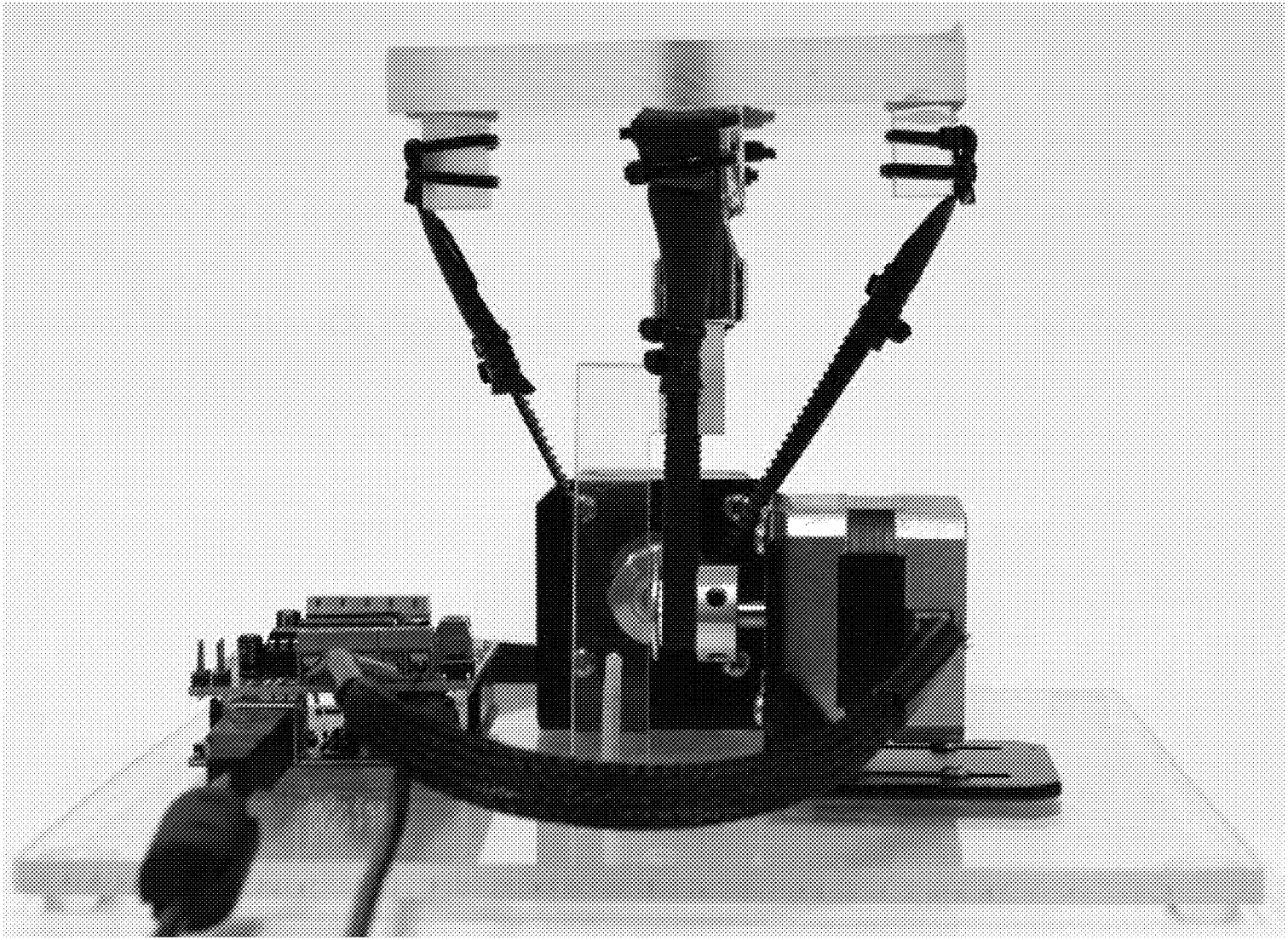
Figures 2, 20:
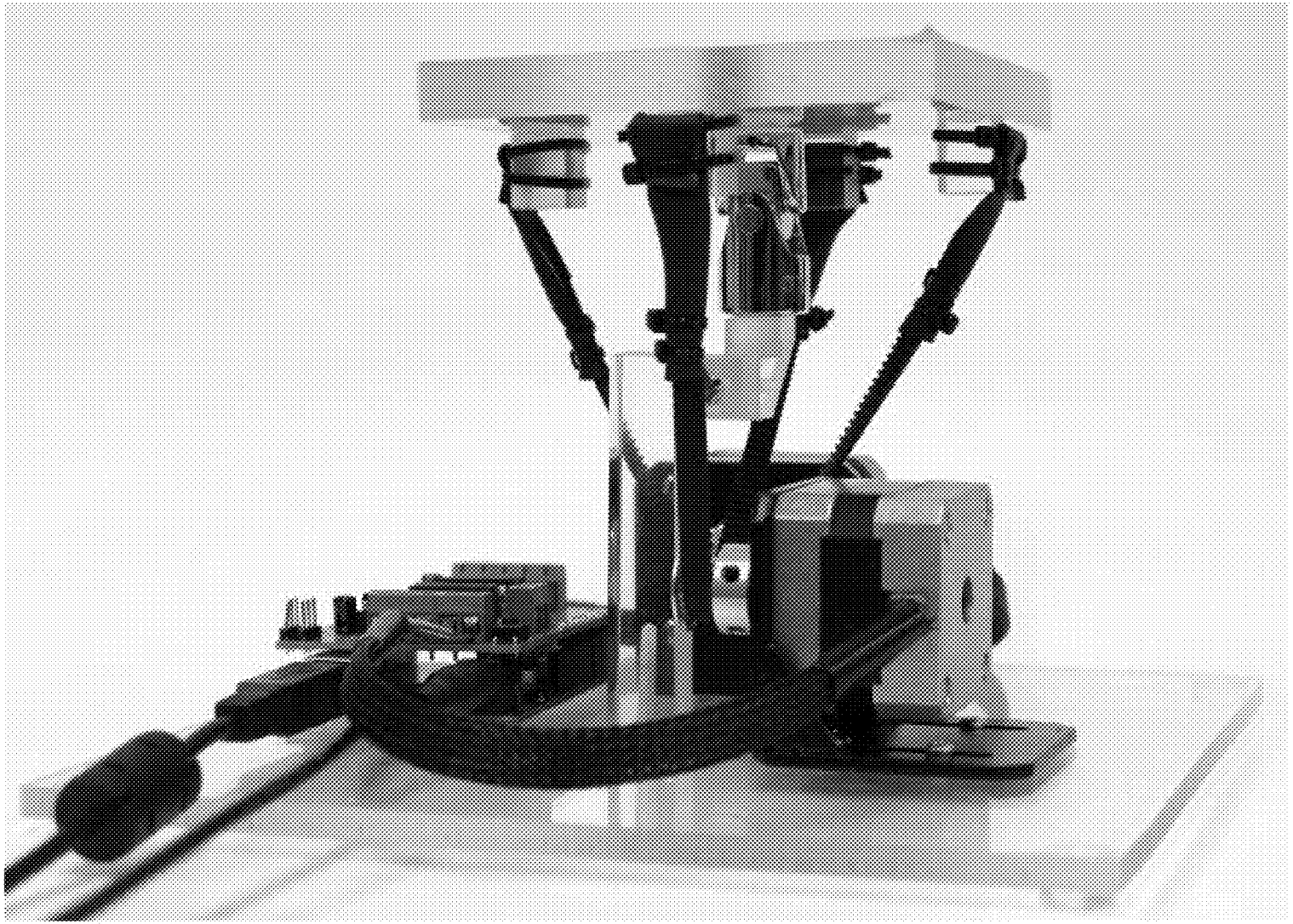
Figures 3, 20:
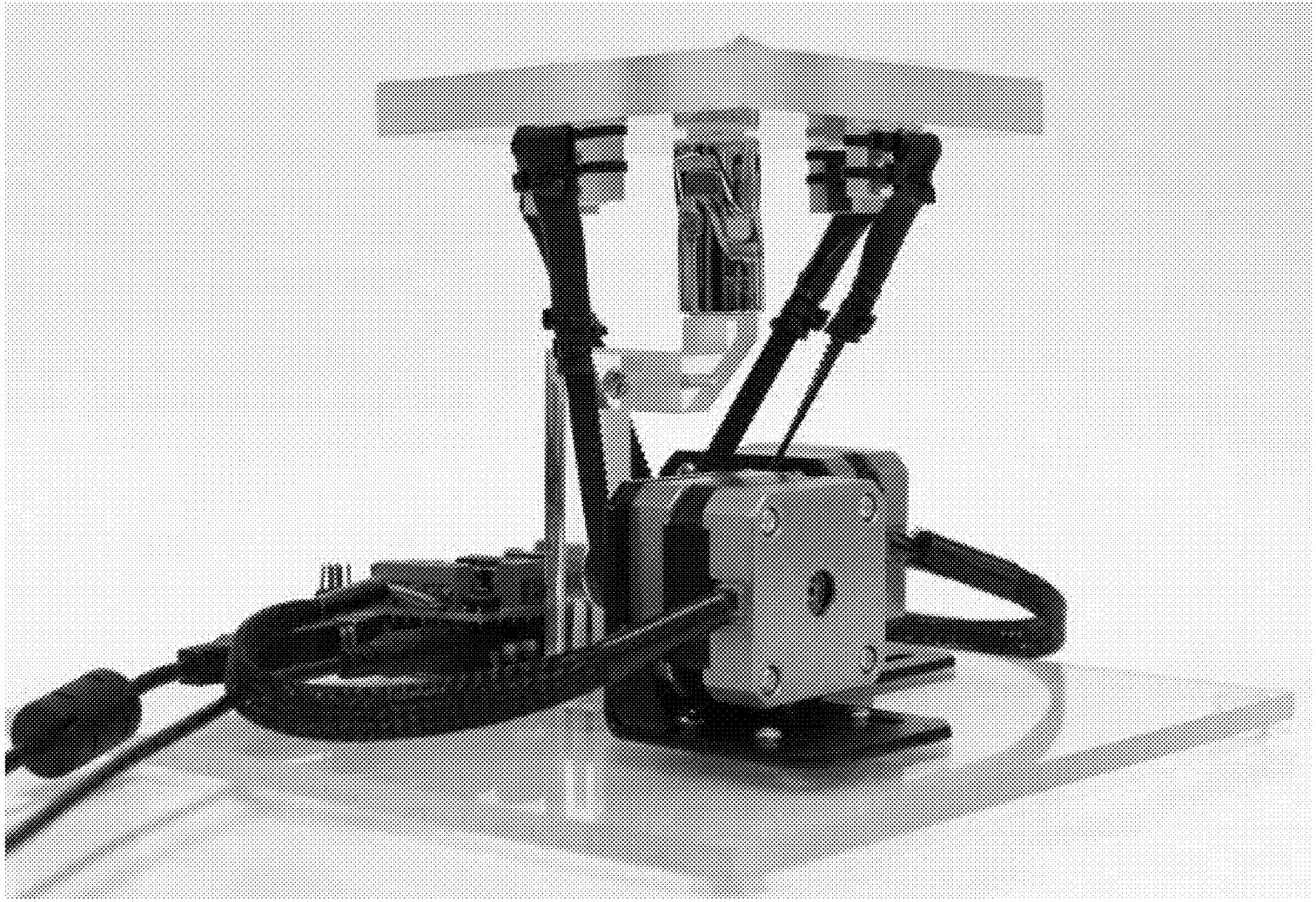
Figures 4, 20:
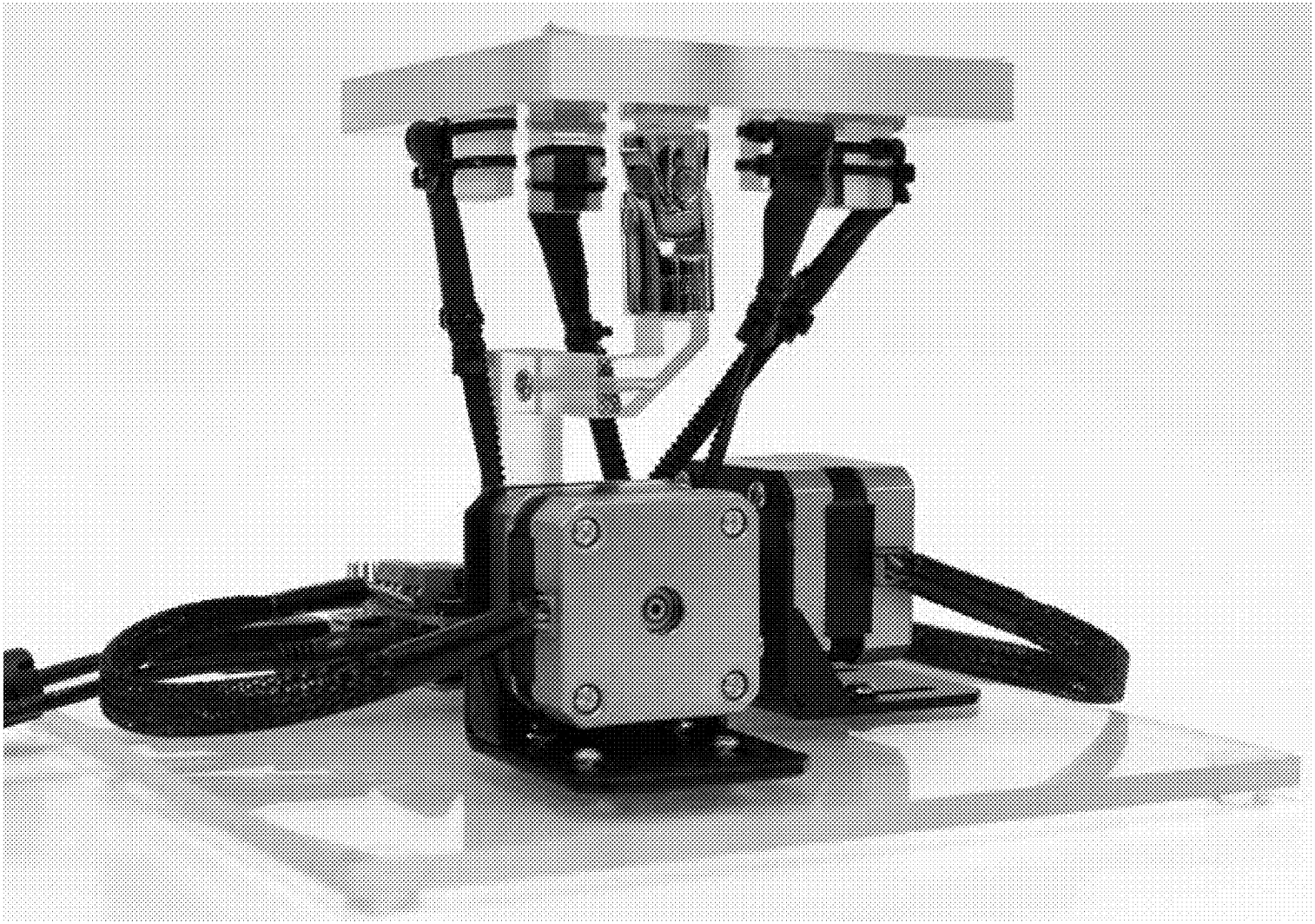
Figures 5, 20:
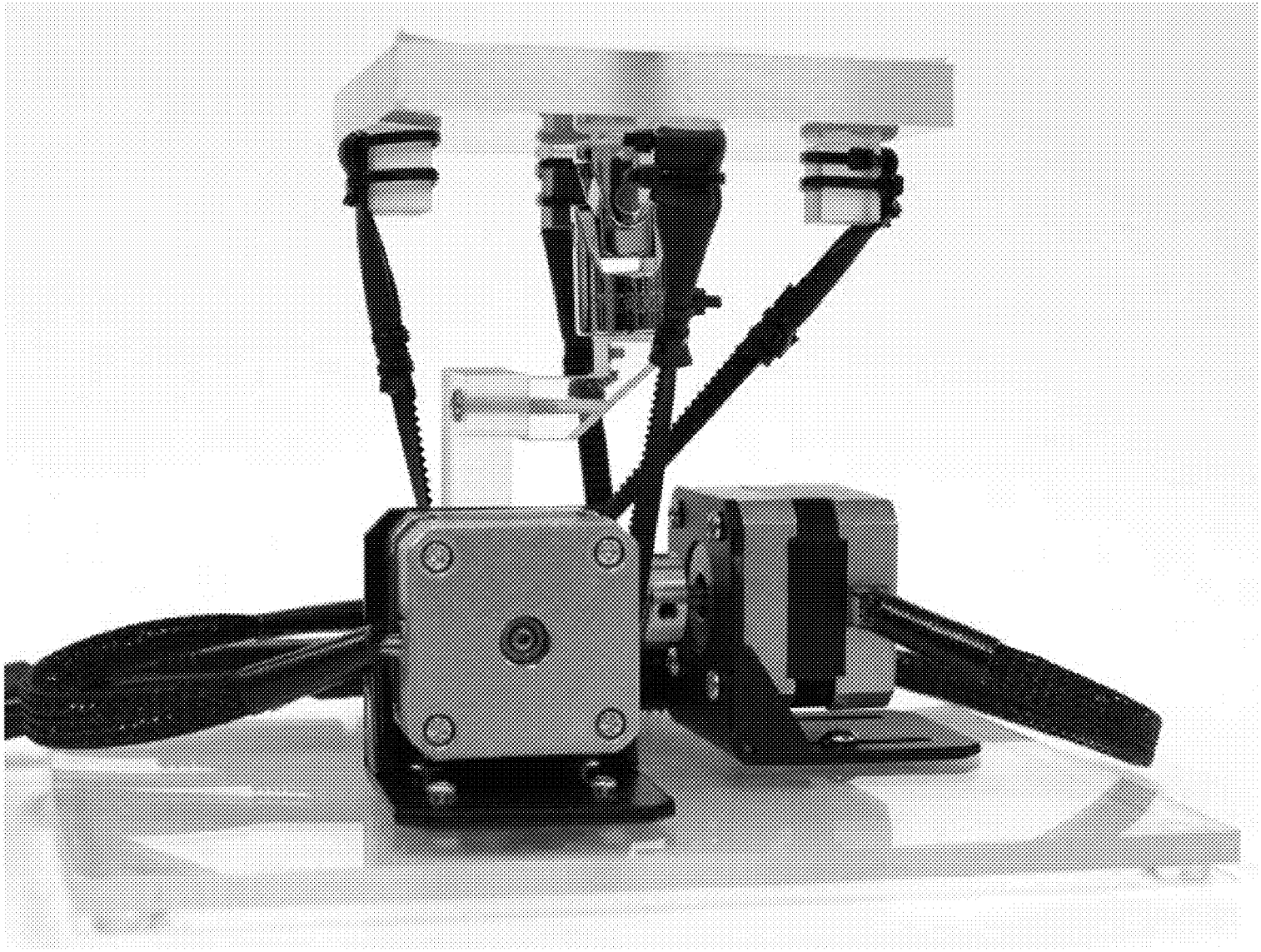
Figures 6, 20:
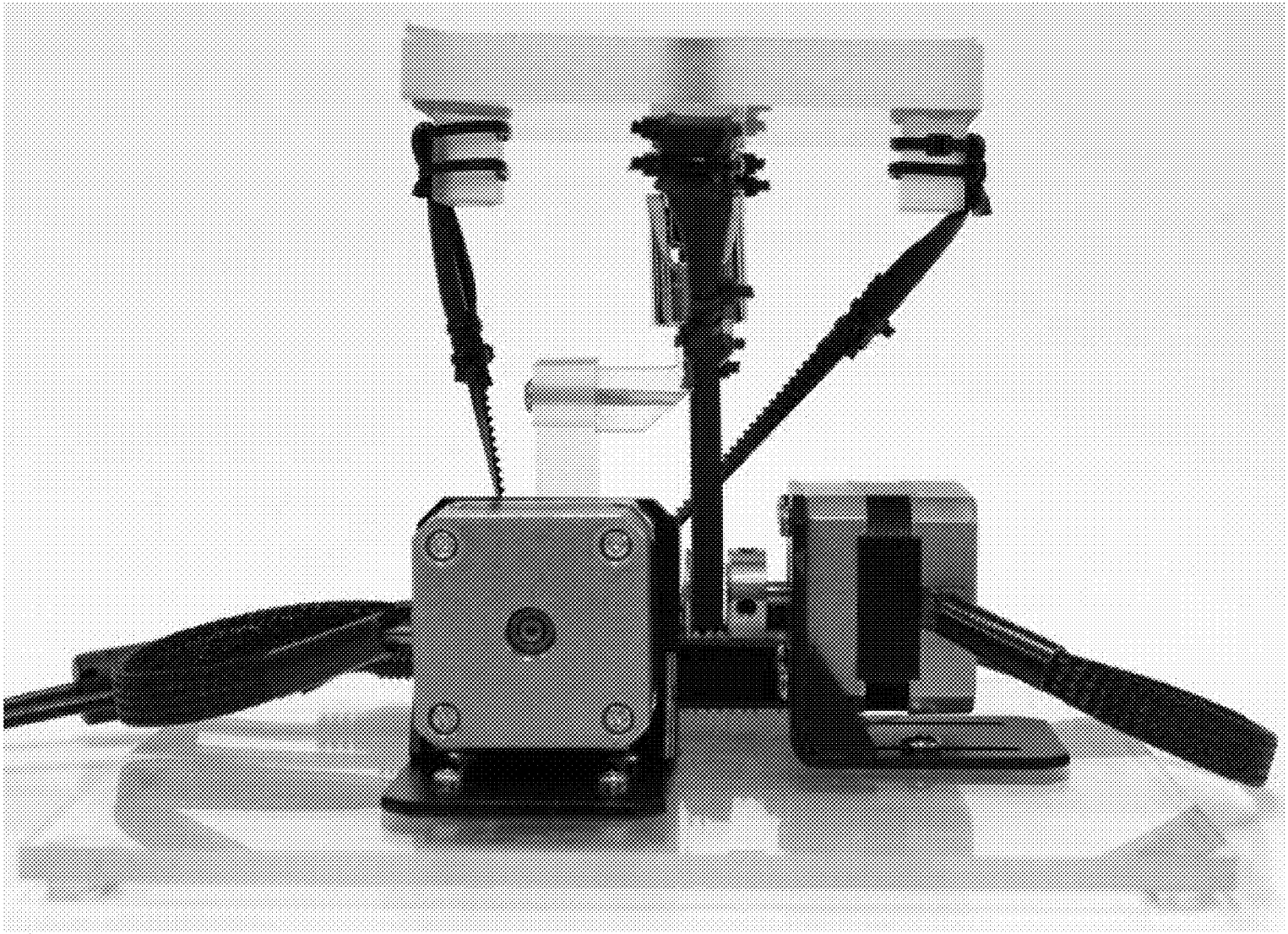
Figures 7, 20:
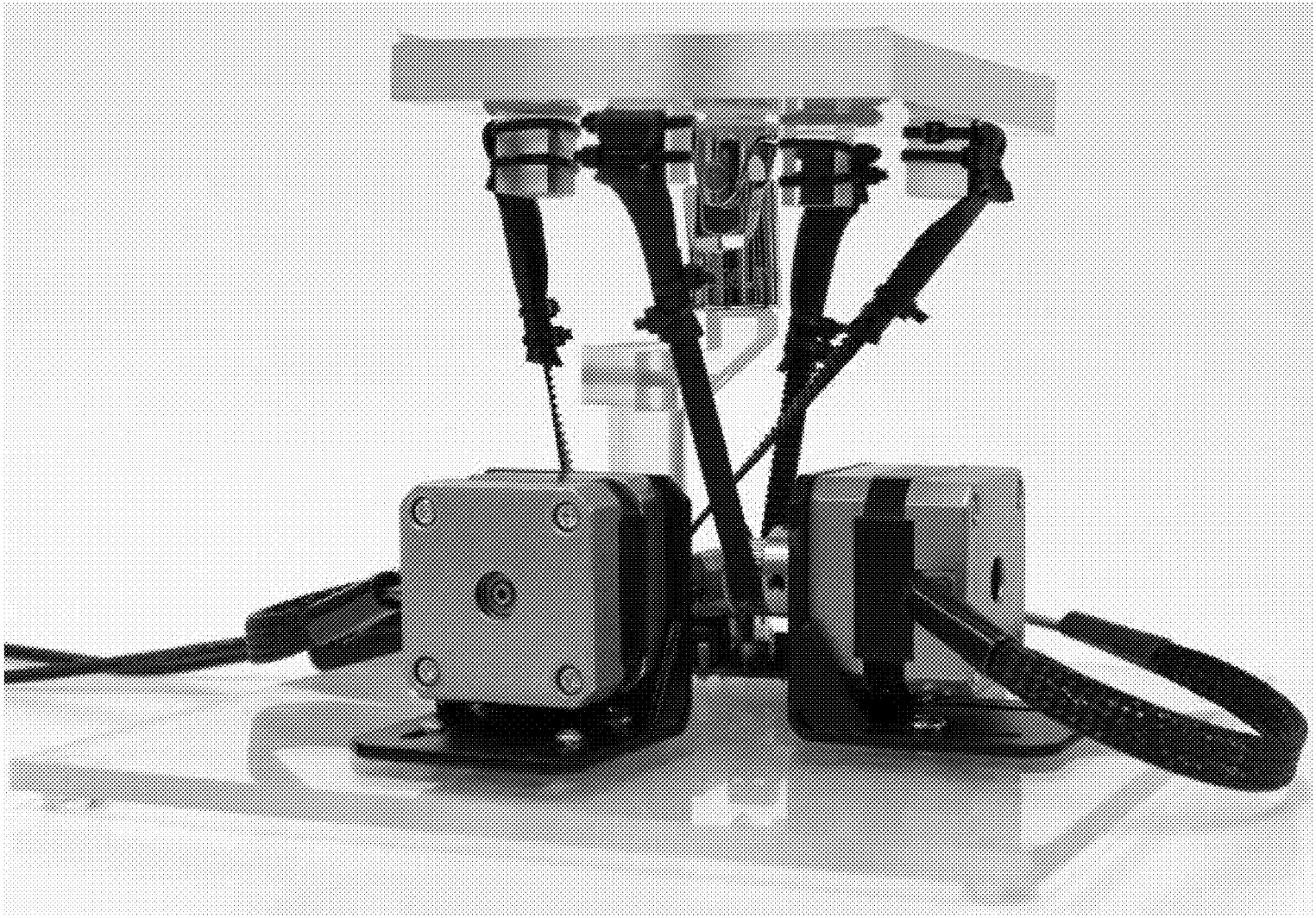
Figures 8, 20:
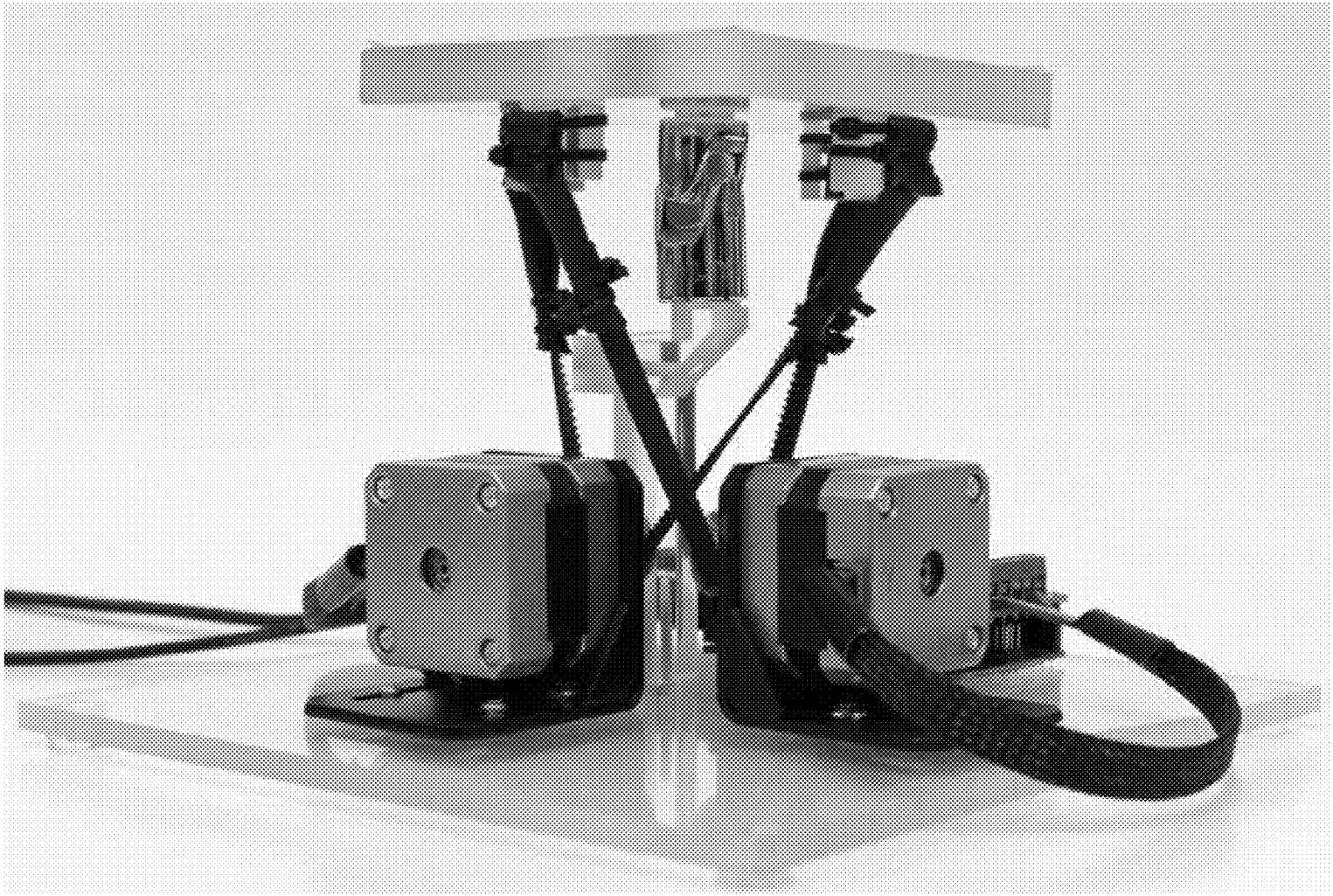
Figures 9, 20:
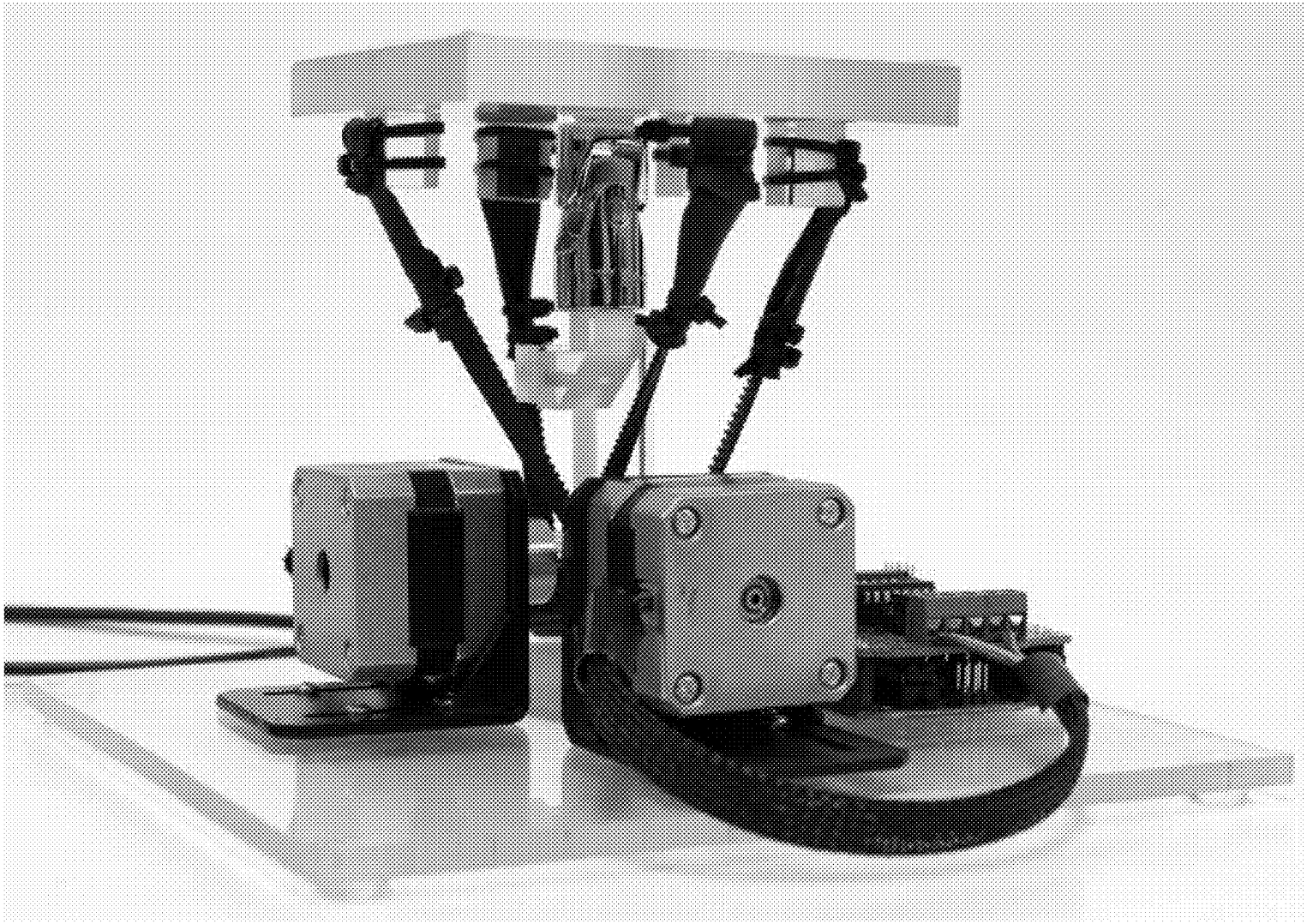
Figures 10, 20:
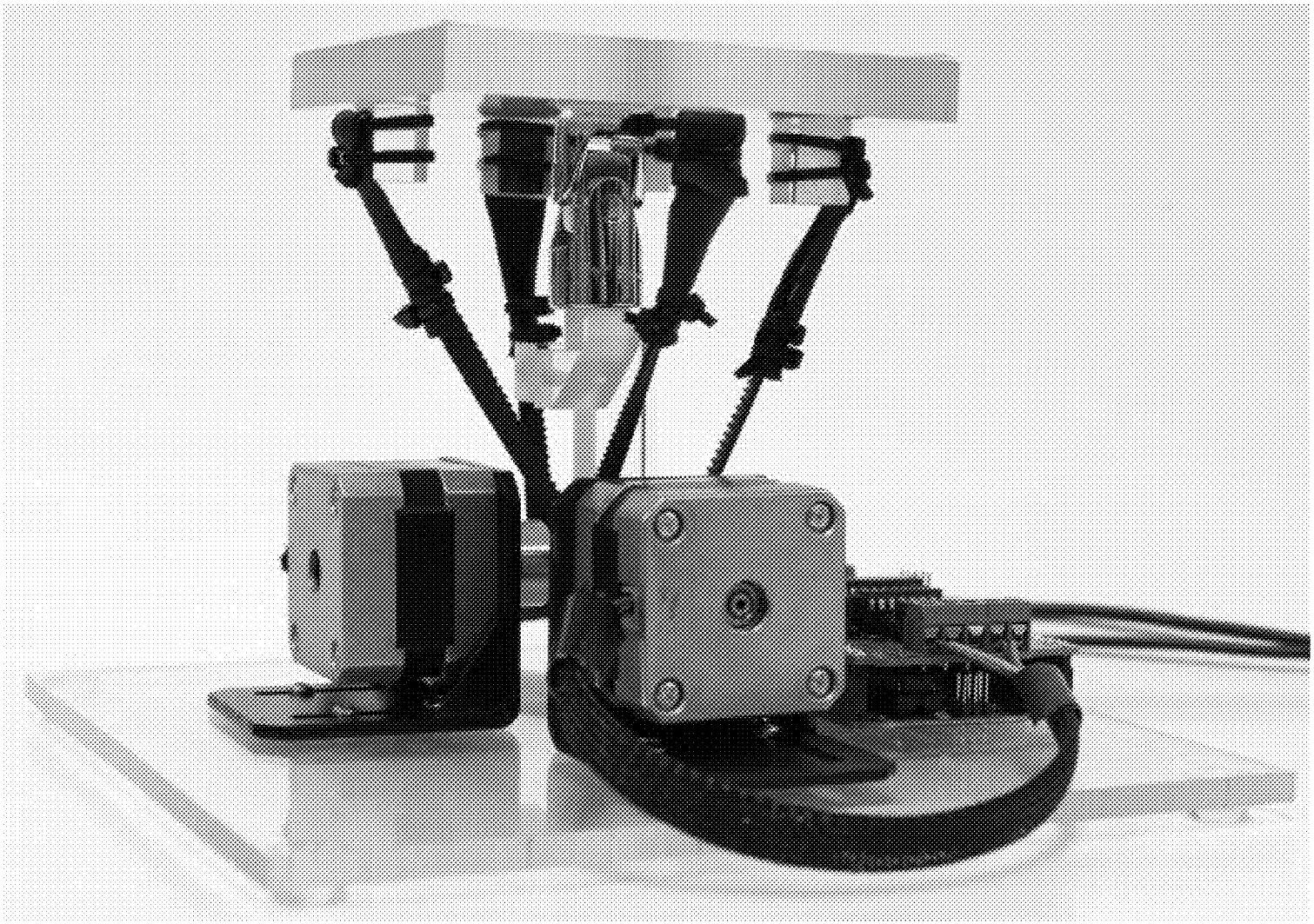
Figures 11, 20:
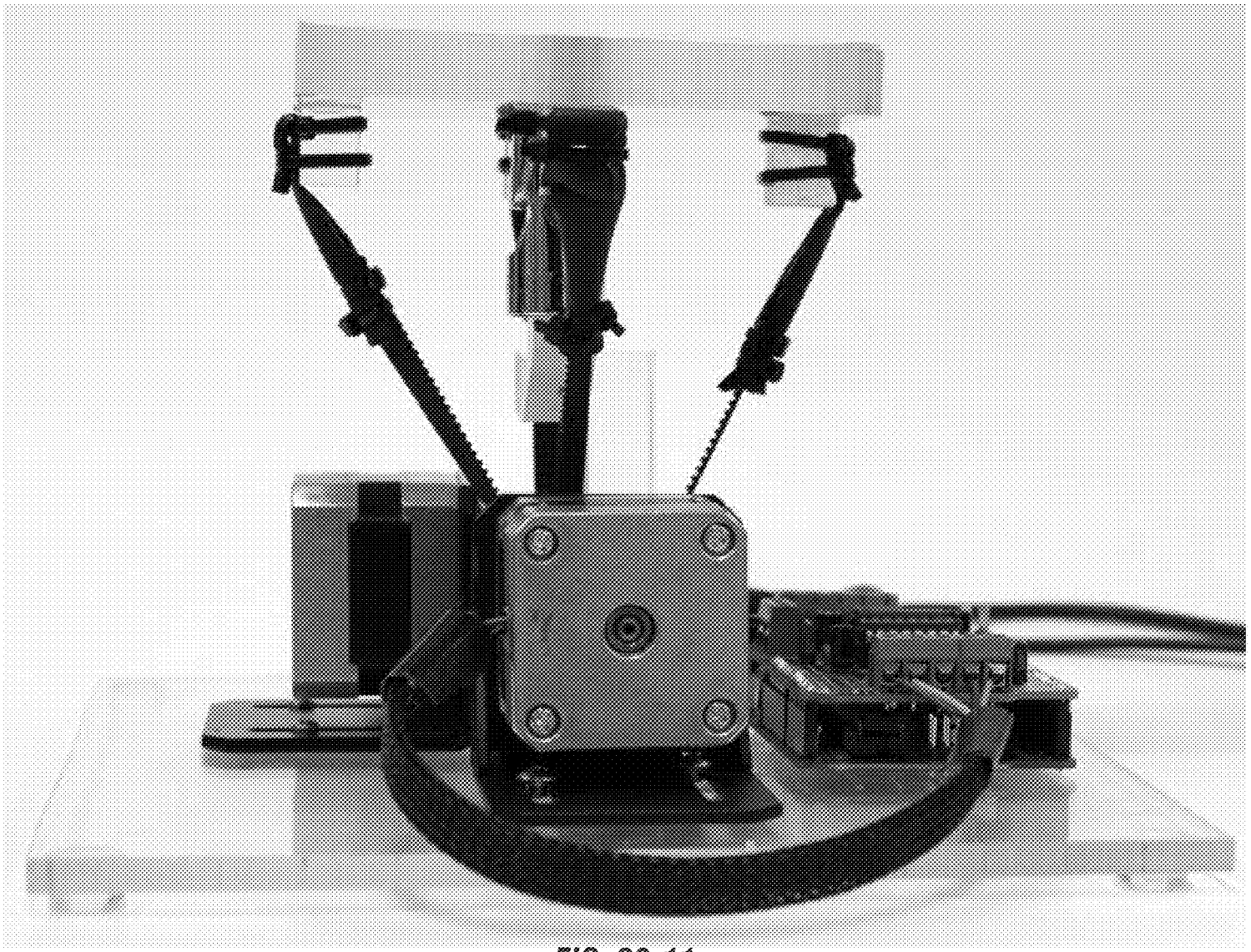
Figures 12, 20:
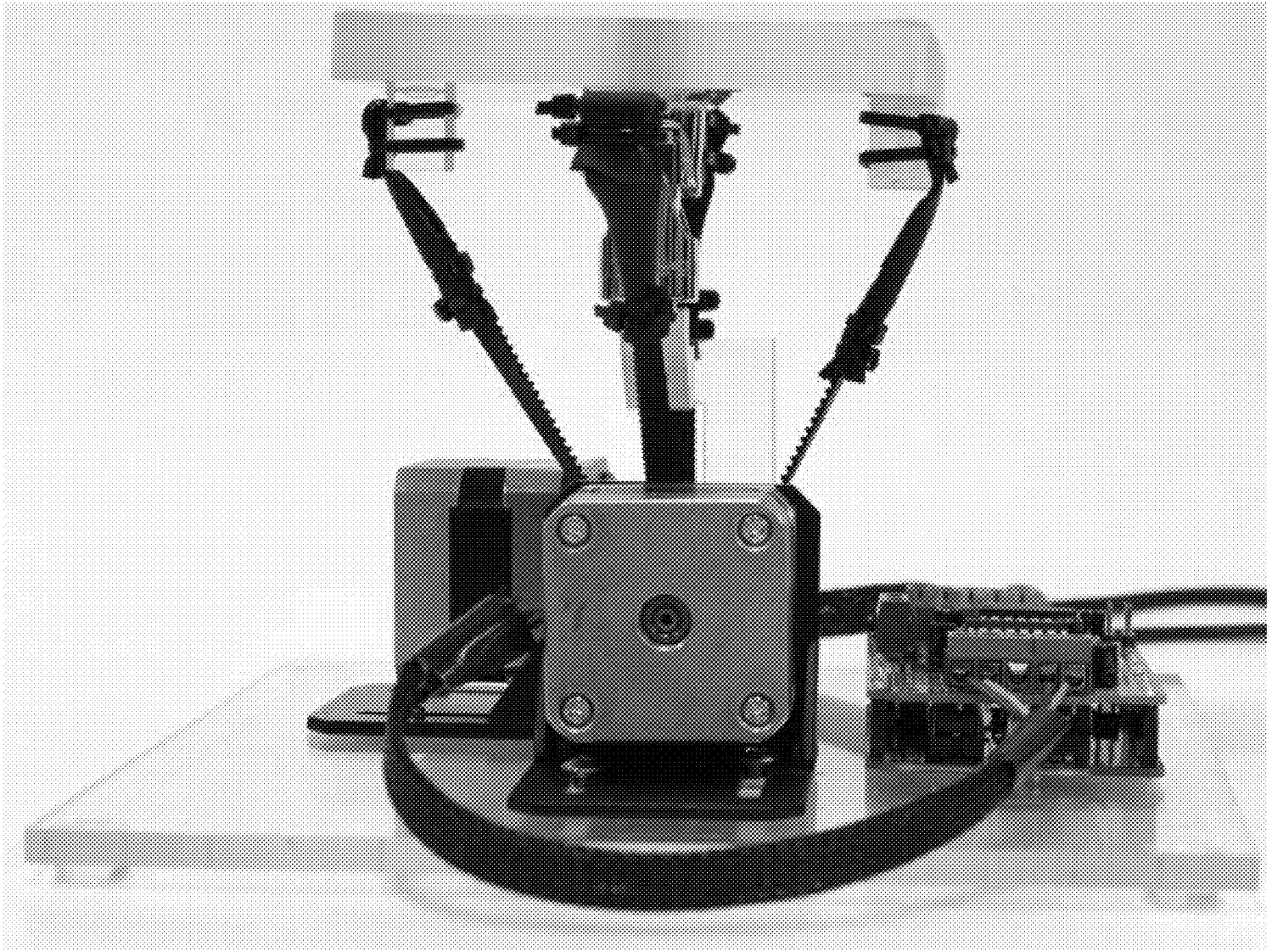
Figures 13, 20:
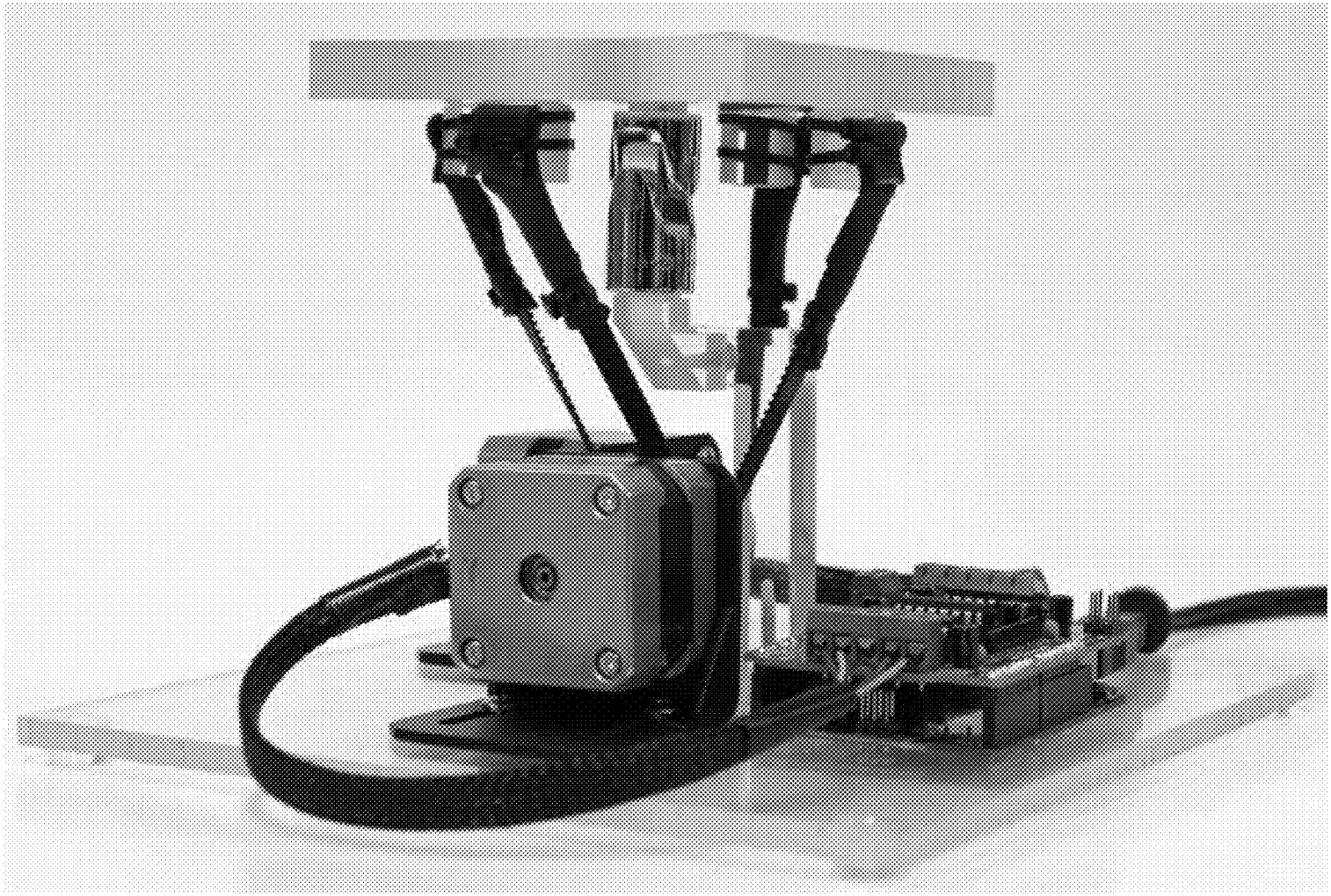
Figures 14, 20:
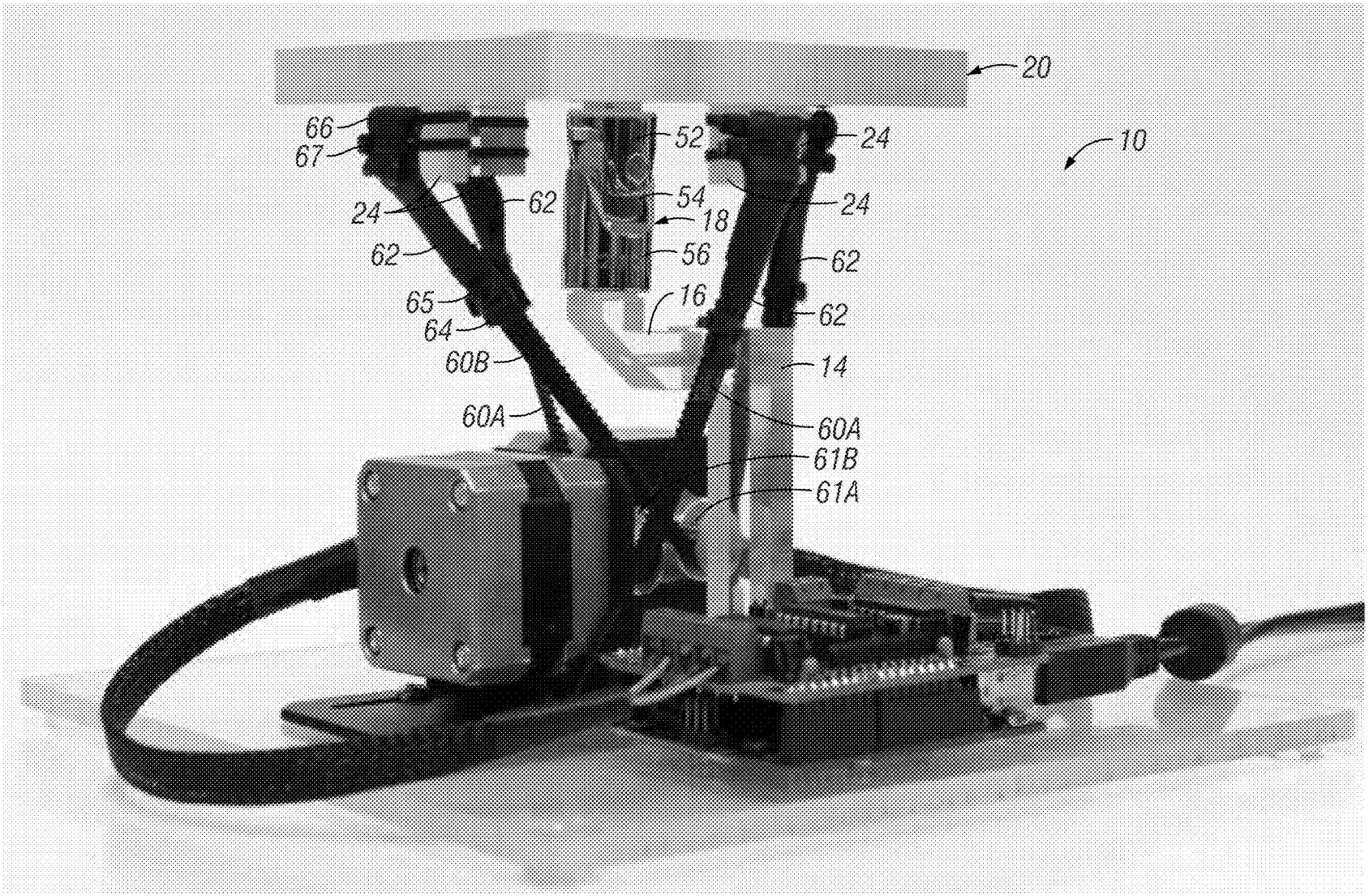
Figures 15, 20:
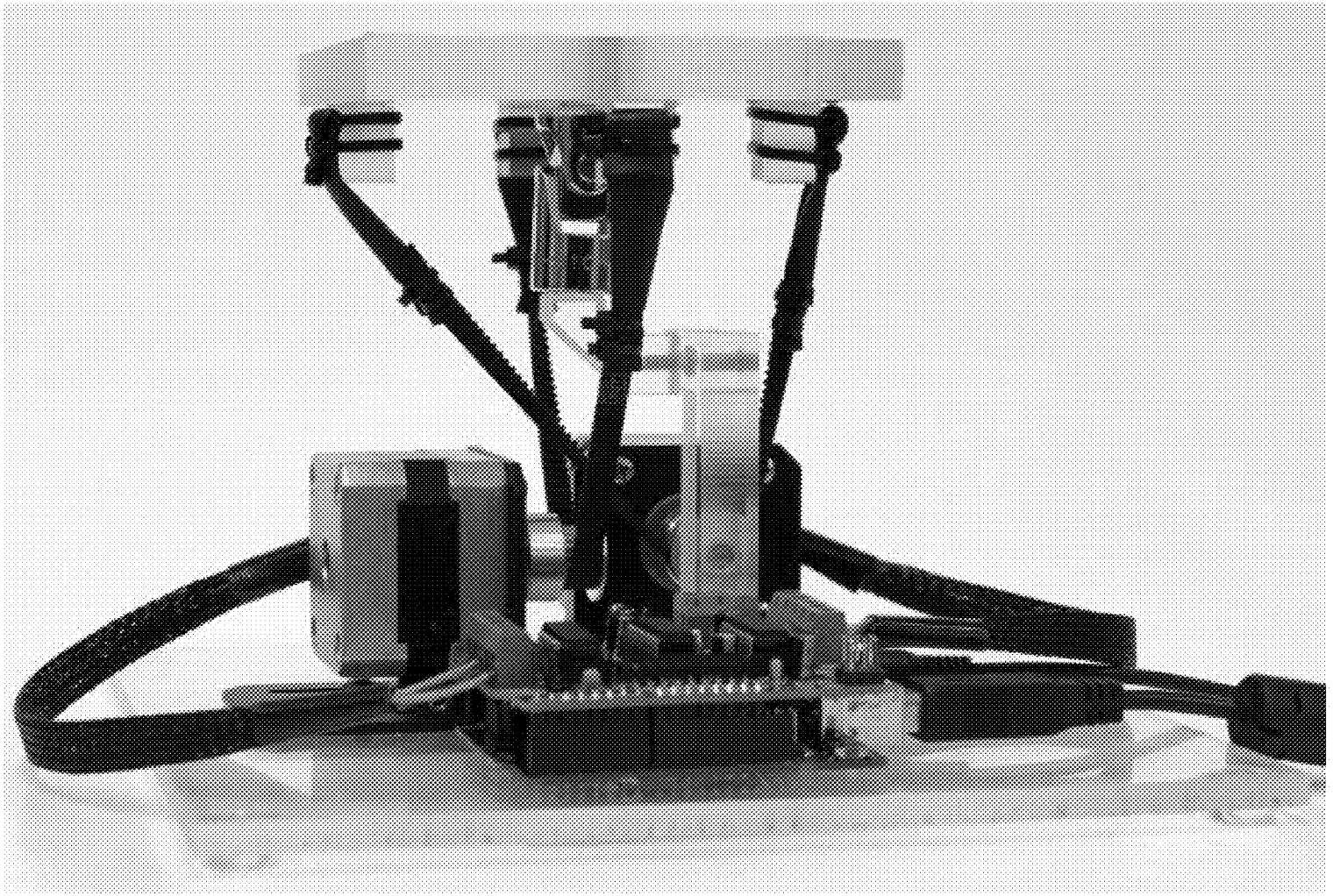
Figures 16, 20:
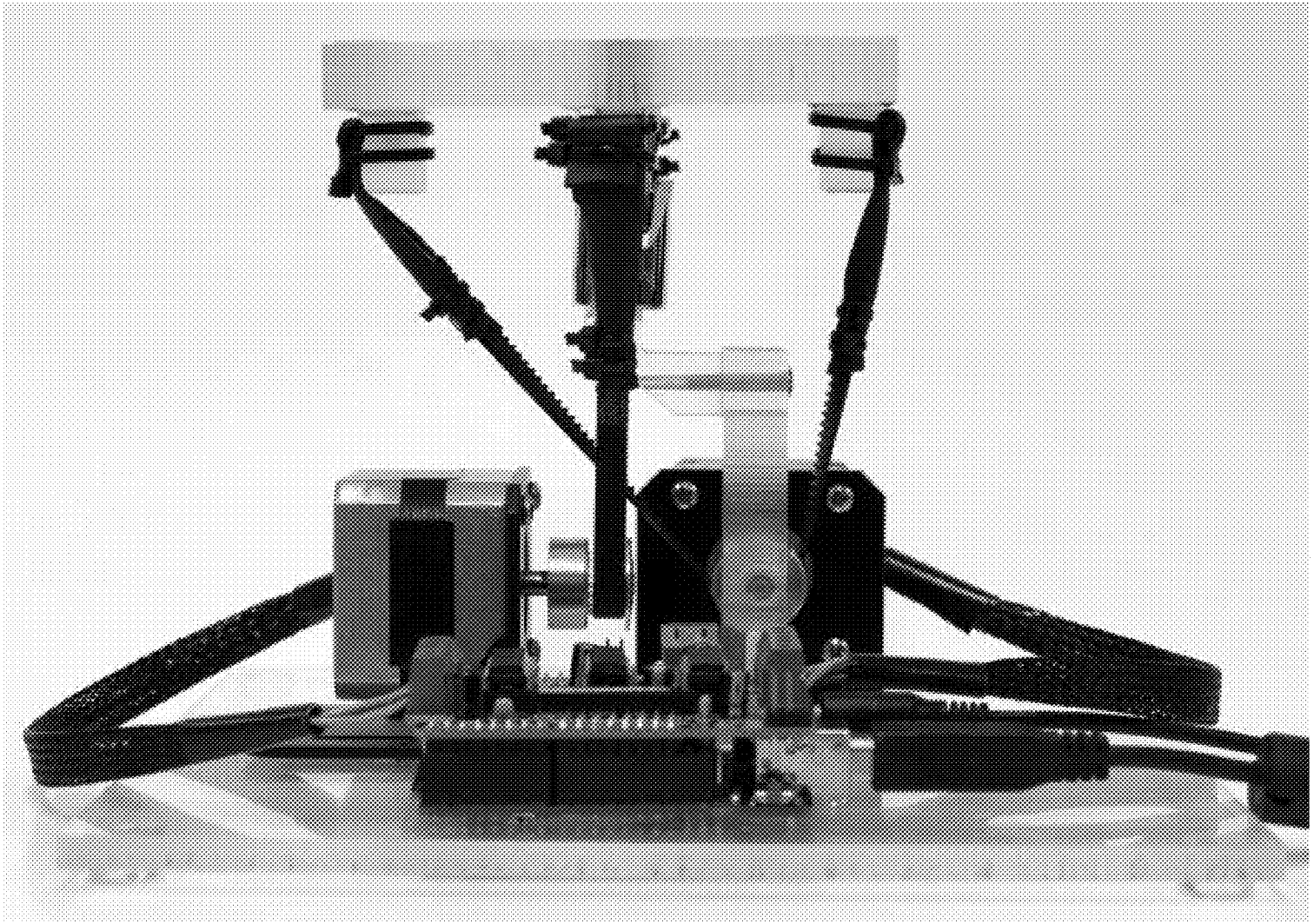
Figures 17, 20:
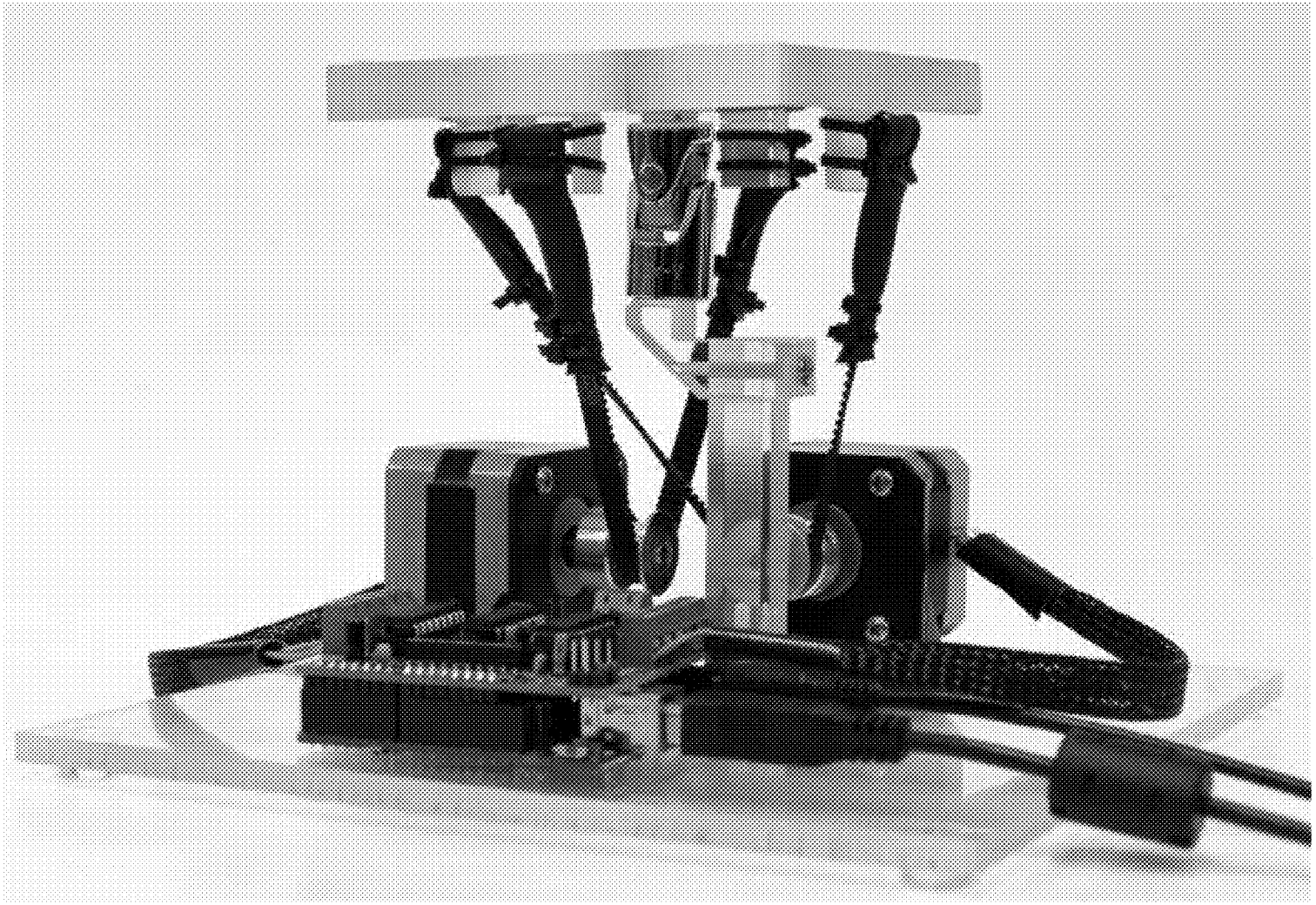
Figures 18, 20:
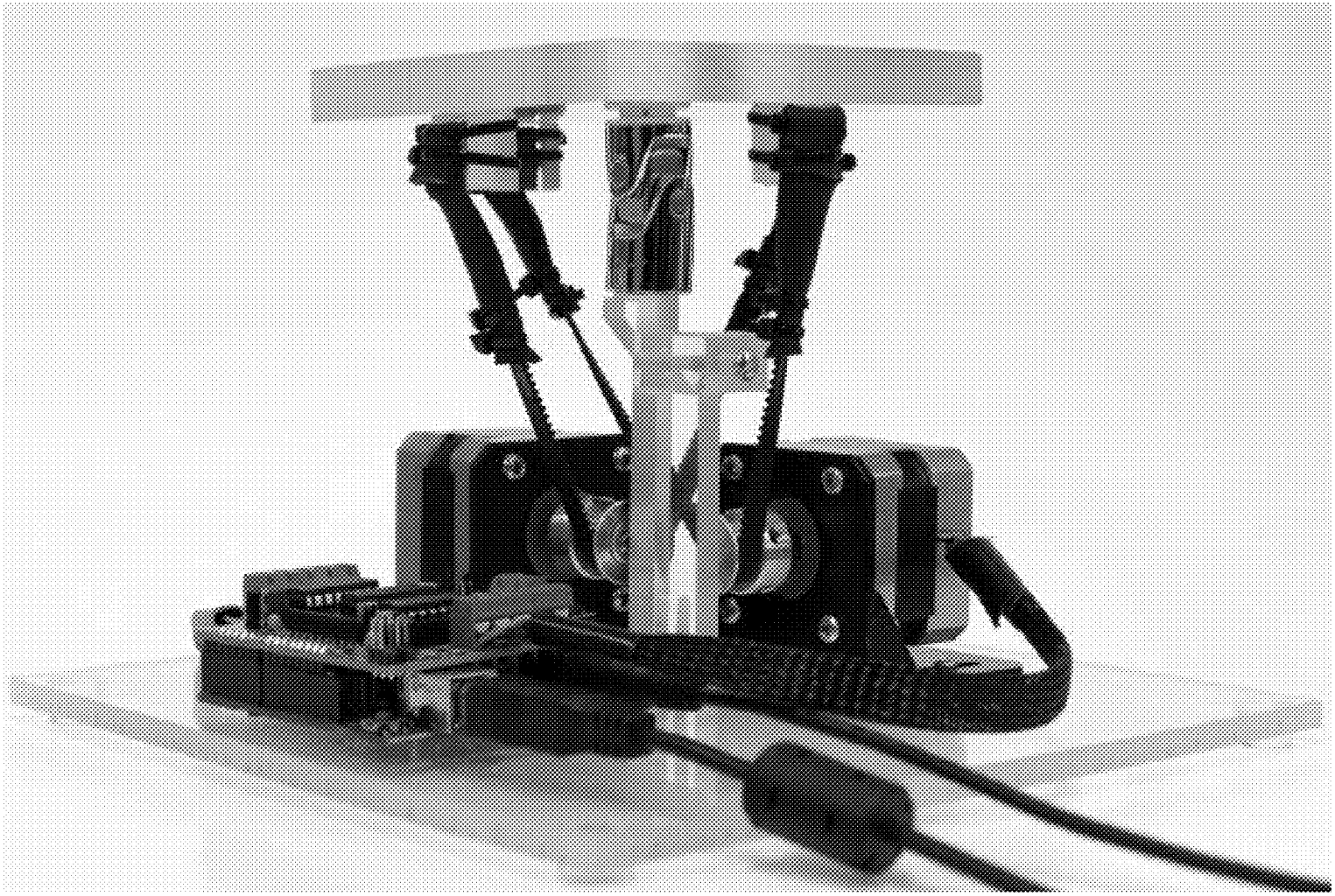
Figures 19, 20:
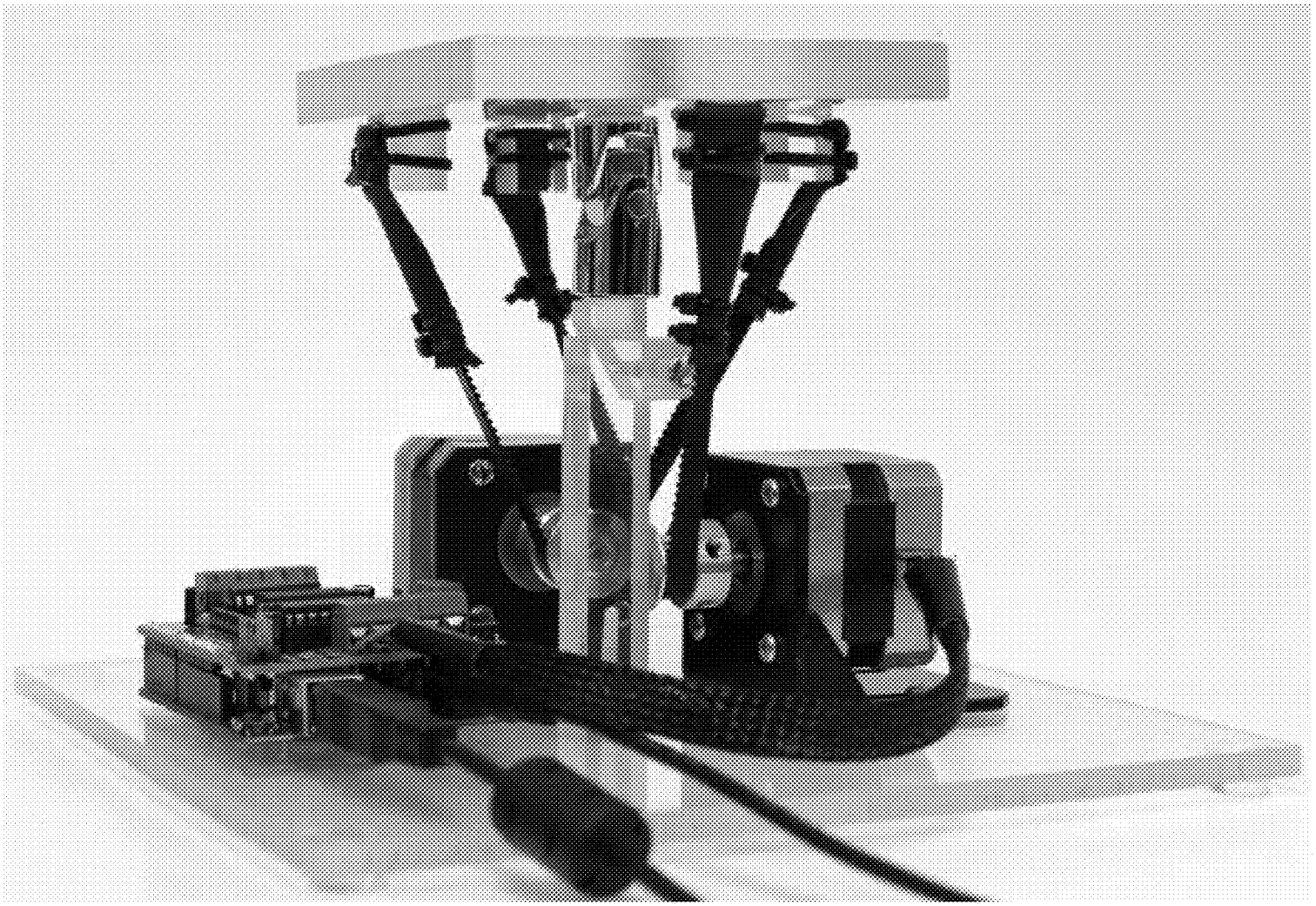
Figure 20:
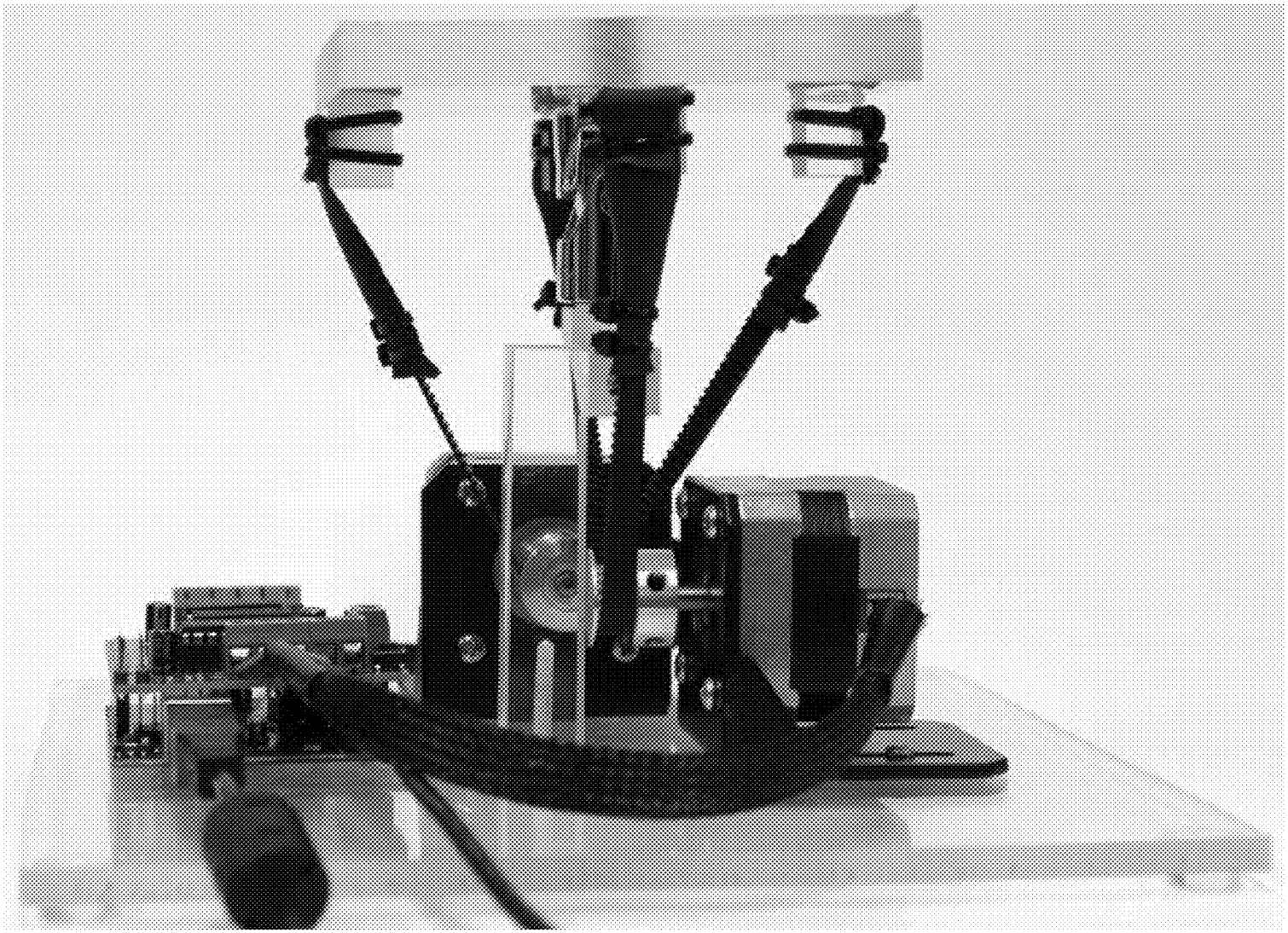
Figures 1, 21:
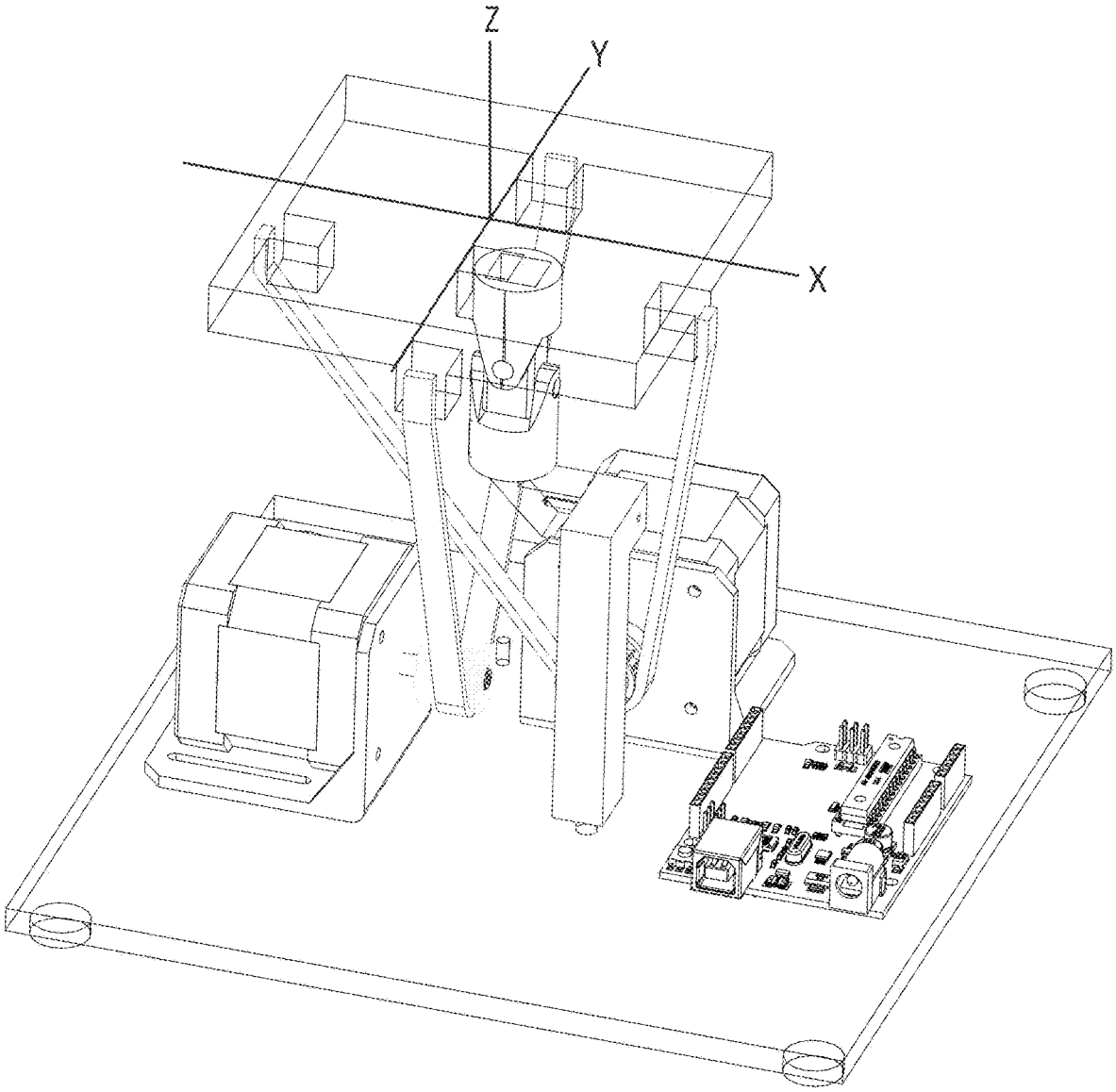
Figures 2, 21:
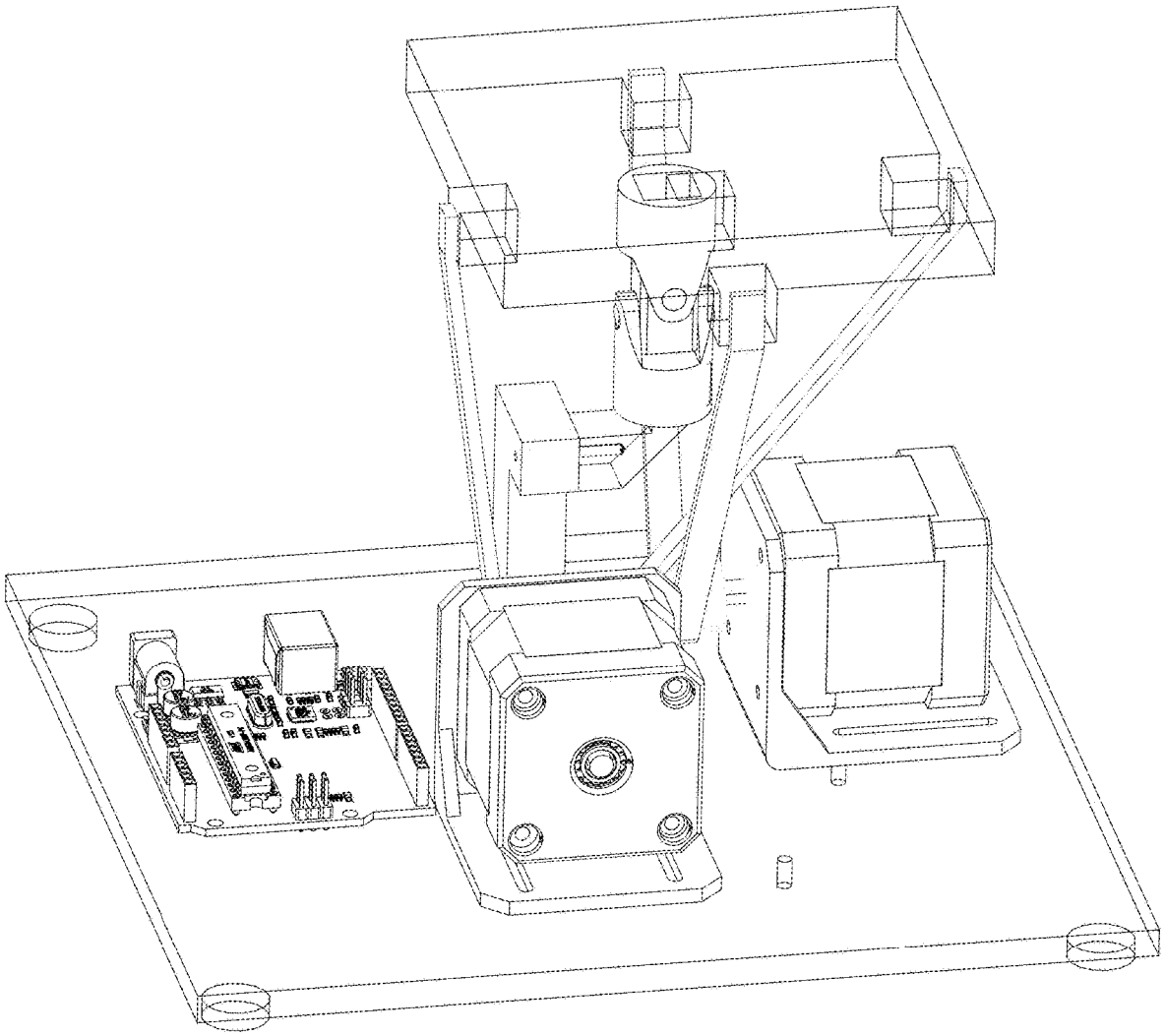
Figures 3, 21:
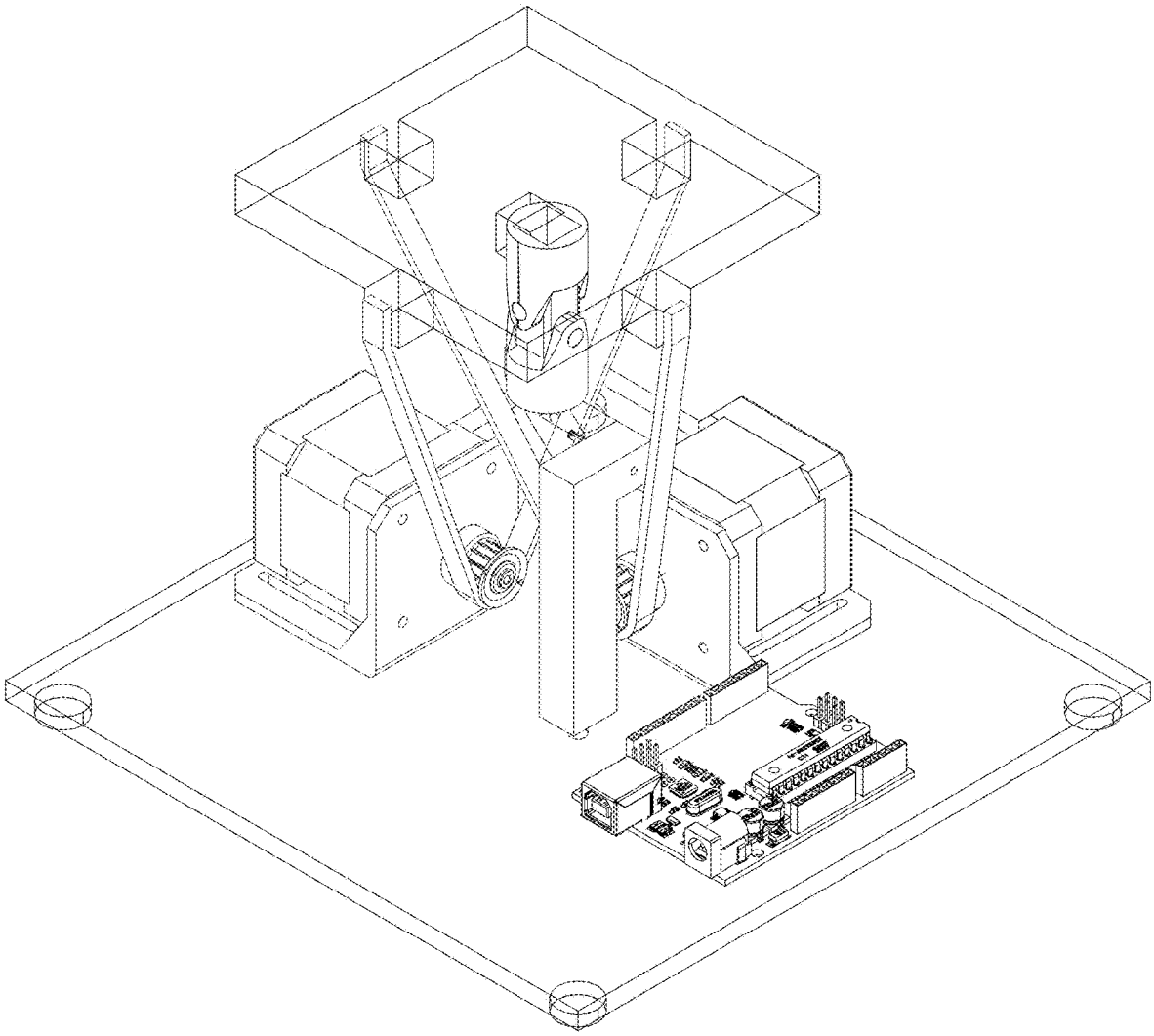
Figures 4, 21:
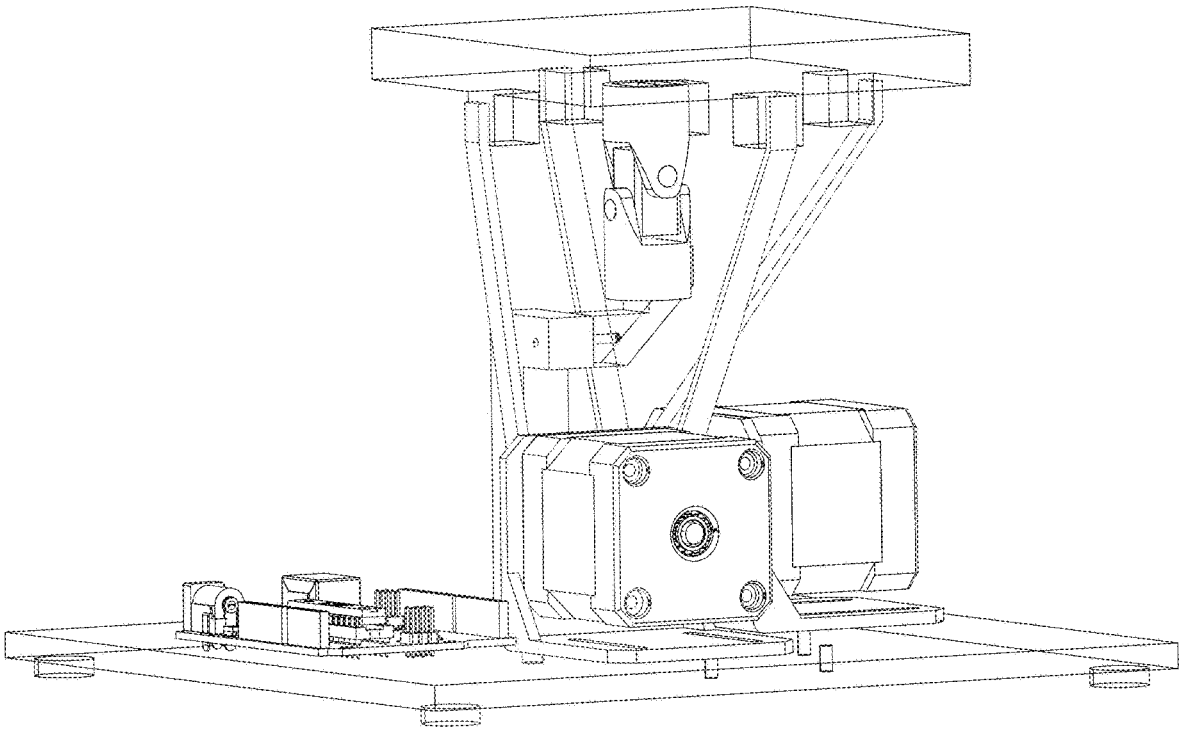
Figures 5, 21:
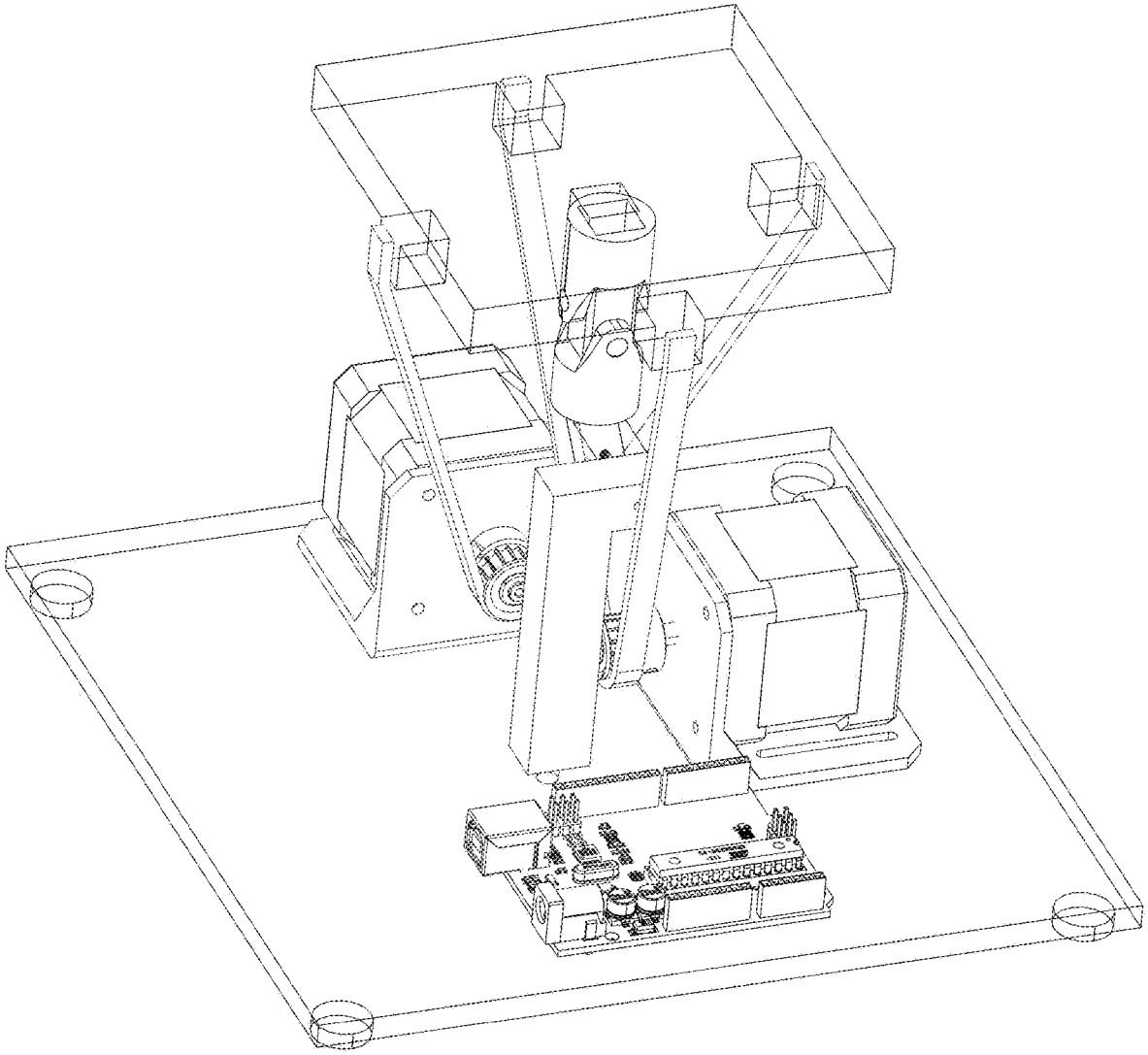
Figures 6, 21:
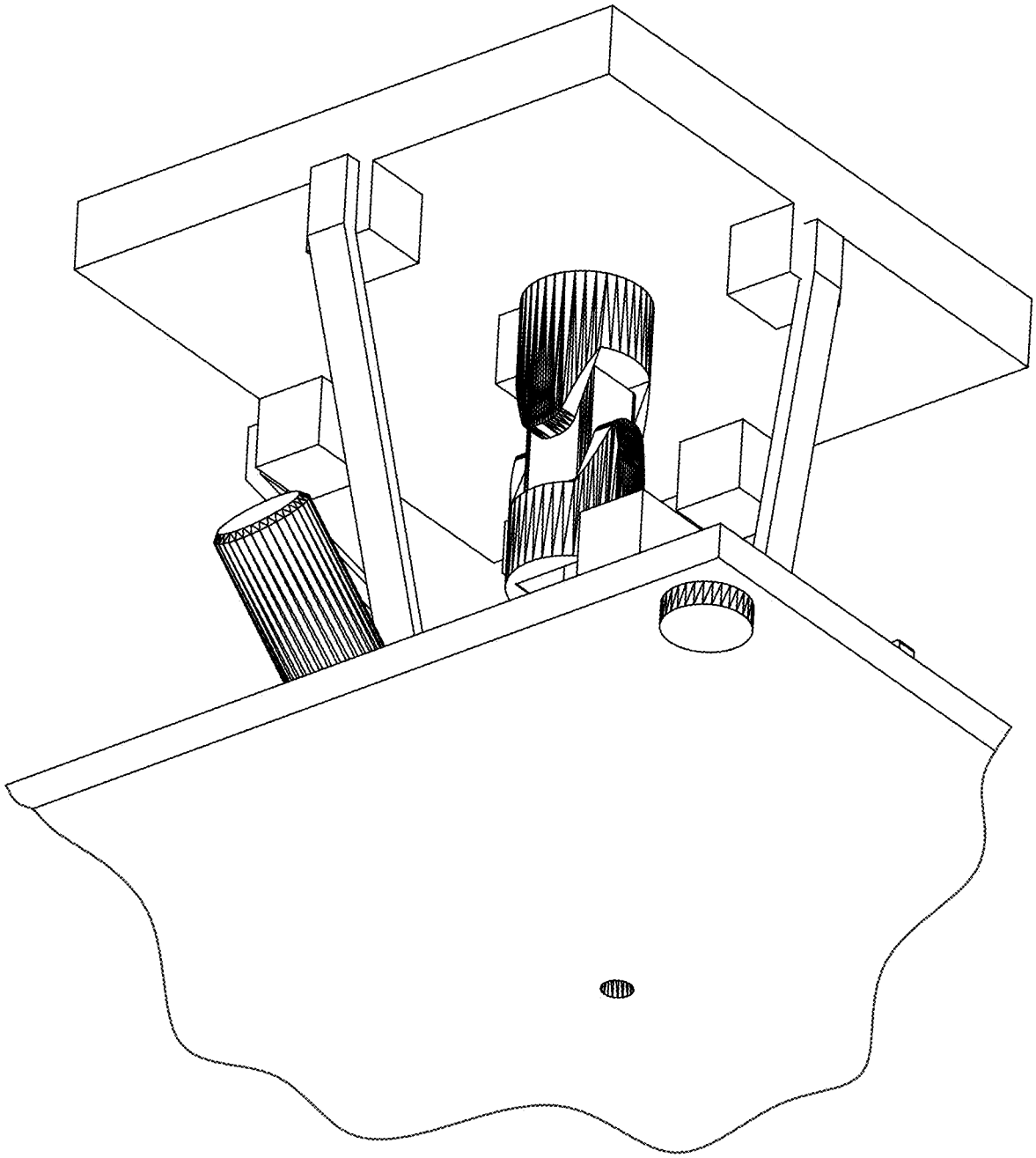
Figures 1, 22:
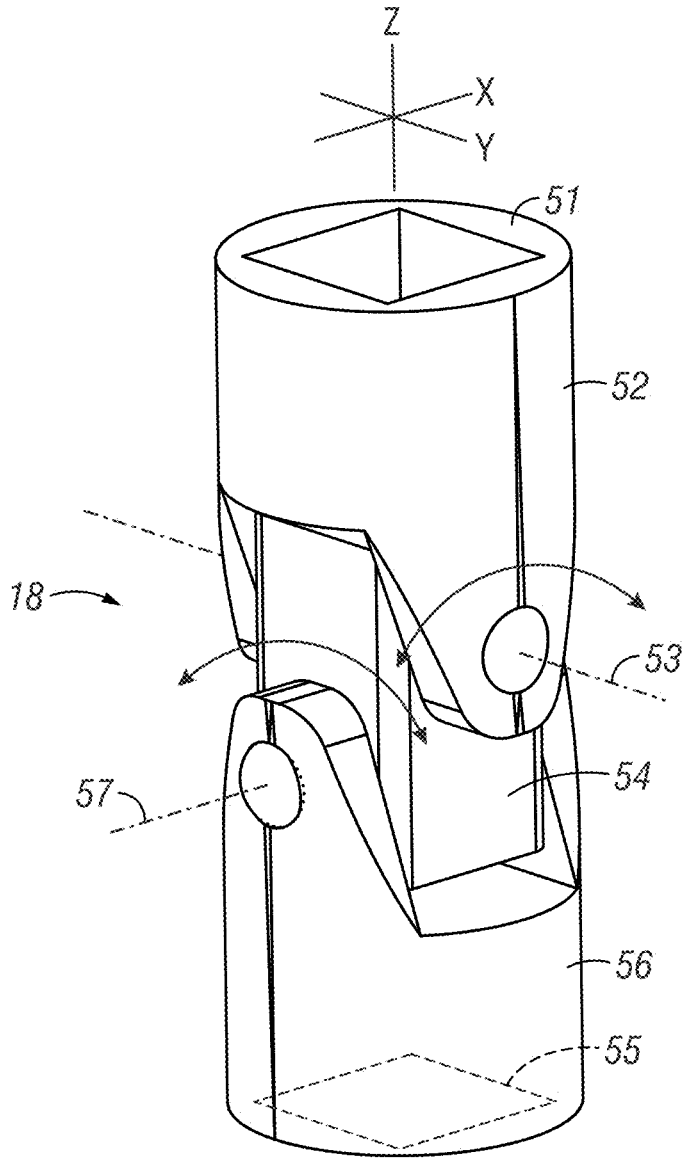
Figures 2, 22:
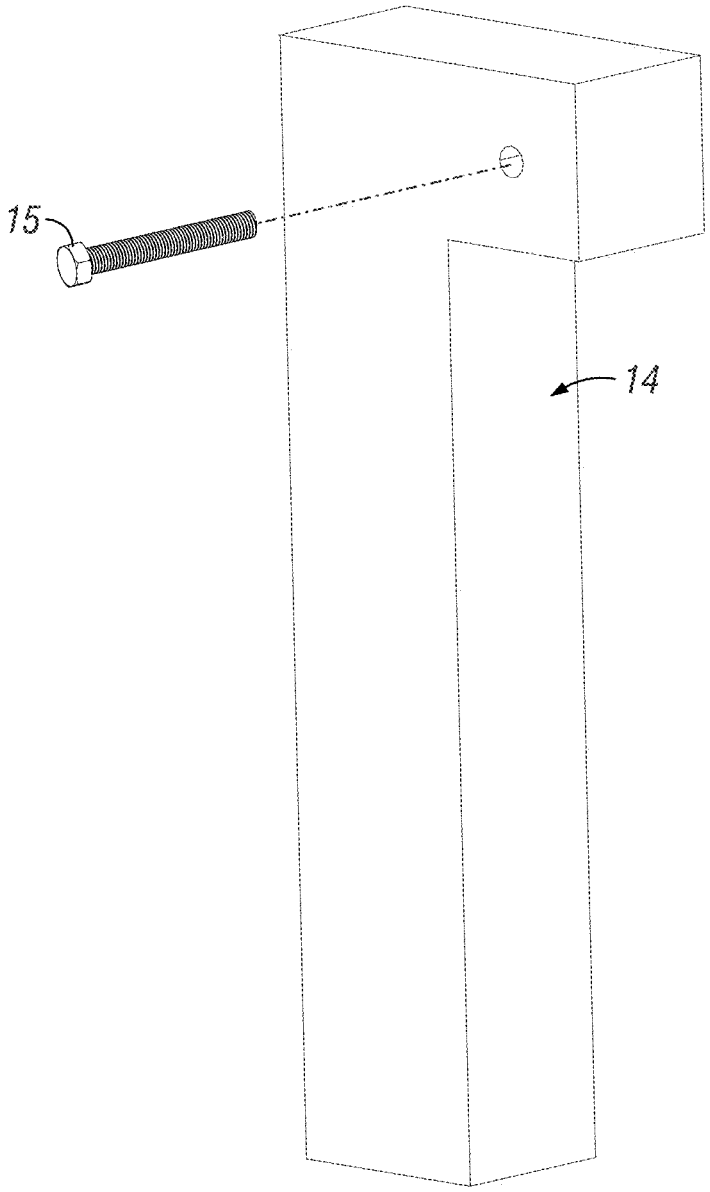
Figures 3, 22:
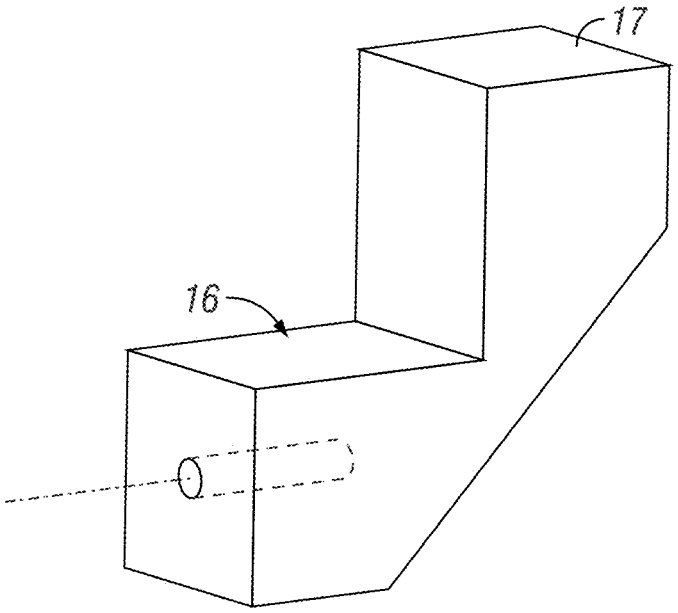
Figures 4, 22:
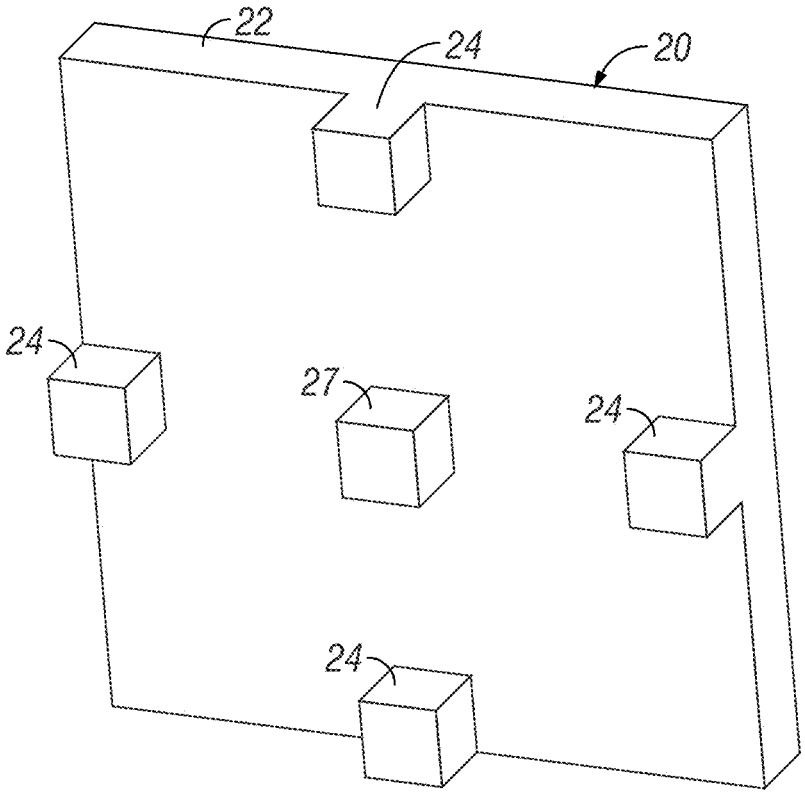
Figures 5, 22:
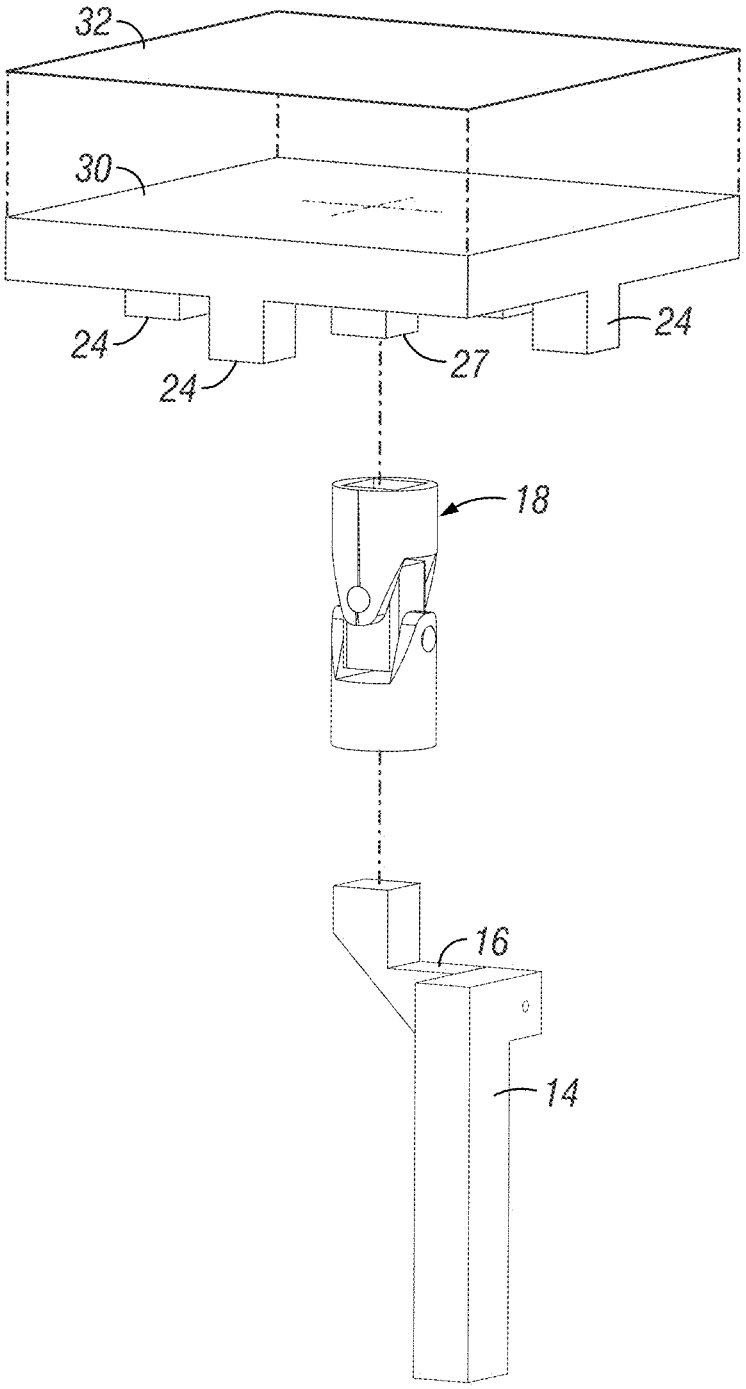
Figure 23:
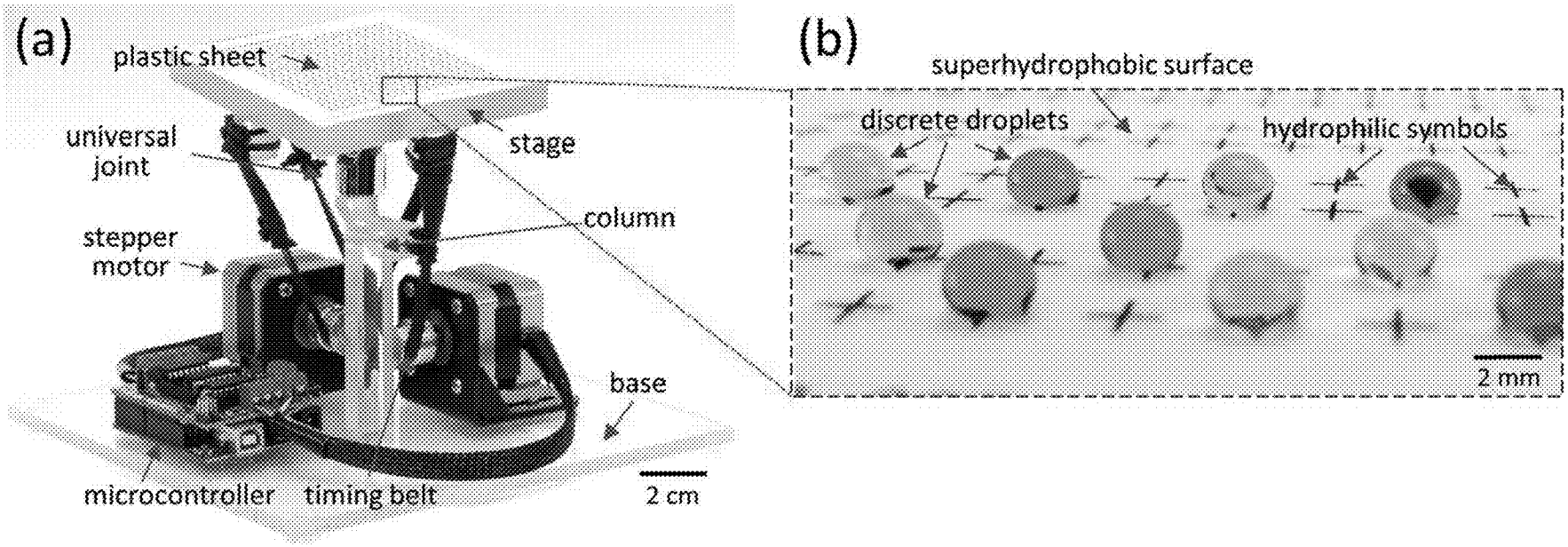
FIG. 23 The droplet actuation system. (a) The system comprises three structural components: base, column, and stage with plastic sheet. The base is physically screwed to the column. A universal joint connects the column to the stage. A microcontroller interfaces with two stepper motors (attached with individual timing belts) and controls the mechanical tilting of the stage. The plastic sheet is taped on the top of the stage. Scale bar=2 cm. (b) A plastic sheet is spray-coated with a superhydrophobic chemical and printed with hydrophilic symbols using an inkjet printer. The image shows discrete droplets, each coloured with food dyes for visual illustration, resting on the hydrophilic symbols. Scale bar=2 mm.
Figure 24:
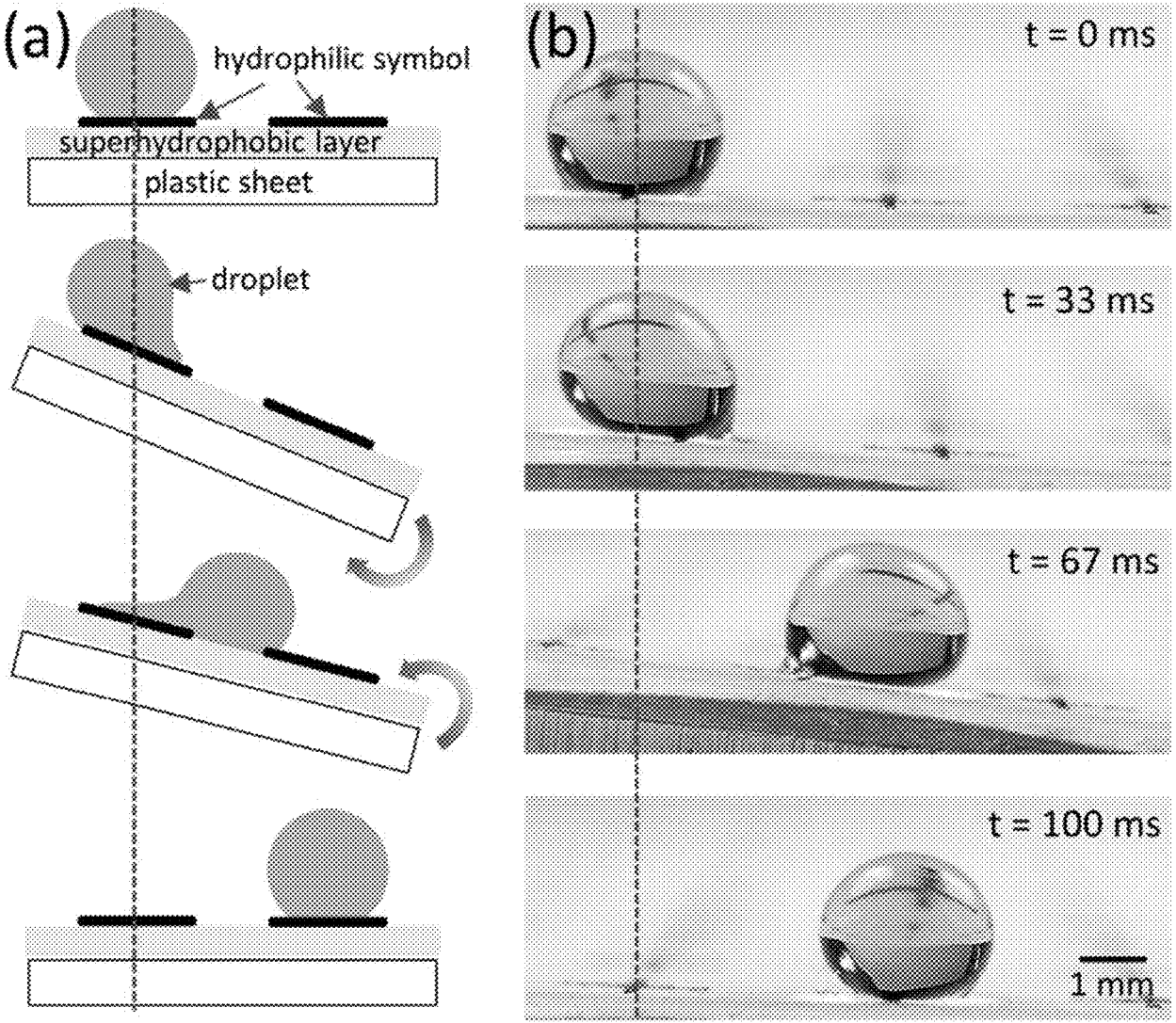
FIG. 24 Transport mechanism of a single droplet. (a) In the cartoon, a droplet is initially positioned on the left hydrophilic symbol printed on the superhydrophobic surface of a plastic sheet. The stage is tilted clockwise and then anticlockwise to return to its default horizontal position (depicted by red block arrows). This rapid tilting action enables the droplet to move to the right hydrophilic symbol. (b) Timelapsed images of an actual droplet show how the droplet is transported from the left symbol to the right symbol by the tilting action of the stage. The vertical dotted lines represents the starting position of the droplet. Scale bar=1 mm.
Figure 25:
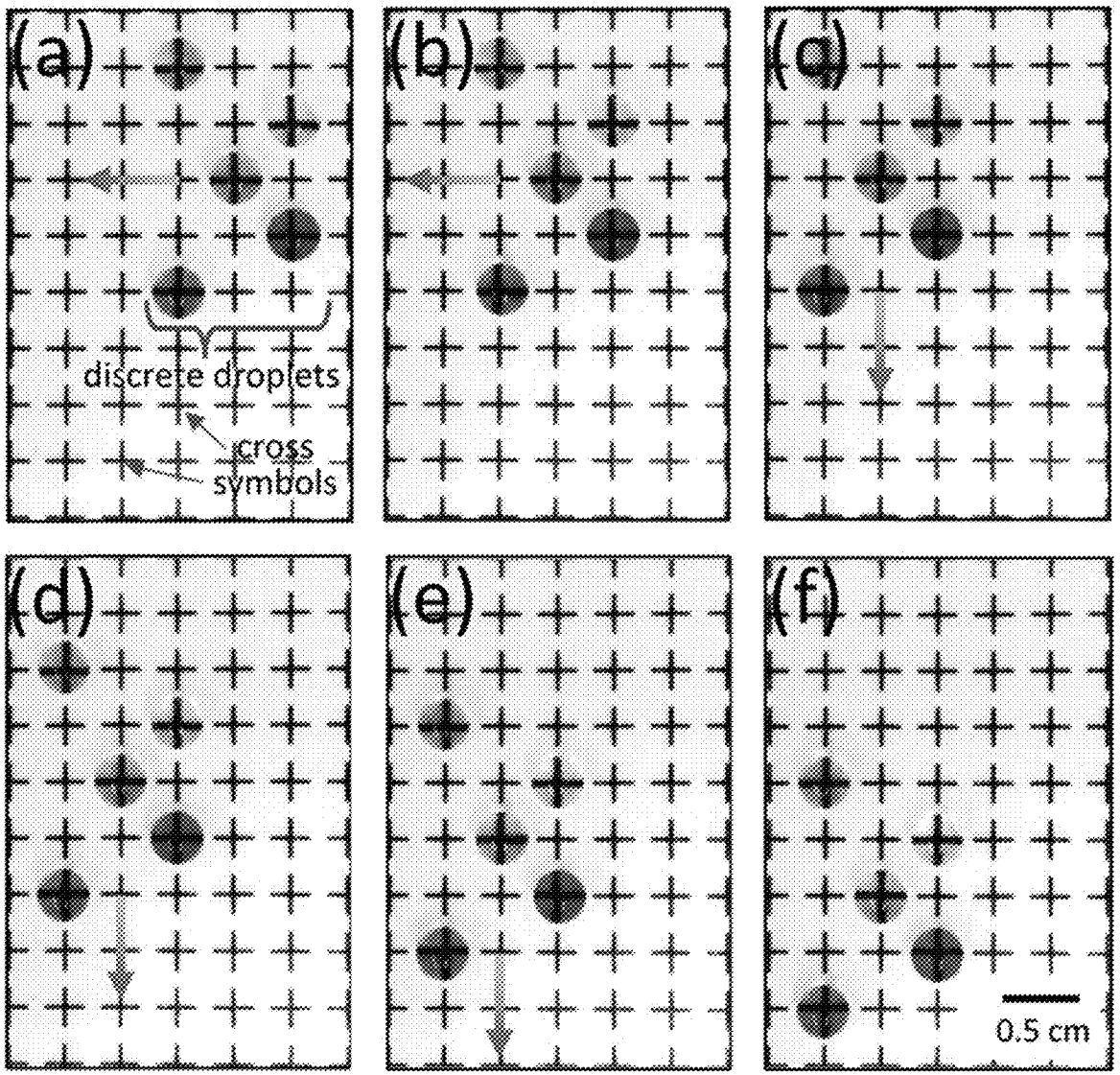
FIG. 25 Transport of multiple droplets: a series of images are taken to illustrate the movement of multiple droplets on an arrangement of plus symbols. The volume of each droplet is 10 μL and they are uniquely coloured with a food dye for visual illustration. The motor speed is 100 r.p.m. and the number of steps is 14. The direction of tilting the stage at every step is denoted by a red arrow. The stage is rapidly tilted twice in left direction (a, b) and three times in the downward direction (c-e). The final positions of all droplets are shown in (f). This demonstration shows that multiple droplets can be simultaneously moved in the same direction without any risk of cross-contamination. Scale bar=0.5 cm.
Figure 26:
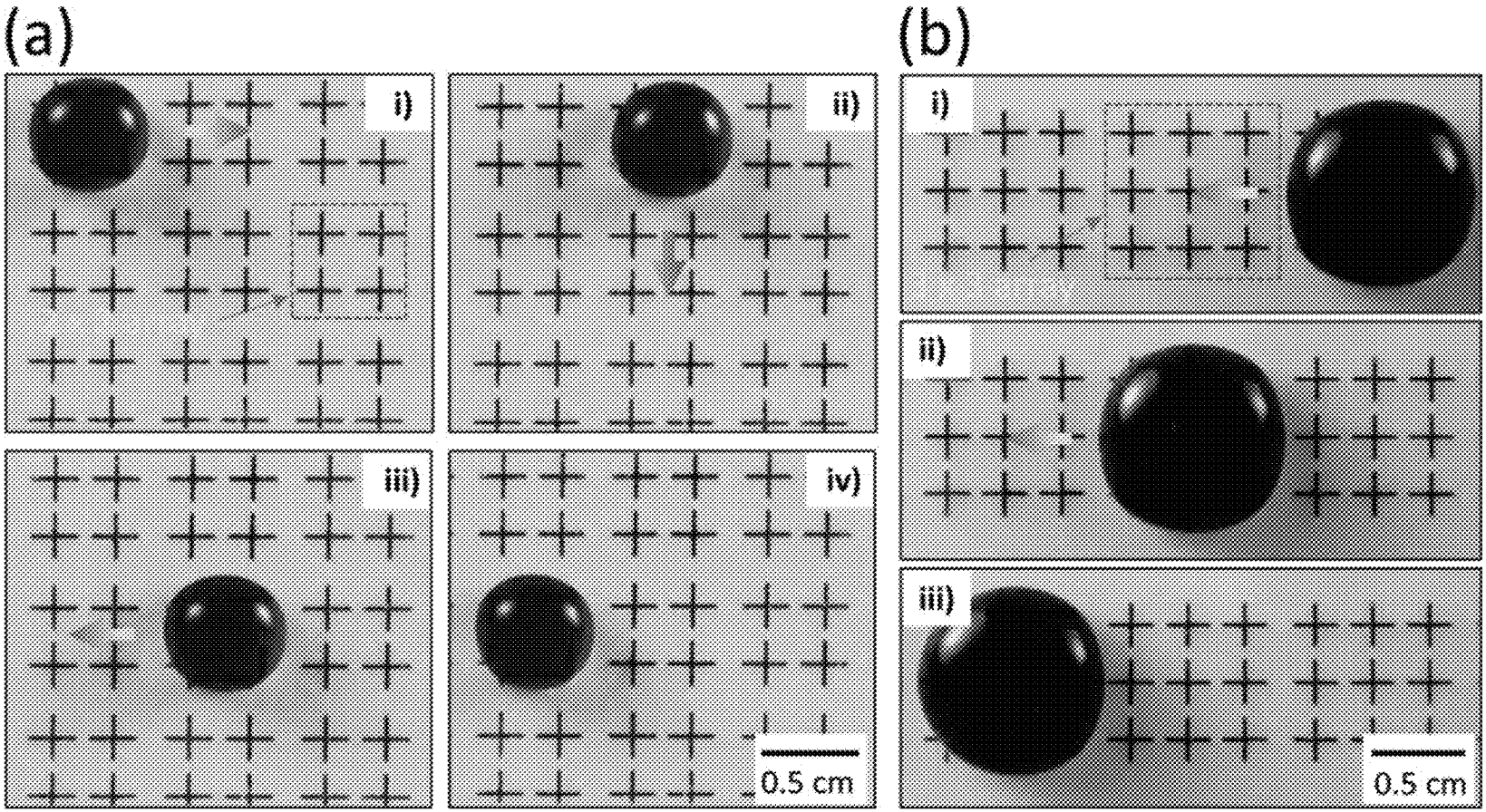
FIG. 26 Transport of large droplets: (a) a large blue droplet (volume=80 μL) is moved using a 2×2 array of plus symbols (line width is 0.0178 cm, line length is 0.24 cm, and inter-array spacing is 0.68 cm). Compared to FIG. 3 where 10 μL droplets were moved, here the motor speed is decreased and the number of steps is increased (80 r.p.m., 20 steps) to move the 80 μL droplet. (b) A large green droplet (volume=300 μL) is being transported to the neighbouring pattern using a 3×3 array of plus symbols. As in (a), the motor speed is decreased and the number of steps is increased (60 r.p.m., 25 steps) compared to those in FIG. 3. By using the same scheme and adjusting the parameters of stepper motors, up to 1 mL droplets have been transported. Scale bar=0.5 cm.
Figure 27:
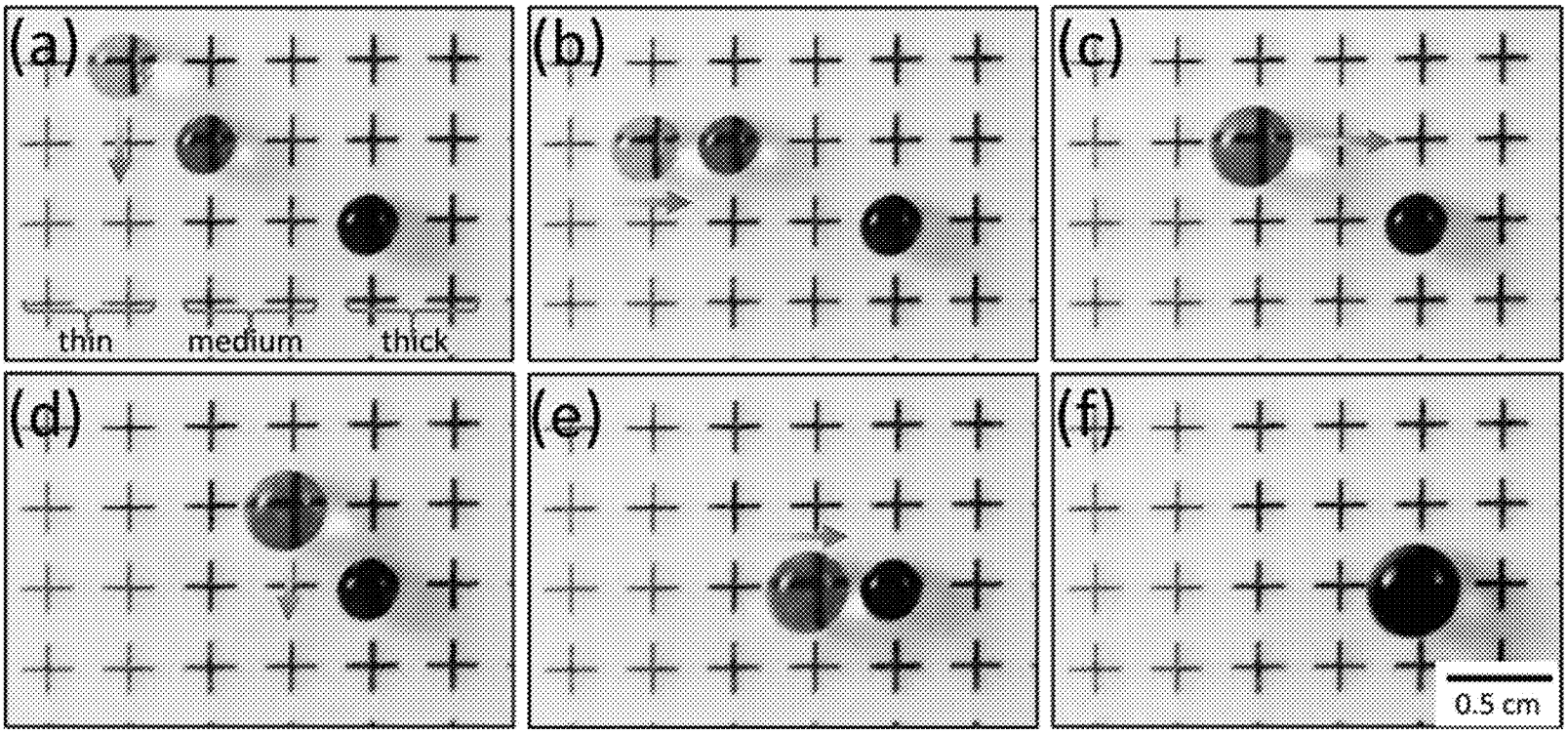
FIG. 27 Merging and mixing of multiple droplets. (a) A two-dimensional arrangement of plus symbols is shown where the line width is thinnest in the left two columns, medium thickness in the middle two columns, and thickest in the right two columns. Three droplets (yellow, red, and blue) are placed on the plus symbols. The red arrow indicates the direction of tilting the stage and the stage is tilted in the following sequence: downwards, right, right, downwards, and right. The yellow droplet is moved to and merged with the red droplet (a-c). This merged droplet is now moved and merged with the blue droplet (d-e) and the final product after merging all droplets is shown in (f). After the merging step, the stage can be agitated to mix the combined droplets. Scale bar=0.5 cm.
Figure 28:
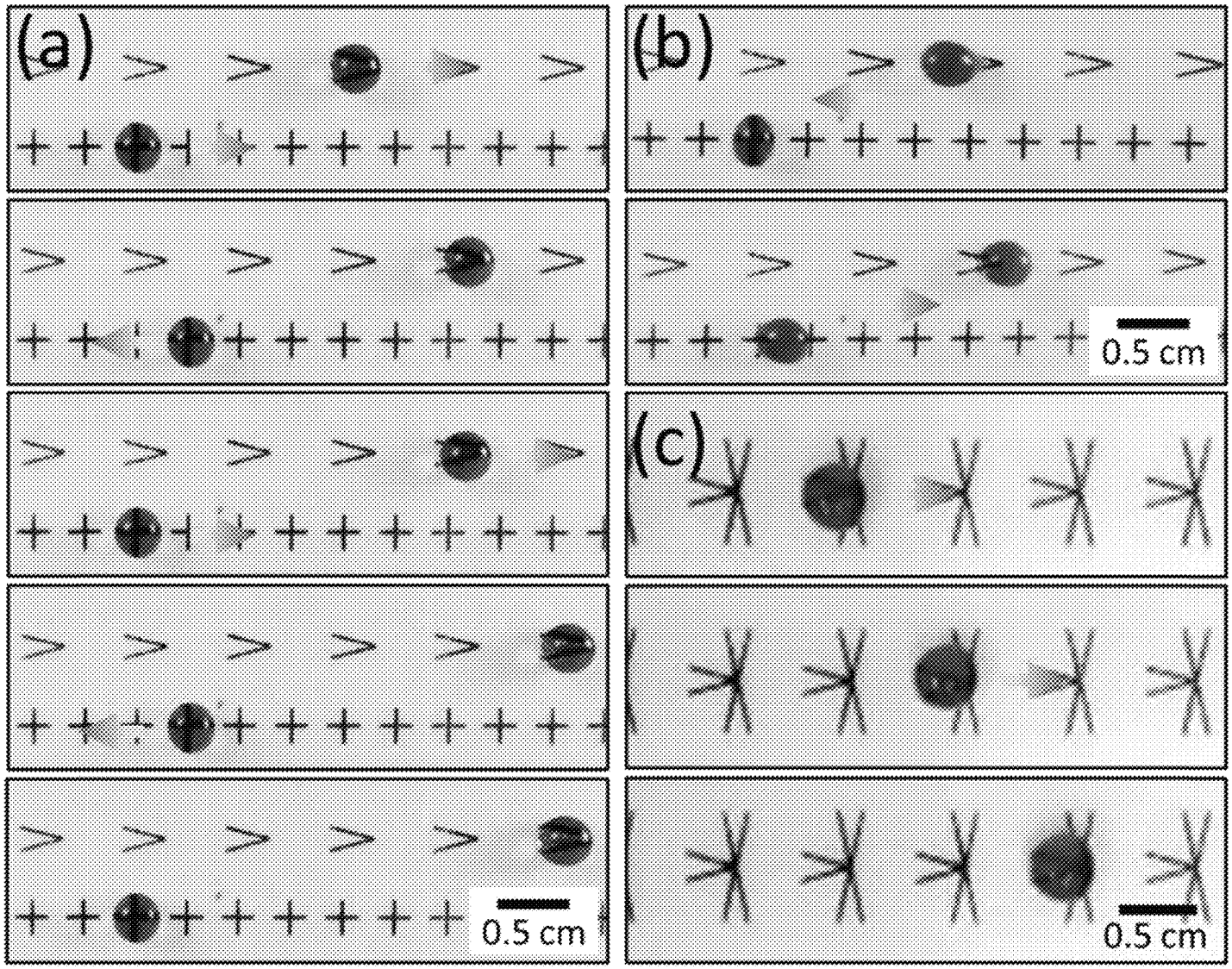
FIG. 28 (*a*) Each droplet is placed on two different symbols (plus and greater-than sign). The droplet on the plus symbol moves to the left when rapidly tilted to the left, but the droplet on the greater-than symbol does not move. When the substrate rapidly tilts to the right, both droplets on the plus symbol and the greater-than symbol move to the right. The acute point of the greater-than symbol has less hydrophilic area to attract the droplet. (b) Slow motion images showing different configurations of the droplet when the stage rapidly tilts to the left and right directions. When the stage tilts left, the two diagonal lines attached to the large area of the droplet prevent it from moving to next symbol. When the stage tilts right, a sharp point (where two diagonal lines meet) attaches to a small area of the droplet and the droplet is released to the next symbol. (c) One directional movement: the droplet only moves to the right due to the pattern of three converging greater-than symbols pointing to the center. Scale bar=0.5 cm.
Figure 29:
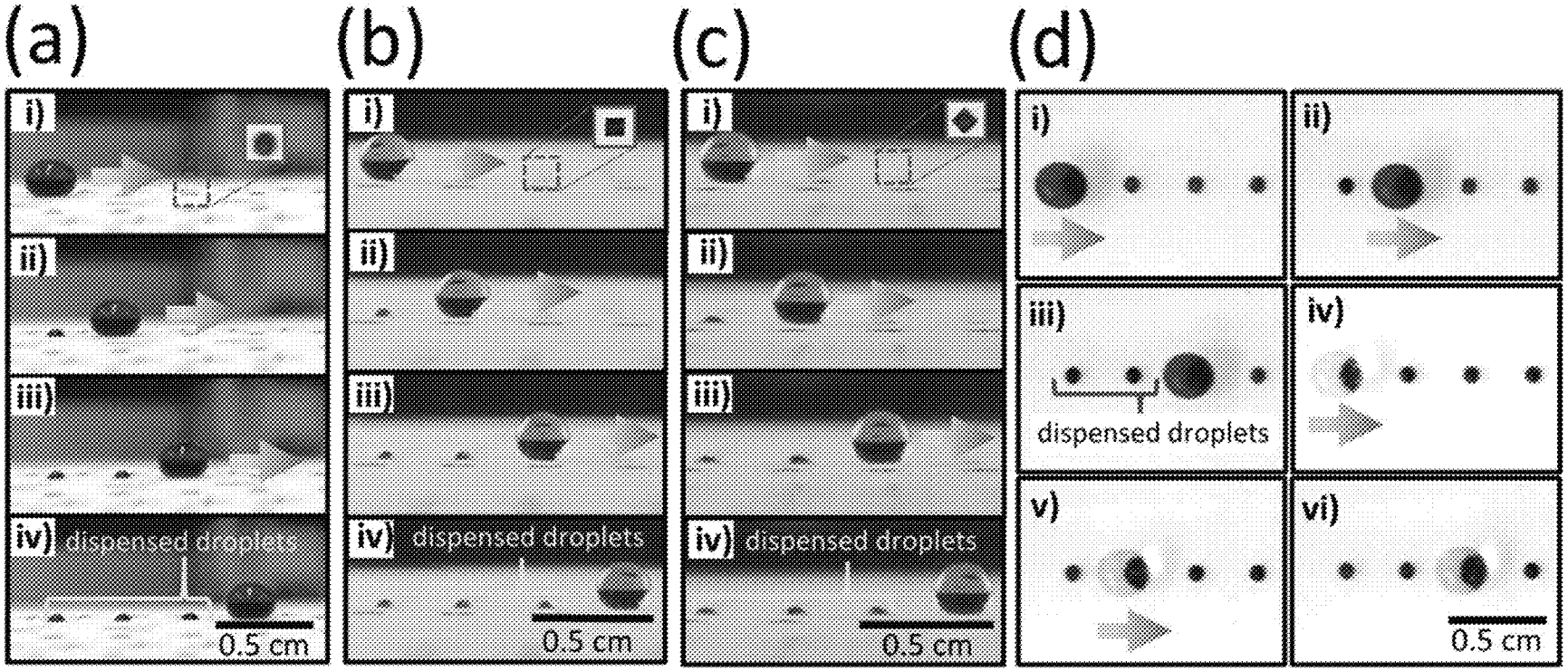
FIG. 29 Droplet dispensing from a large droplet (volume=10 μL): (a) A small red droplet is dispensed on each circular dot hydrophilic symbol. While a large droplet moves over the hydrophilic dots, each symbol attracts the droplet and a small volume is left on each symbol. (b) Small red droplets are dispensed on rectangular-shaped hydrophilic symbols. (c) Small red droplets are dispensed on diamond-shaped hydrophilic symbol. (d) After the dispensing operation on circular dot symbols, a clear water droplet is transported across the dot symbols, causing the red colour intensity to increase in the clear droplet. Scale bar=0.5 cm.
Figure 30:
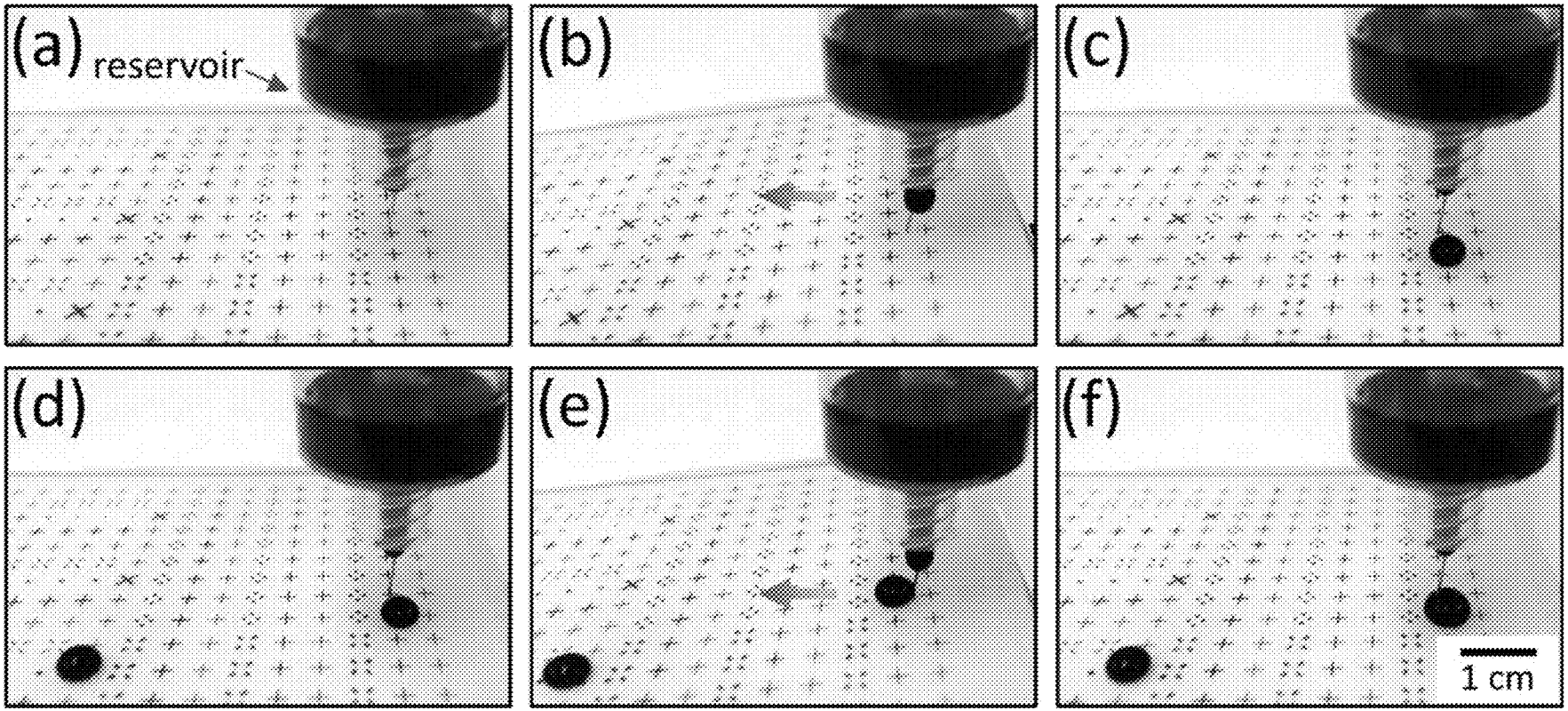
FIG. 30 Dispensing droplets from an external reservoir: (a) the reservoir is placed along the edge of the stage. (b) A dispenser tip is pressed by tilting the stage. (c) While the tip is pushed up, liquid flows out through the opened entrance of the reservoir. (d) A dispensed droplet is transported to another symbol and the next droplet is dispensed. (e, f) By tilting the stage twice, a larger droplet is dispensed in the same location. Scale bar=1 cm.
Figure 31:
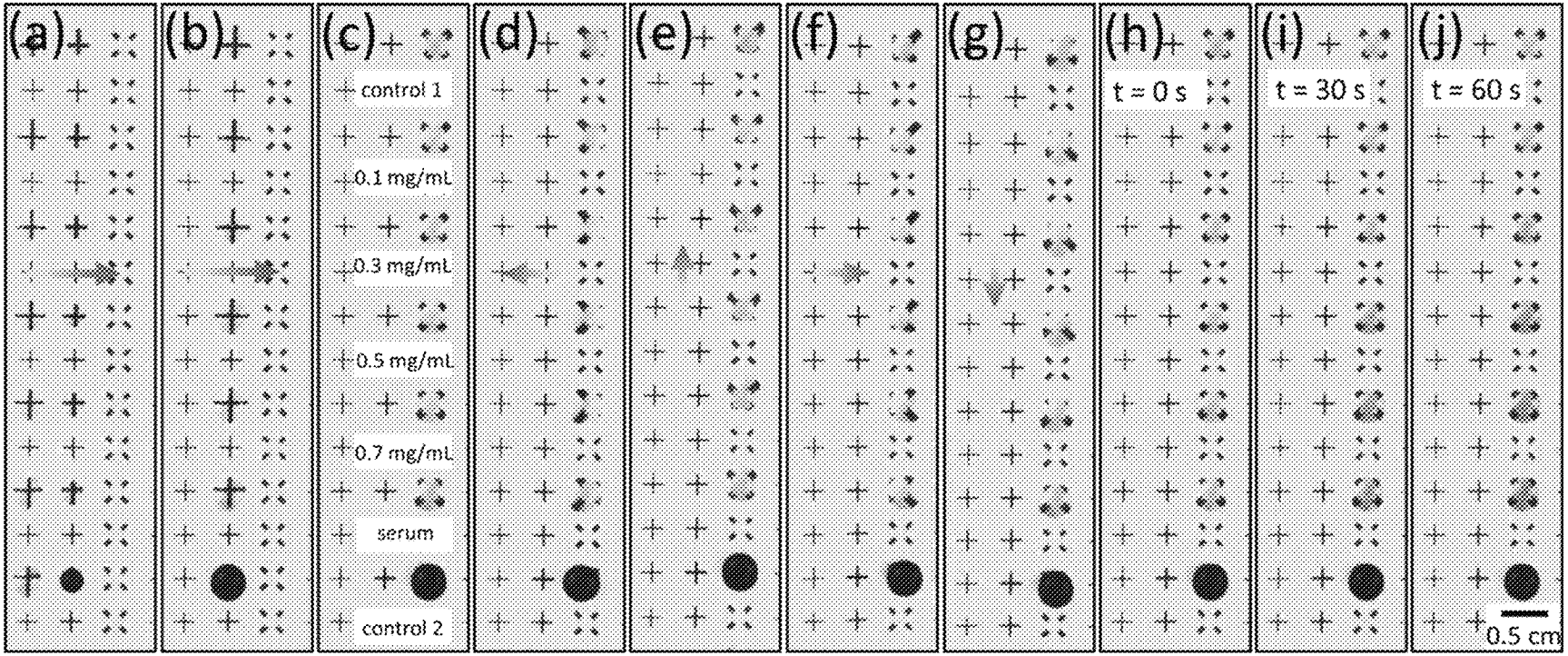
FIG. 31 Glucose detection on the droplet actuation system. (a) Glucose standards of different concentrations are placed on the middle column of plus symbols and the glucose reagents are placed on the leftmost column. (b) The stage is tilted to the right and the two columns of droplets merge on the middle column. (c) The merged droplets settle on the third column. (d-g) The stage is agitated in multiple directions to mix the combined droplets. (h-j) The merged droplets are incubated for the chemical reaction and the colour change is visible after around 10 seconds of incubation. The colour intensity is darker for droplets having higher glucose concentrations. Scale bar=0.5 cm.
Figure 32:
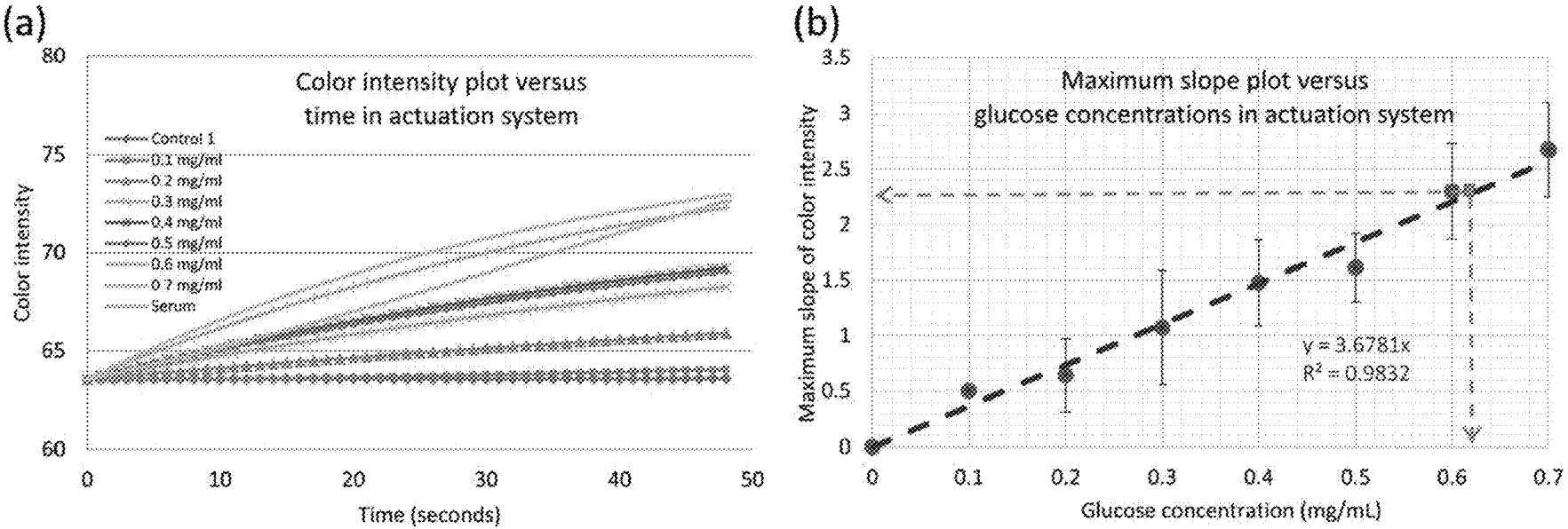
FIG. 32 Determination of glucose concentrations in sheep serum. (a) The colour intensities of incubated droplets at different time points are shown. Each glucose concentration is tested three times (n=3). (b) The maximum slope of each colour intensity graph at different glucose concentrations is plotted to obtain the standard curve equation and to determine the glucose concentration in sheep serum.
Figure 33:
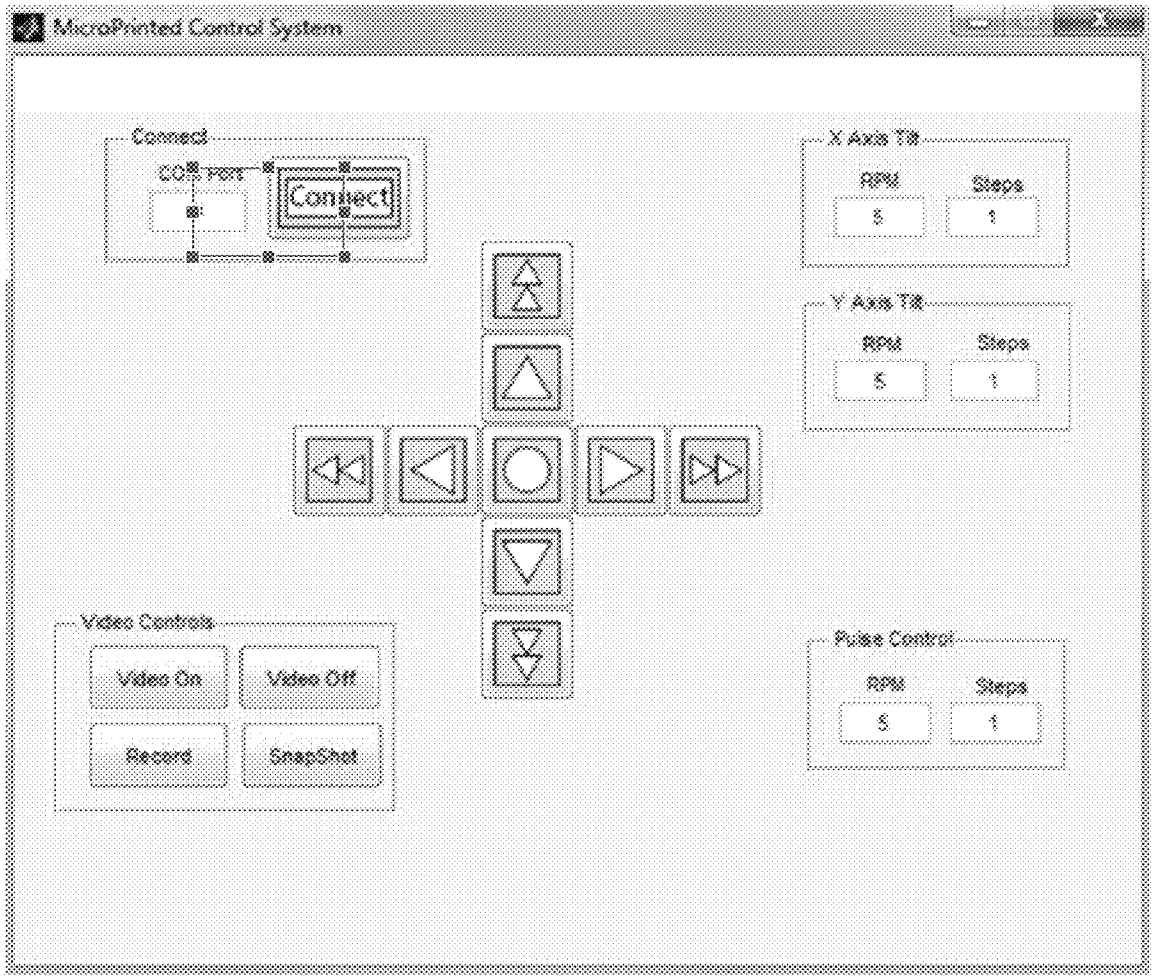

FIG. 33 Screenshot of the Graphical User Interface (GUI) to remotely control the droplet actuation system. The connect button automatically searches for available COM port numbers. The circle button at the center resets the stage's horizontal position. The single arrow buttons in four directions tilt the stage and return it to its initial position according to the speed (i.e. revolutions per minute, r.p.m.) and distance (i.e. finite steps). The double arrow buttons tilt and hold the platform in the four directions. In addition, GUI offers the option to preview a live video, take a snapshot, or record a video file for future analysis.

Figure 34:
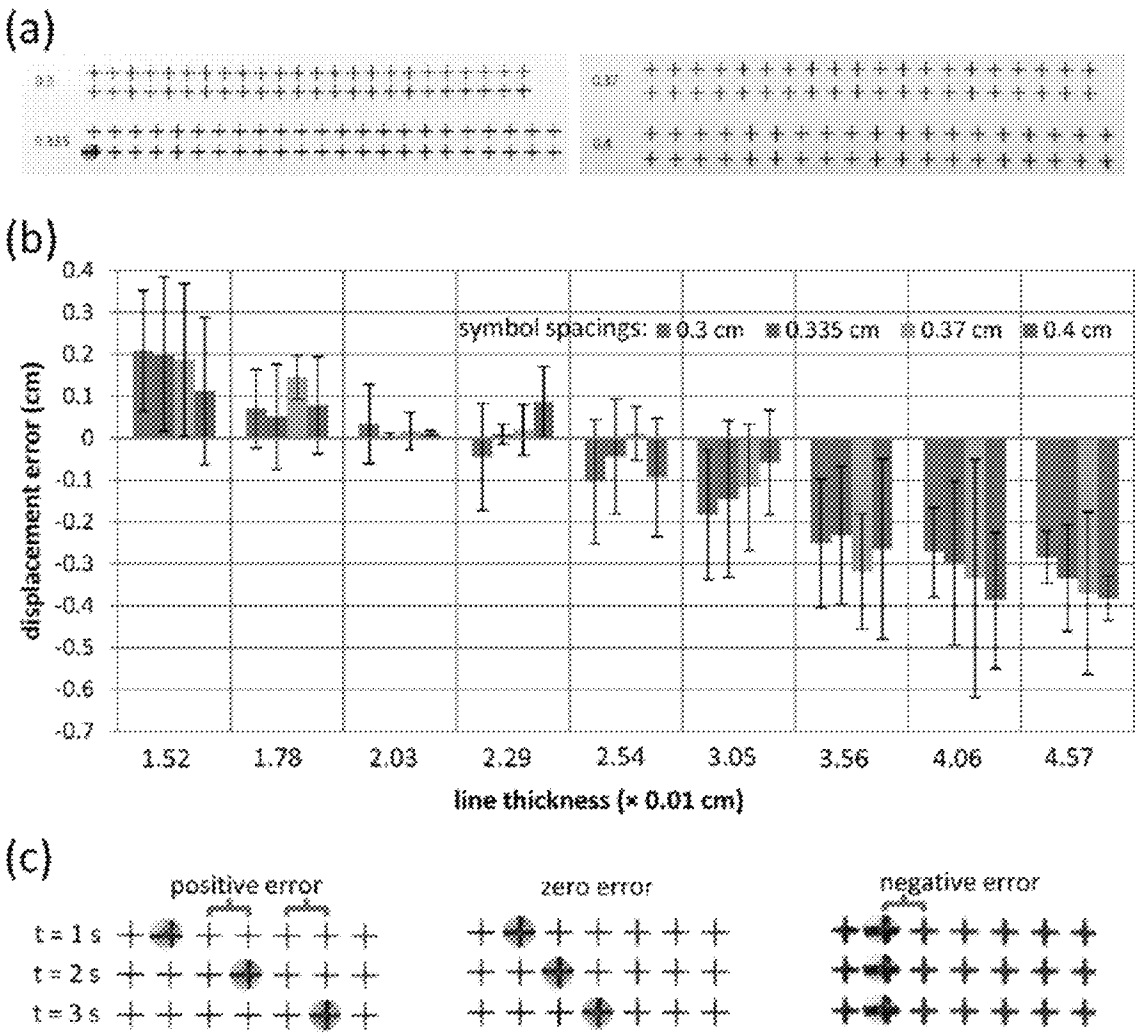

FIG. 34 Determination of the optimal line width and inter-symbol spacing for plus symbols. In all cases, the droplet volume is 10 μL, tilting speed is 100 r.p.m., and number of steps is 14. (a) Sectional images of the printed plus symbols having different line widths and inter-symbol spacing. A droplet is placed on a row of plus symbols and its movement is tracked upon tilting the stage to the right side. (b) The error in droplet displacement is plotted for different line widths; each line width with four inter-symbol spacing. The optimal design occurs when the displacement error is negligible. (c) Images of a droplet over plus symbols demonstrating our definition of positive error, zero error, and negative error when the stage is tilted to the right side. A positive error occurs when the droplet displacement is more than one symbol, a zero error occurs when the droplet displacement is exactly one symbol, and a negative error is noted when the droplet stays in its original position.

Figure 35:
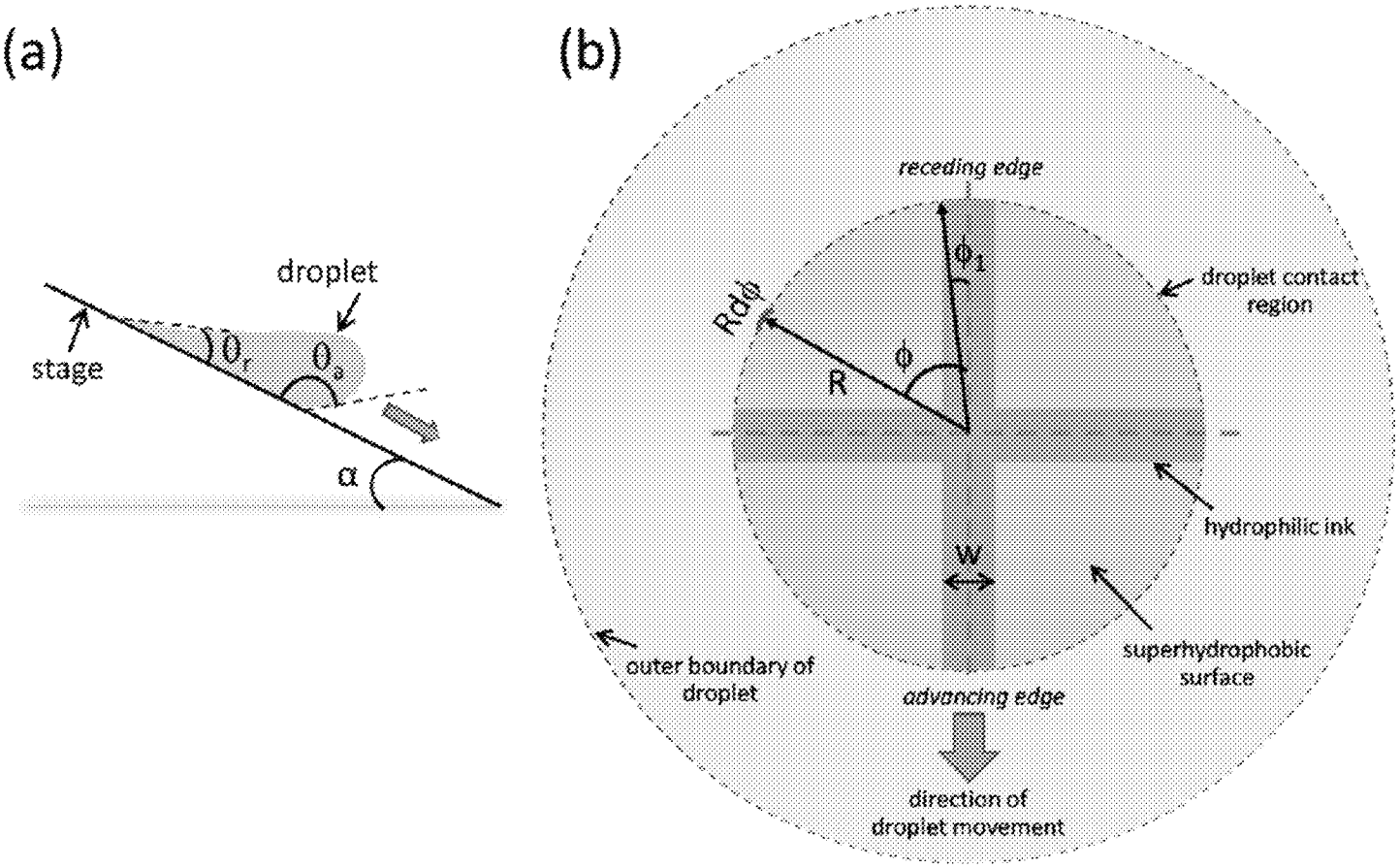

FIG. 35 Physical model for the droplet detachment from a hydrophilic plus symbol. (a) Side-view of the droplet ready to detach from the hydrophilic symbol when the stage is tilted to a critical angle α. (b) Topview of the droplet showing its contact with a plus symbol and the superhydrophobic surface.

Figure 36:
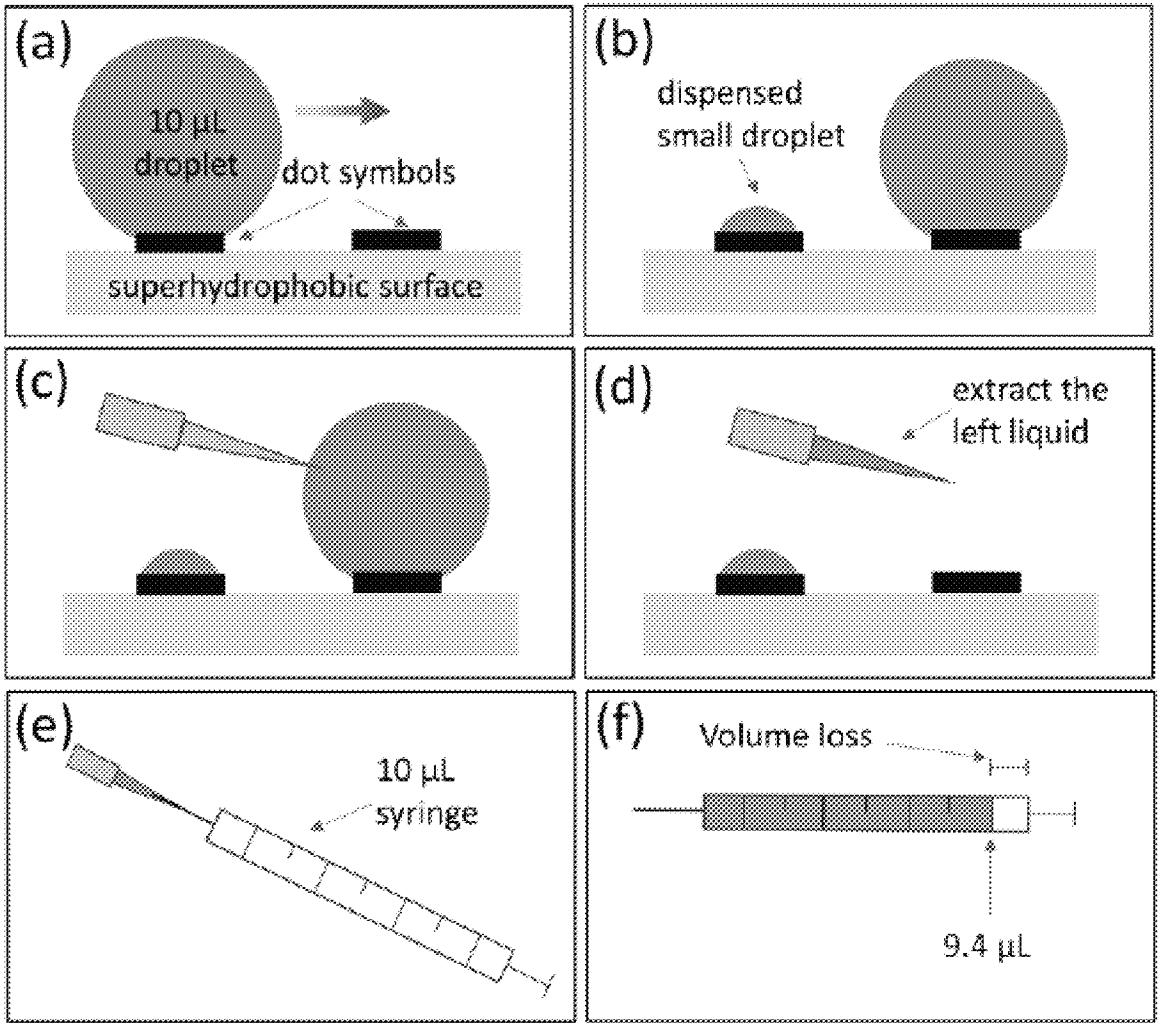

FIG. 36 Illustration of the procedure for measuring the volume of smaller droplet left or dispensed on a dot symbol. (a) 10 μL of water droplet initially pipetted (pipet-lite SL 10™) on the first dot symbol moves to the second dot symbol by tilting the stage. (b) A residual volume is dispensed on the first symbol and the remaining volume moves to the second dot symbol. (c)-(d) The remaining droplet on the second symbol is extracted into the pipette tip. (e) Using a 10 μL micro-syringe (Hamilton Microliter™ Syringe), the volume from the pipette tip detached from the pipette is transferred into the syringe. (f) The reading from the syringe shows the volume of the droplet after transport over one symbol (e.g. 9.4 μL as shown in the illustration).

TABLE S1

Data displaying the remaining volume (or volume left) on second symbol and volume dispensed (or volume lost) on different symbols for an initial water droplet volume of 10 μL. The symbols used in our experiment are plus symbols (line width = 0.02 cm, line length = 0.24 cm) and two different-sized, solid circular dot symbols (diameter = 0.109 cm and 0.148 cm, respectively). For each symbol, the number of repeats (n) for every experimental and control tests is 10.

| Initial droplet | Volume loss on different symbols (μL) | | | |
|---|---|---|---|---|
| volume = 10 μL | + | · | • | Control |
| Volume left | 9.71 ± 0.05 | 9.41 ± 0.05 | 9.12 ± 0.06 | 9.81 ± 0.07 |
| Volume lost | 0.29 ± 0.05 | 0.59 ± 0.05 | 0.88 ± 0.06 | 0.19 ± 0.07 |
| Volume left | 9.71 ± 0.05 | 9.41 ± 0.05 | 9.12 ± 0.06 | 9.81 ± 0.07 |
| volume lost | 0.29 ± 0.05 | 0.59 ± 0.05 | 0.88 ± 0.06 | 0.19 ± 0.07 |

TABLE S2

Data displaying the remaining volume (or volume left) on the final symbol and volume dispensed (or volume lost) on multiple dot symbols for an initial water droplet volume of 10 μL. Each solid circular dot symbol has a diameter = 0.148 cm. For each symbol, the number of repeats (n) for every experimental and control tests is 10.

| Initial droplet | Volume loss on different symbols (μL) | | | |
|---|---|---|---|---|
| volume = 10 μL | • | •• | ••• | Control |
| Volume left | 9.12 ± 0.06 | 8.39 ± 0.09 | 7.69 ± 0.1 | 9.81 ± 0.07 |
| Volume dispensed | 0.88 ± 0.06 | 1.61 ± 0.09 | 2.31 ± 0.1 | 0.19 ± 0.07 |

Figure 37:
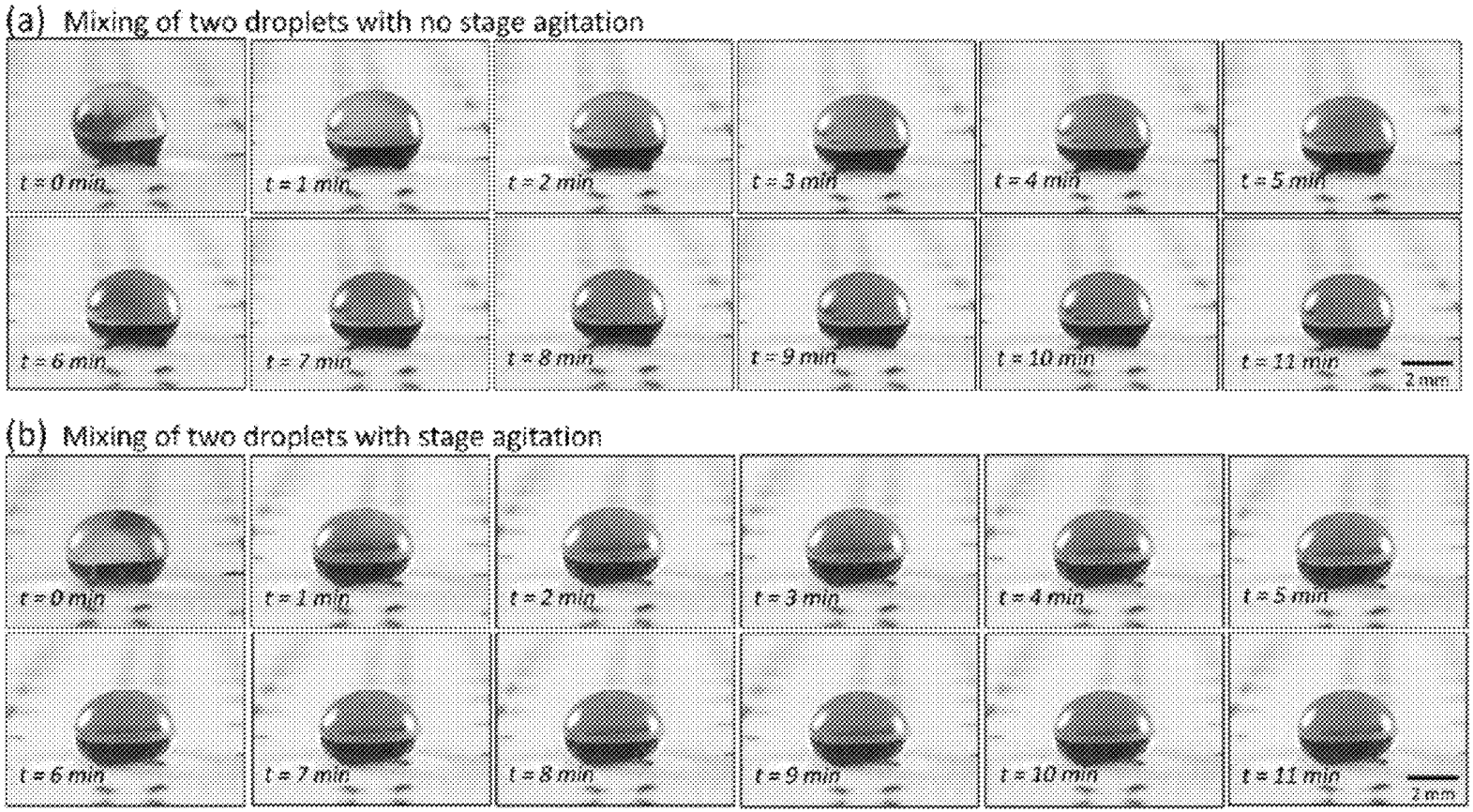

FIG. 37 Images of merged droplets (from 5 μL of a red droplet and 20 μL of a yellow droplet) as a function of time show the effect of stage agitation on enhancing molecular diffusion in the droplet. The blend ratio is 1:4 to produce an orange droplet, as per the datasheet of the dyes (Tone's Food Color Kit™). A webcam (Logitech C920) is used to record the droplet mixing as a video file. The video file (resolution: 1280×720 pixels) is analyzed to extract the color intensities of four detection zones (15×15 pixels) within the droplet. A detection zone outside the droplet is used as the control zone. (a) Side-view of the merged droplet with no stage agitation. (b) Side-view of the merged droplet with stage agitation. Scale bar=2 mm.

Figure 38:
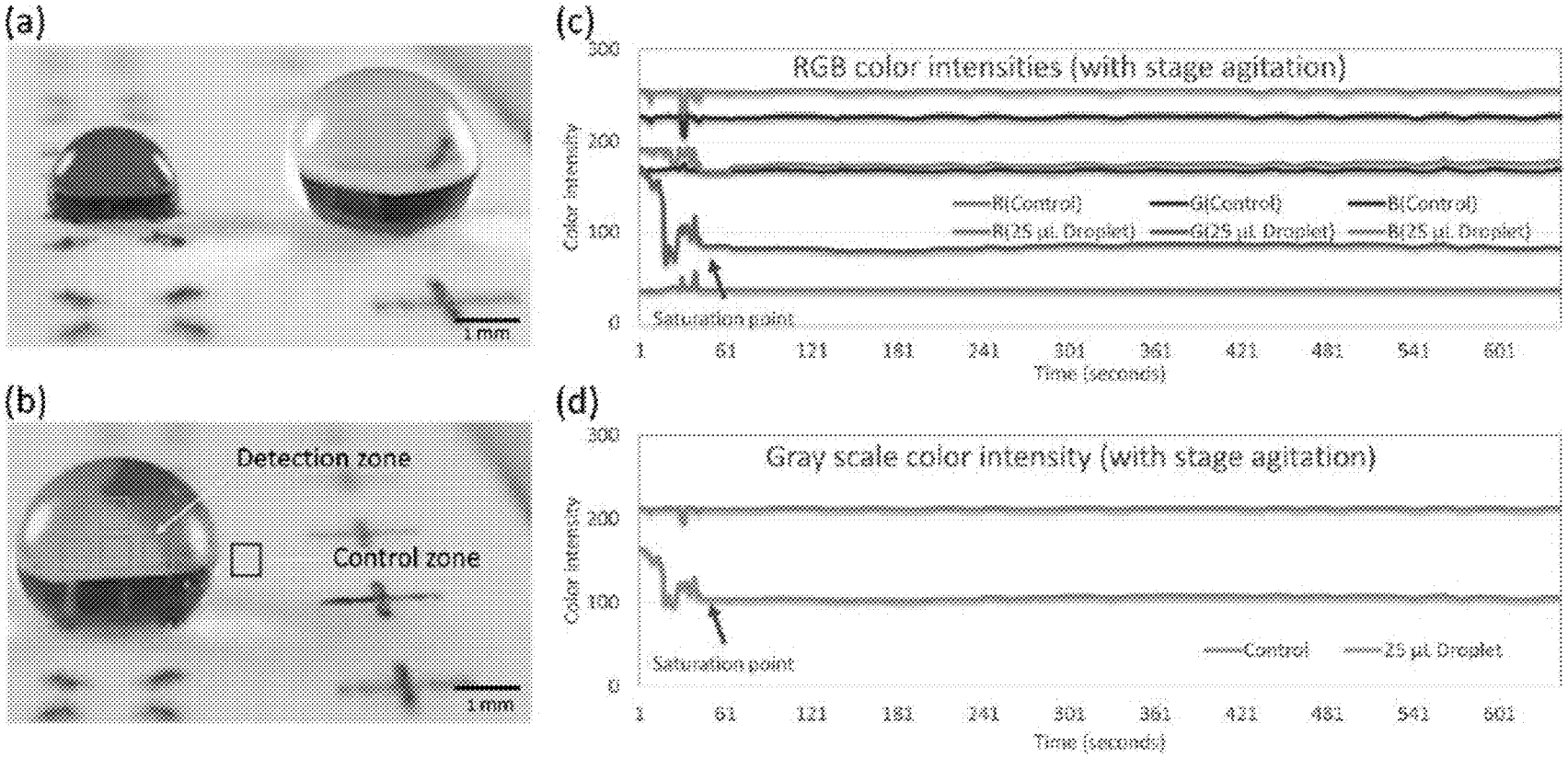

FIG. 38 Characterizing the mixing profile in a merged droplet with stage agitation. (a) Side-view of a red droplet (5 μL) and yellow droplet (20 μL) placed on individual symbols. (b) Side-view of the merged droplet. (c) Plot of the averaged RGB color intensities of the four detection zones, along with RGB color intensities of the control zone. (d) Plot of the averaged grayscale color intensities of the four detection zones, along with grayscale color intensities of the control zone.

Figure 39:
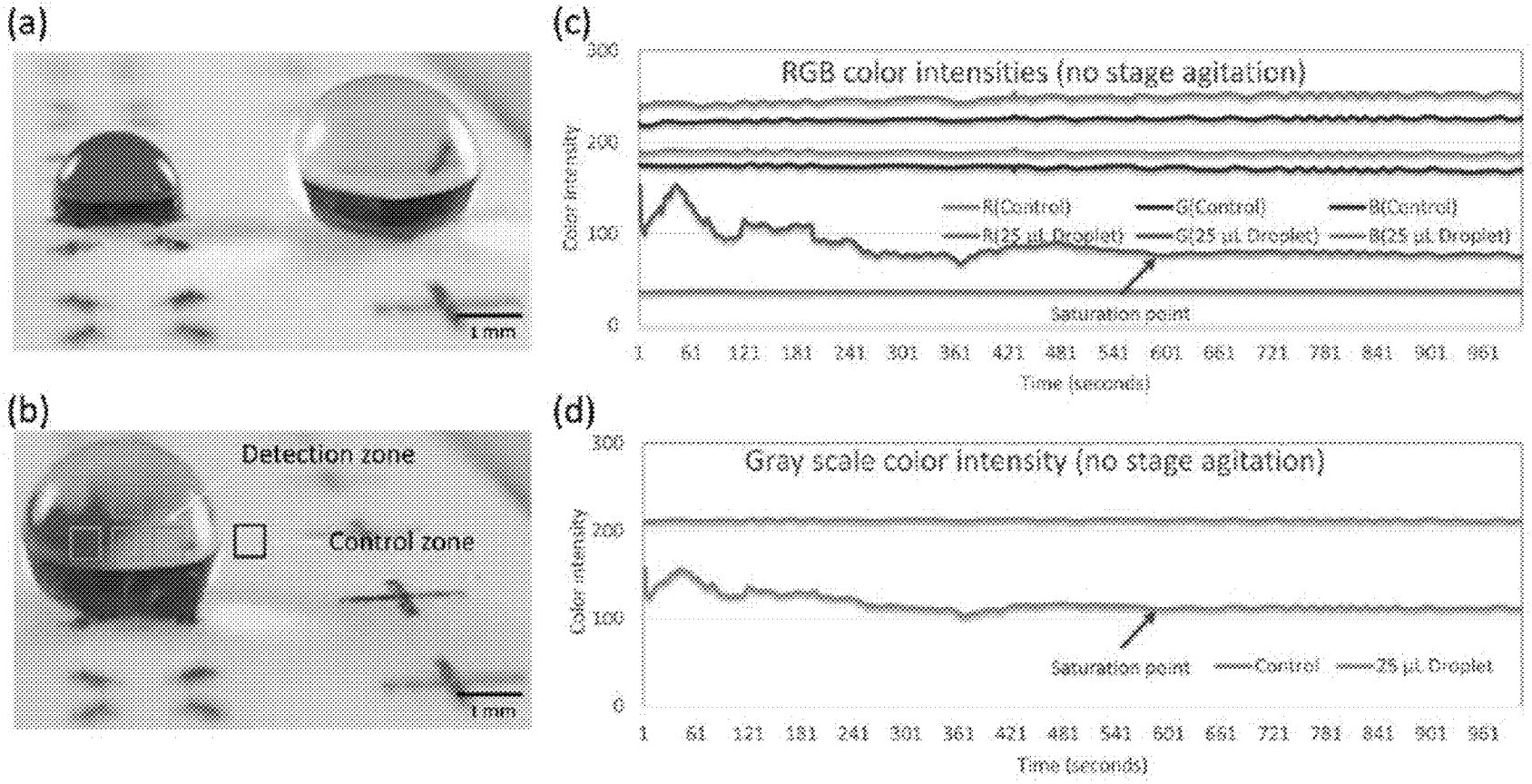

FIG. 39 Characterizing the mixing profile in a merged droplet by passive diffusion (i.e. without stage agitation). (a) Side-view of a red droplet (5 μL) and yellow droplet (20 μL) placed on individual symbols. (b) Side-view of the merged droplet. (c) Plot of the averaged RGB color intensities of the four detection zones, along with RGB color intensities of the control zone. (d) Plot of the averaged grayscale color intensities of the four detection zones, along with grayscale color intensities of the control zone.

Figure 40:
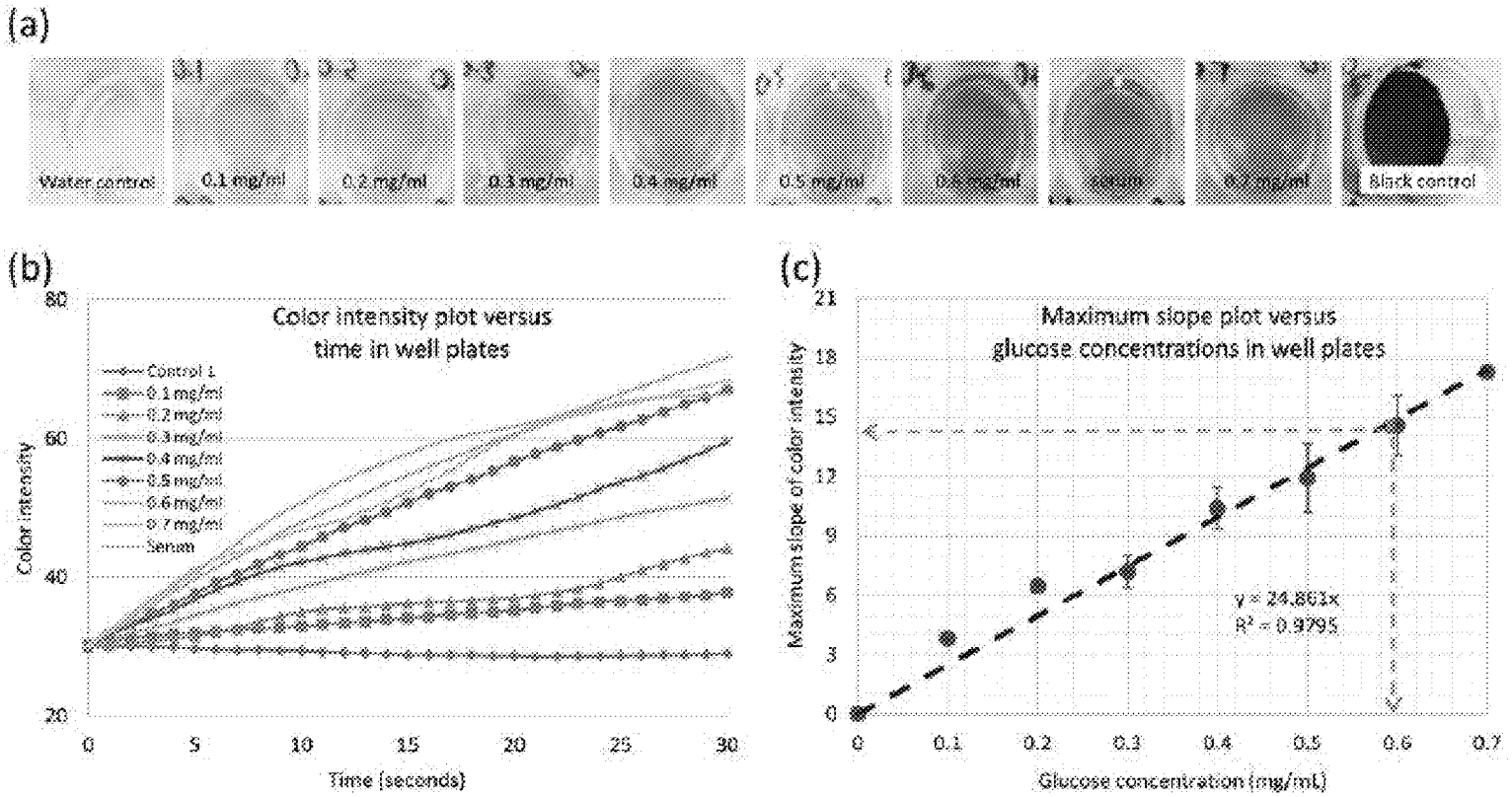

FIG. 40 Glucose testing in 24-well plates. (a) In each well, different concentrations of 250 μL of glucose standard solutions are pipetted. After that, 500 μL of the assay reagent is added in each well. A webcam is used to record the color intensity changes within each well plate for 30 minutes. Each glucose concentration is tested three times (n=3). (b) A Matlab script estimates the color intensity in each well at different time points. (c) The maximum slope of each color intensity graph is plotted to obtain the standard curve equation and to estimate the concentration of glucose in sheep serum.

Additional video files: See http://pubs.rsc.oreen/content/articlelanding/2016/lc/c6lc00176a#!divAbstract (incorporated by reference herein)

Supplemental Video 1.

Transport of single and multiple droplets (10 μL), transport of larger droplets (80 μL and 300 μL), and merging of three droplets.

Supplemental Video 2.

One-directional transport on single greater-than symbol and three converging greater-than symbols, dispensing small droplets on symbols (dot, rectangular, and diamond-shaped), and glucose detection test.

Supplemental Video 3.

Tests showing the volume range of three fluids (water, milk, and ethylene glycol) that can be transported using fixed operating conditions (speed=100 rpm, number of steps=14).

F. Options and Alternatives

As indicated above, variations and options are possible with the invention. Variations obvious to those skilled in the art will be included with the invention. Examples of options and alternatives have been discussed above. Additional examples follow.

For example, the form factor, shape, and size of platform, the motors, base, the belts, and the connections can vary according to the need or desire.

By way of other examples, the materials for the pattern surface on top of the platform can vary. Examples of patterns which are neither exclusive nor conclusive have been described. Others are possible. As will be appreciated by those skilled in the art, an etched or cut surface can be produced in a number of ways. Programmable tools can cut or etch a pre-programmed pattern in a surface. Chemical etching is possible. If the pattern in formed in a sheet, cutting operations on the sheet can be performed by machines that can cut or etch a sheet. Just like hydrophilic material can be added to a surface, e.g. by a printer which can be pre-programmed to print a pattern on a sheet, such machines can be pre-programmed to cut or etch a pattern. In one example, a transparent flexible sheet (e.g. plastic) is coated with a hydrophobic material. Non-limiting examples are a spray coating, Teflon, or Parylene. Once the coating is established on the sheet, the combination can be passed through a machine to add the pattern (e.g. printer or cutter).

In some cases, the designer or user will prefer a cut or etched pattern instead of an ink printed pattern. Sometimes an ink printed pattern will degrade or dissolve, at least after a certain period of time, when in contact with a liquid.

In some cases, the designer or user will prefer a closed or enclosed surface instead of open surface. A closed or enclosed surface, for example, may deter evaporation of the fluid droplets. By closed or enclosed surface it is meant that a surface patterned in one of the ways described herein is covered or sealed from the general surrounding environment. It does not interfere with the droplets or their movement, but controls the atmosphere right at the droplets.

The exemplary embodiments focus on a platform surface having hydrophilic and hydrophobic areas. At least some aspects of the invention are envisioned to be applicable in analogous fashion to droplets that might not respond to hydrophilic and hydrophobic materials. For example, oleophilic and oleophobic materials could be used for oil-based droplets. Principles of the invention can work with omniphilic and omniphobic materials, for droplets that respond in the ways needed.

Likewise, the types of manipulations can be varied or standard.

Also, the ability to instruct manipulation operation can take different forms. As will be appreciated by those skilled in the art, programmable control can include a variety of devices. Non-limiting examples are a desk top computer, a lap top computer, a tablet computer, a PDA, or a smart phone equipped with the necessary software or applications, or other digital or intelligent devices including digital controllers and the like. Tasks can also be shared or completed by a combination of such devices.

The invention claimed is:

1. An apparatus for manipulation of one or more liquid droplets comprising:

a base;

a column mounted to the base at a first end and having a second end extending away from the base;

a joint mounted on the second end of the column;

a platform having a bottom connected to and supported on the joint, first and second opposite sides, and a planar top surface and with a pattern of a plurality of spaced-apart droplet locations separated by interstitial hydrophobic areas, each droplet location comprising a shape of a size and thickness above the planar top surface or a groove of a size and depth below the top planar surface;

a stepper motor mounted on the base and including a driven rotatable pulley and electrical connection to a motor control circuit to control number of steps, stepping speed, and step direction of the stepper motor;

an elongated belt having a length between opposite ends, the opposite ends attached to the first and second opposite sides of the platform and with the length of the elongated belt tensioned around the pulley holding the planar top surface of the platform in a home position in a first plane such that rotation of the pulley drives the belt to move the platform in a direction, a distance, and at a speed in response to the rotation of the pulley and tilt the platform on the joint out of the first plane in a direction, an amount, and at a speed in response to movement of the belt; and a programmable controller in electrical communication with the motor control circuit controlling the direction, the number of steps, the stepping speed, and the step direction of the stepper motor to drive rotation of the pulley to cause the belt to tilt the top surface of the platform from the home position in the first plane an amount in a range of 0-4.5 degrees at a speed of between 2.2 radians/sec. and 2.7 radians/sec.

2. The apparatus of claim 1 wherein each the plurality of the droplet locations further comprises hydrophilic material.

3. The apparatus of claim 1 further comprising a second stepper motor having a motor axle that can be controlled to move the platform in a direction, a distance, and at a speed of rotation, and a second belt having opposite ends attached to third and fourth opposite sides of the platform such that rotation of the pulley of the second stepper motor moves the platform a direction, a distance, and at a speed to therefore tilt the planar top surface of the platform out of the first plane from the home position in a second tilt direction, to a second tilt angle, and at a second tilt speed for the top planar surface of the planar top surface of the platform independent of the first stepper motor.

4. The apparatus of claim 3 wherein the programmable controller electrically communicates with the motor control circuit to control both the stepper motor and the second stepper motor to tilt the planar top surface of the platform on the joint in any direction.

5. The apparatus of claim 1 wherein at least a portion of the belt has elasticity and resilience to promote an enhanced jerking action on the platform during tilting.

6. The apparatus of claim 1 wherein each of the plurality of each of the droplet locations of the pattern comprises a shape and size which is one of:

a. the same for all of the droplet locations;

b. similar for all of the droplet locations, or c. different for at least some droplet locations.

7. The apparatus of claim 6 wherein each of the plurality of the droplet locations comprises one of:

a. a cross shape;

b. a V-shape in one direction;

c. a dot shape.

8. The apparatus of claim 7 wherein the size of each of the plurality of the droplet locations comprises:

a. at least one dimension larger than a second dimension.

9. The apparatus of claim 1 further comprising one or more of:

a. a through-hole in the surface at one or more droplet locations to facilitate porting of fluid at the one or more droplet locations;

b. a magnet at one or more of the droplet locations to facilitate magnetic separation at the one or more droplet locations.

10. The apparatus of claim 1 wherein the planar top surface is removable from the platform.

11. The apparatus of claim 10 wherein the removable surface comprises:

a flexible sheet or substrate of paper, plastic, or metal foil.

12. An apparatus for manipulation of one or more liquid droplets comprising:

a base;

a column mounted to the base at a first end and having a second end extending away from the base;

a joint mounted on the second end of the column;

a platform having a bottom connected to and supported on the joint, first and second opposite sides, and a planar top surface and with a pattern of a plurality of spaced-apart droplet locations separated by interstitial hydrophobic areas, each droplet location comprising a hydrophilic material;

a stepper motor mounted on the base and including a driven rotatable pulley and an electrical connection to a motor control circuit to control number of steps, stepping speed, and step direction of the stepper motor;

an elongated belt having a length between opposite ends, the opposite ends attached to the first and second opposite sides of the platform and with the length of the elongated belt tensioned around the pulley holding the planar top surface of the platform in a home position in a first plane such that rotation of the pulley drives the belt to move the platform in a direction, a distance, and at a speed in response to the rotation of the pulley and tilt the platform on the joint out of the first plane in a direction, an amount, and at a speed in response to movement of the belt; and a programmable controller in electrical communication with the motor control circuit, controlling the number of steps, stepping speed, and step direction of the stepper motor to drive rotation of the pulley to cause the belt to tilt the top surface of the platform from the home position in the first plane an amount in a range of 0-4.5 degrees at a speed of between 2.2 radians/sec. and 2.7 radians/sec.

13. The apparatus of claim 12 wherein each the plurality of the droplet locations further comprises a thickness height above the planar top surface or a groove of a size and depth below the top planar surface.

* * * * *